US012458835B2

(12) United States Patent
Pohl

(10) Patent No.: US 12,458,835 B2
(45) Date of Patent: Nov. 4, 2025

(54) PINION LOCK FOR ADJUSTABLE BARBELL SYSTEM

(71) Applicant: Johnson Health Tech Retail, Inc., Cottage Grove, WI (US)

(72) Inventor: Ryan J. Pohl, Camas, WA (US)

(73) Assignee: Johnson Health Tech Retail, Inc., Cottage Grove, WI (US)

( * ) Notice: Subject to any disclaimer, the term of this patent is extended or adjusted under 35 U.S.C. 154(b) by 179 days.

(21) Appl. No.: 18/512,928

(22) Filed: Nov. 17, 2023

(65) Prior Publication Data

US 2024/0181287 A1 Jun. 6, 2024

Related U.S. Application Data

(60) Provisional application No. 63/385,942, filed on Dec. 2, 2022.

(51) Int. Cl.

| | |
|---|---|
| ***A63B 21/072*** | (2006.01) |
| ***A63B 21/075*** | (2006.01) |
| ***A63B 71/00*** | (2006.01) |

(52) U.S. Cl.

CPC ..... *A63B 21/0728* (2013.01); *A63B 21/0724* (2013.01); *A63B 21/075* (2013.01); *A63B 71/0036* (2013.01)

(58) Field of Classification Search

CPC ..... A63B 21/0724; A63B 21/0728; A63B 21/075; A63B 71/0036

See application file for complete search history.

(56) References Cited

U.S. PATENT DOCUMENTS

| | | | | |
|---|---|---|---|---|
| 6,261,022 | B1 | 7/2001 | Dalebout et al. | |
| 6,540,650 | B1 | 4/2003 | Krull | |
| 7,087,000 | B1 * | 8/2006 | Walker | A63B 21/0728 482/106 |
| 7,862,487 | B2 * | 1/2011 | Olson | A63B 21/0728 482/98 |
| 8,932,188 | B2 * | 1/2015 | Svenberg | A63B 21/0728 482/106 |

(Continued)

FOREIGN PATENT DOCUMENTS

| | | |
|---|---|---|
| CN | 101099884 A | 1/2008 |
| CN | 104117180 A | 10/2014 |

(Continued)

OTHER PUBLICATIONS

"International Search Report and Written Opinion for PCT/US2023/080302, mailed on Mar. 14, 2024".

(Continued)

*Primary Examiner* — Joshua Lee

(74) *Attorney, Agent, or Firm* — Dorsey & Whitney LLP

(57) ABSTRACT

An adjustable barbell including a handle assembly having a bar, a weight selector assembly comprising a rod movably coupled to the bar, and a gear assembly configured to cause axial movement of the rod relative to the bar. A lock mechanism is included that has a first configuration disengaged from the gear assembly wherein the weight selector assembly is operable to move the rod to selectively couple one or more of a plurality of removable weights to the handle assembly, and a second configuration in engagement with the gear assembly preventing the rotation of the weight selector assembly.

19 Claims, 42 Drawing Sheets

(56) References Cited

U.S. PATENT DOCUMENTS

| | | | | |
|---|---|---|---|---|
| 9,452,312 | B2 * | 9/2016 | Svenberg | A63B 21/0724 |
| 9,566,465 | B2 * | 2/2017 | Svenberg | A63B 21/075 |
| 9,643,042 | B2 | 5/2017 | Madden | |
| 10,166,427 | B2 | 1/2019 | Myre | |
| 10,232,214 | B2 * | 3/2019 | Svenberg | A63B 21/0728 |
| 10,328,299 | B2 * | 6/2019 | Wang | A63B 1/00 |
| 10,617,905 | B2 | 4/2020 | Moran et al. | |
| 11,013,947 | B2 * | 5/2021 | Svenberg | A63B 21/072 |
| RE49,161 | E | 8/2022 | Myre | |
| 11,590,380 | B2 | 2/2023 | Pohl et al. | |
| 11,602,661 | B2 * | 3/2023 | Svenberg | A63B 21/075 |
| 11,771,941 | B2 * | 10/2023 | Luo | A63B 21/075 482/108 |
| 11,771,942 | B2 * | 10/2023 | Casagrande | A63B 24/0087 482/108 |
| 11,865,397 | B2 * | 1/2024 | Svenberg | A63B 21/075 |
| 12,011,634 | B2 | 6/2024 | Pohl et al. | |
| 12,076,605 | B2 * | 9/2024 | Sun | A63B 21/0726 |
| 12,076,606 | B2 * | 9/2024 | Svenberg | A63B 21/0728 |
| 2003/0148862 | A1 | 8/2003 | Chen et al. | |
| 2004/0005968 | A1 | 1/2004 | Crawford et al. | |
| 2005/0233873 | A1 | 10/2005 | Chen | |
| 2007/0225132 | A1 | 9/2007 | Liu | |
| 2009/0197745 | A1 | 8/2009 | Olson | |
| 2009/0305852 | A1 | 12/2009 | Höglund | |
| 2010/0304940 | A1 | 12/2010 | Svenberg et al. | |
| 2010/0323856 | A1 | 12/2010 | Svenberg et al. | |
| 2013/0231224 | A1 | 9/2013 | Svenberg | |
| 2013/0324375 | A1 * | 12/2013 | Svenberg | A63B 21/00065 482/108 |
| 2015/0367164 | A1 | 12/2015 | Myre | |
| 2017/0072248 | A1 | 3/2017 | Chen | |
| 2017/0239510 | A1 | 8/2017 | Wang | |
| 2017/0252599 | A1 | 9/2017 | Wang | |
| 2019/0168058 | A1 * | 6/2019 | Svenberg | A63B 21/072 |
| 2020/0306578 | A1 | 10/2020 | Pohl et al. | |
| 2022/0331641 | A1 | 10/2022 | Weng | |
| 2023/0181958 | A1 * | 6/2023 | Fu | A63B 71/0036 482/107 |
| 2023/0293933 | A1 | 9/2023 | Pohl et al. | |
| 2024/0390725 | A1 | 11/2024 | Pohl et al. | |

FOREIGN PATENT DOCUMENTS

| | | | |
|---|---|---|---|
| CN | 110292744 | A | 10/2019 |
| CN | 110368640 | A | 10/2019 |
| CN | 108926802 | B | 10/2020 |
| TW | 201609223 | A | 3/2016 |
| WO | 2020205317 | A1 | 10/2020 |
| WO | 2024118362 | A1 | 6/2024 |

OTHER PUBLICATIONS

"Extended European Search Report for EP24183085.0, mailed on Sep. 18, 2024".

International Search Report and Written Opinion for PCT/US2020/024305 mailed on Jun. 25, 2020.

"Office Action and Translation for 202080036887.3, mailed Apr. 19, 2022".

"Office Action and Translation for TW Appl. No. 109110040, mailed on Aug. 14, 2023 pp. all".

"Office Action for TW Appl. No. 113126224, mailed Jan. 10, 2025".

* cited by examiner

PINION LOCK FOR ADJUSTABLE BARBELL SYSTEM

CROSS-REFERENCE TO RELATED APPLICATION(S)

This application claims the benefit of U.S. Provisional Application No. 63/385,942, filed on Dec. 2, 2022, the disclosure of which is hereby incorporated by reference in its entirety.

FIELD

The present disclosure relates generally to an exercise system including an adjustable free weight, such as an adjustable barbell, and a weight selector assembly for an adjustable free weight, such as a barbell.

BACKGROUND

Free weights, such as dumbbells and barbells, are widely used exercise devices for providing resistance training in a wide variety of exercises such as bicep curls, bench presses, shoulder presses, triceps extensions, and the like. Due to the number of exercises that may be performed with free weights, users often need a large number of free weights, each with different weights, to perform an exercise routine, or as their strength changes over time. Traditional dumbbells and barbells are somewhat inconvenient to use because each time a user desires to change the weight of the free weight, the user either has to select a heavier free weight, or disassemble the free weight to change the weight, for instance by removing a collar and then adding or removing weight plates of different incremental weights. This process is time consuming, can lead to injury (e.g., from pinching fingers between plates, dropping plates on the user's feet, or others), and also because it requires decision making by the user as to the number and combination of plates that need to be assembled to the handle bar to achieve the desired weight. Adjustable-weight (or simply adjustable) dumbbells have been developed to allow the user to more efficiently adjust the weight of the free weight device, one example of which is the BOWFLEX SELECTTECH dumbbell system. While some adjustable dumbbell and barbell systems have been developed, designers and manufacturers continue to seek improvements to the same.

SUMMARY

Described herein are examples of an adjustable barbell. The adjustable barbell has a handle assembly that includes: a bar; a weight selector assembly with a selector housing fixed to the bar and a selector knob rotatably coupled to the bar; and a first weight fixed to the bar. The weight selector assembly is operable to engage a plurality of removable weights to selectively couple one or more of the plurality of removable weights to the handle assembly based on a rotational position of the selector knob with respect to the bar.

Optionally, in some embodiments, the first weight may be fixed to the selector housing. The weight selector assembly may include a rod coupled to the bar such that the rod moves along an axial direction of the bar responsive to a rotation of the knob relative to the bar. The bar may be a curl bar.

Optionally, in some embodiments, the adjustable barbell may include a pawl movably attached to a distal end of the rod to prevent extension of the rod beyond a distal face of the first weigh or a removable weight, when the distal face of the first weight or the removable weight is not interlocked with another removable weight. The pawl may be pivotally coupled to the rod to pivots radially away from the rod.

Optionally, in some embodiments, the adjustable barbell may include a detent assembly configured to urge the selector knob toward one of a plurality of predetermined rotational positions.

Optionally, in some embodiments, the adjustable barbell may include a weight selector assembly includes a selector ring rotatably coupled to the selector housing, and wherein the knob is fixed to the selector ring such that the rotation of the knob rotates the selector ring. In some embodiments, the adjustable barbell may include a plunger and a biasing element that urges the plunger toward the selector ring. The plunger and biasing element may be non-rotatably coupled to the selector housing. The selector ring may include one or more markings configured to indicate a selected weight of the barbell.

Optionally, in some embodiments, the selector assembly may include a gear assembly configured to convert the rotation of the selector ring to an axial movement of the rod. The gear assembly may include a main bevel gear fixed to the selector ring, a rack provided on (e.g., extending along the length of) the rod, a pinion gear operatively associated with the rack, and a plurality of intermediate gears operatively engaged between the main bevel gear and the rack to drive the rod responsive to rotation of the main bevel gear. The plurality of intermediate gears may include an intermediate bevel gear meshed with the main bevel gear, a first spur gear coaxial and rotating synchronously with the intermediate bevel gear, and a second spur gear meshed with the first spur gear. The second spur gear may be coaxial to and rotating synchronously with a pinion gear operatively associated with the rack.

Optionally, in some embodiments, the rod may include a longitudinal slot configured to engage a transverse pin for limiting the axial movement of the rod. A rack may be integrally formed with the rod on a surface of the rod opposite the longitudinal slot.

Optionally, in some embodiments, the weight selector assembly may be one of a pair of weight selector assemblies, each coupled to an opposite end of the bar and each being independently operable to selectively couple one or more of the removable weights to the respective end of the bar.

Examples of an adjustable barbell system are described herein. The adjustable barbell system may include an adjustable barbell as described herein, the plurality of removable weights; and a base configured to support the adjustable barbell. The base may be configured to automatically unlock the barbell for weight adjustment when the barbell is placed on the base.

Optionally, in some embodiments, the barbell may include a locking mechanism configured to resist rotation of the knob relative the bar when the barbell is removed from the base. The base may include a lock disengagement pin configured to actuate a locking pin of the barbell when the barbell is placed on the base. The locking pin may be biased toward a locked configuration in which the locking pin interferes with rotation of the knob. The locking pin may include a first portion and a second portion narrower than the first portion; the rod may include a plurality of spaced apart divots; and the locking pin may be oriented transversely to a length of the rod such that the first portion is received in one of the plurality of divots when the locking pin is in the locked configuration and the second portion is non-interferingly aligned with a divot when the locking pin is in an unlocked configuration.

Optionally, in some embodiments, the adjustable barbell may include an over-center mechanism having a plurality of stable positions that correspond to the plurality of predetermined rotational positions of the selector knob. Each of the plurality of predetermined rotational positions of the selector knob is a position in which the selector mechanism selectively couples one or more of the plurality of removable weights to the handle assembly, and a plurality of unstable positions that correspond to rotational positions of the selector knob between the predetermined rotational positions. In some embodiments, the over-center mechanism includes a selector ring rotatably coupled to the selector housing and fixed to the selector knob such that rotation of the selector knob rotates the selector ring, and a plurality of cams with raised surfaces disposed on an inner surface of the selector ring, which cams are interspersed between a plurality of detents, the raised surfaces corresponding to the plurality of unstable positions of the over-center mechanism. The raised surfaces may include hills having generally straight sloping sides that meet at a peak and terminate at a trough. The barbell system may include a cam follower that engages the cam. The cam follower may be biased into the engagement with the cam to urge the over-center mechanism toward a stable position of the plurality of stable positions. The cam follower may be biased radially outward from a longitudinal axis of the bar. The cam follower may include an engagement end tapered to a size such that the engagement end can engage any of the detents. The plurality of detents may correspond to the stable positions.

Optionally, in some embodiments, the adjustable barbell may include a removable spacer between the base and the plurality of weights and configured to operatively position the barbell on the base for automatic unlocking of the barbell when placed on the base.

Optionally, in some embodiments, each of the plurality of removable weights may include a plurality of interlocking features arranged peripherally on each major face of the removable weight. In some embodiments, each of the plurality of removable weights may include a plate having first and second opposing major faces. Each of the removable weights may include a plurality of tabs extending from one of the first and second opposing major faces and a plurality of apertures formed in the other one of the first and second opposing major faces.

Optionally, in some embodiments, the base may include a media holder. The base may be supported on a stand configured to support one or more additional handle assemblies. The base and the stand may include separate leveling features for independently leveling each of the base and the stand on a support surface.

Optionally, in some embodiments, the adjustable barbell may include an extension prevention mechanism that prevents the weight selector assembly from selecting additional weights when a weight is missing from the plurality of removable weights. In some embodiments, each of the plurality of removable weights may include a relief feature allowing extension of the rod beyond a distal face of a last selected weight without coupling a weight distal to the last selected weight to the barbell.

Described herein are examples of an adjustable barbell. The adjustable barbell includes a plurality of weights; and a handle assembly. The handle assembly includes a bar and a weight selector assembly. The weight selector assembly includes a selector housing fixed to the bar and a selector knob rotatably coupled to the bar, and an over-center mechanism. The over-center mechanism includes a plurality of stable positions that correspond to a plurality of predetermined rotational positions of the selector knob, wherein each of the plurality of predetermined rotational positions of the selector knob is a position in which the weight selector mechanism securely couples one or more of the plurality of removable weights to the handle assembly, and a plurality of unstable positions that correspond to rotational positions of the selector knob between the predetermined rotational positions, wherein each unstable position is configured to move the selection knob into one of the stable positions.

Described herein are examples of an adjustable barbell. The adjustable barbell includes a plurality of weights and a handle assembly. The handle assembly includes a bar and a weight selector assembly operable to engage the plurality of weights to selectively couple one or more of the plurality of weights to the handle assembly based on a rotational position of the selector knob with respect to the bar. The weight selector assembly includes a selector housing fixed to the bar and a selector knob rotatably coupled to the bar, a rod movably coupled to the bar such that the rod moves along an axial direction of the bar responsive to a rotation of the knob relative to the bar, and a pawl movably attached to a distal end of the rod to prevent the rod from coupling a weight from the plurality of weights to the weight selector assembly unless the weight is interlocked to a distal face of another weight of the plurality of weights that is already coupled to the weight selector assembly.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

The drawings are not necessarily to scale. In certain instances, details unnecessary for understanding the disclosure or rendering other details difficult to perceive may have been omitted. In the appended drawings, similar components and/or features may have the same reference label. The claimed subject matter is not necessarily limited to the particular examples or arrangements illustrated herein.

DETAILED DESCRIPTION

Described here is an adjustable barbell system that allows a user to change the weight of the barbell by selecting a barbell weight setting which effects a selective coupling of one or more of removable weight plates (or interchangeably weights or plates) to the bar, obviating the need for the user to manually add or remove weights from the ends of the bar.

Figure 1:
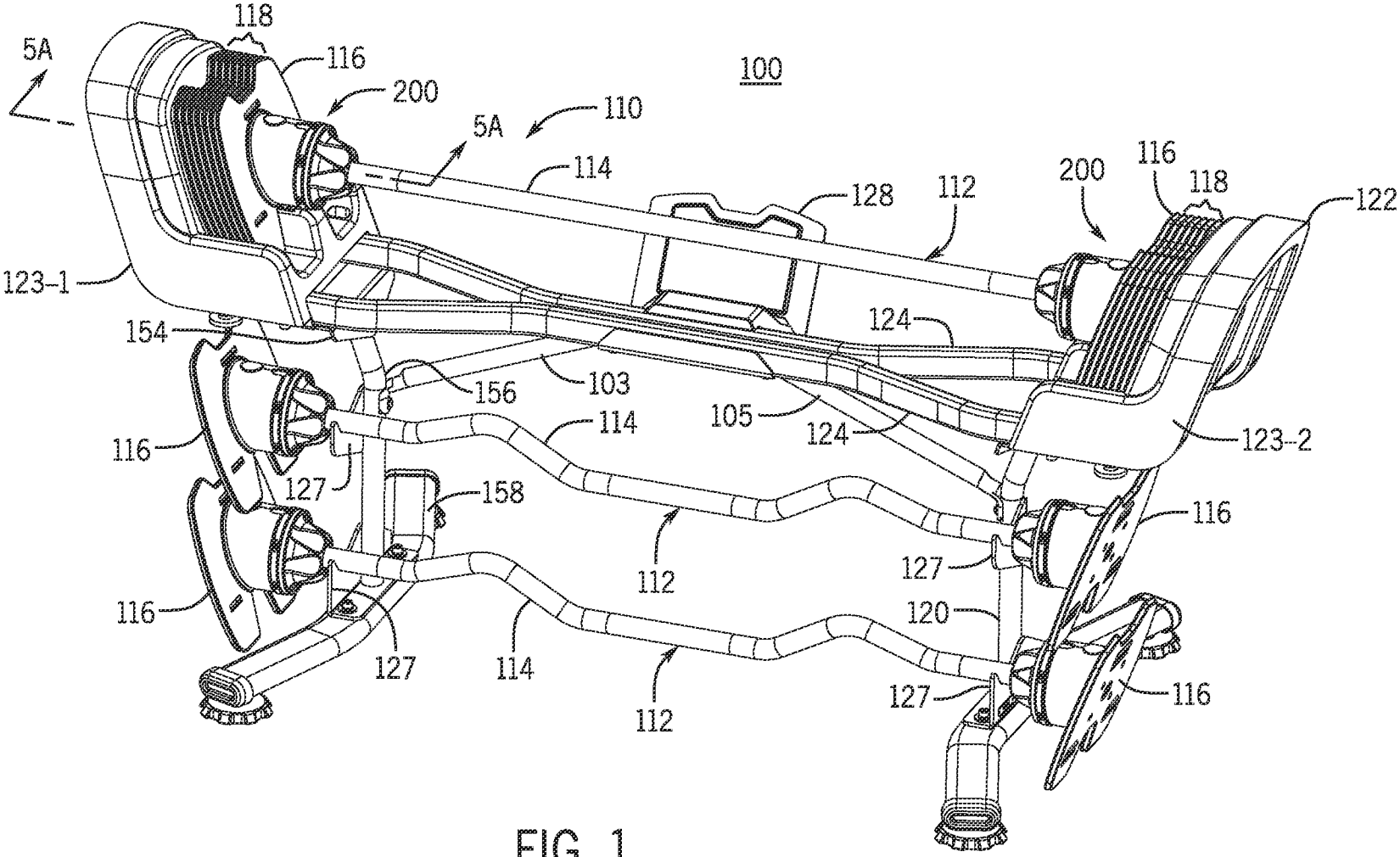
FIG. 1 shows an isometric view of an adjustable barbell system according to some embodiments of the present disclosure.
Figure 2:
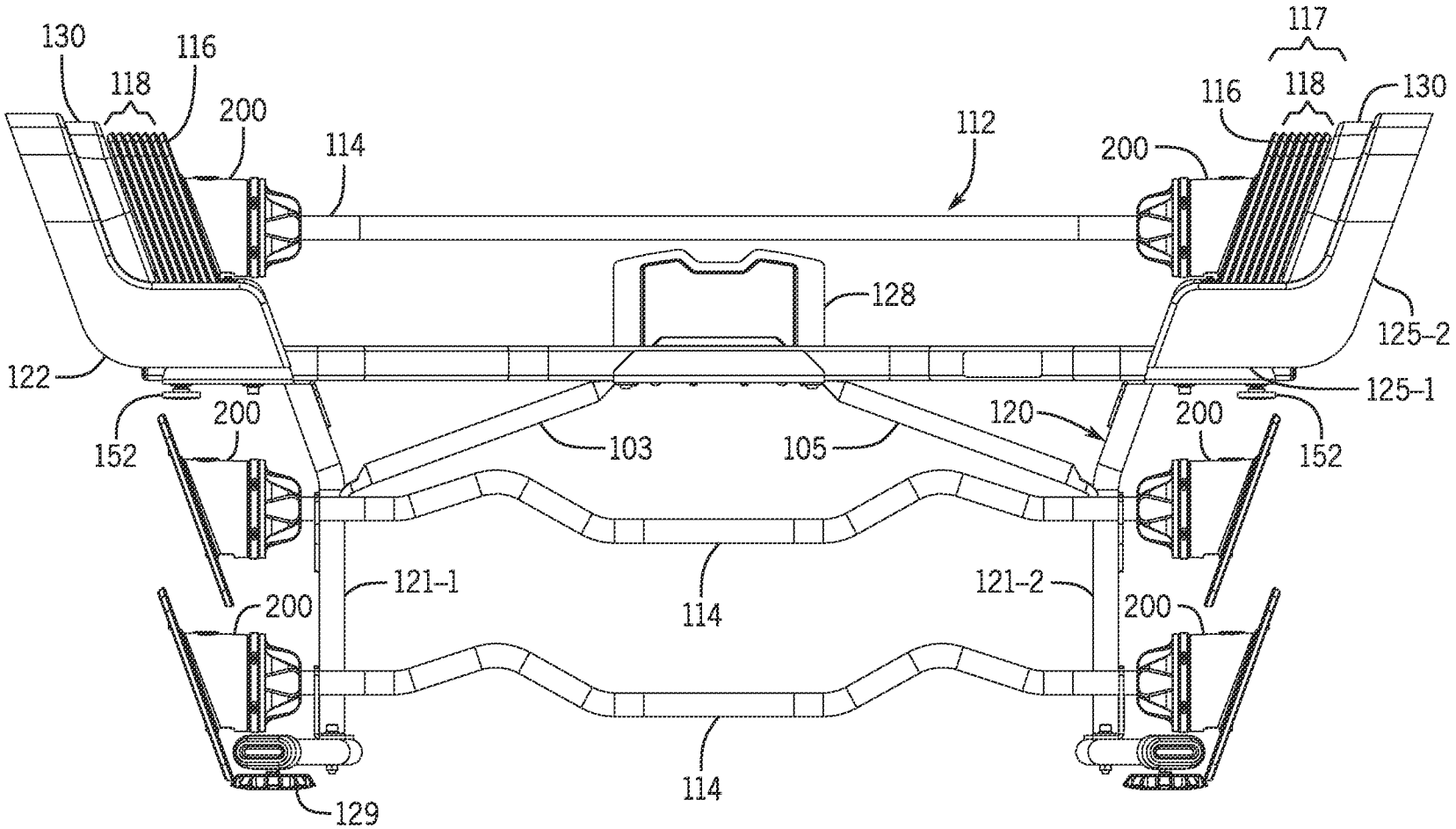
FIG. 2 shows a front elevation view of the adjustable barbell system of FIG. 1.

Referring to FIGS. 1 and 2, an adjustable barbell system 100 may include an adjustable barbell 110 and a base 122. The barbell 110 includes a handle assembly 112 (also referred to as barbell handle or handle), which has a pair of weight selector assemblies 200, one at each of the opposite ends of a bar 114. Each weight selector assembly 200 includes a selector knob 220, which is rotatably coupled to the bar 114, and which allows the user, responsive to rotation of the knob 220 relative to the bar 114, to set the weight of the barbell 110. As such, each of the weight selector assemblies 200 is operable to engage a plurality of removable weights 118 to selectively couple one or more of the plurality of removable weights to the handle assembly based on a rotational position of the selector knob 220 with respect to the bar 114.

The weight selector assembly 200 may include a weight selection indicator configured to indicate the selected weight setting of the barbell 110. For example, the weight selection indicator may be provided by a markings 233 (see FIG. 9) visible through weight setting window 235, which may be implemented as a cutout in the selector housing 210. The window 235 and/or the weight selection indicator may be implemented differently in other embodiments. For example, the weight selector assembly 200 may electronically communicate (e.g., via wired or wireless connection), the selected weight setting to an display, which may be located on the barbell 110, the stand 120, or elsewhere (e.g., the user's smartphone, smart watch, activity tracker or other remote electronic device). In the embodiment shown in FIG. 1., each of the rotational positions of the knob 220 may be associated with a respective one of a plurality of predetermined settings, each of which may be associated with a corresponding weight selection indication (e.g., a marking). The weight selection indication may indicate the selected weight or some other information about the weight setting of the barbell 110. In some such examples, each selection or setting of the knob 220 may be associated with a corresponding predetermined weight setting or selection (e.g., 20 lbs, 30 lbs, 40 lbs, and so on until a maximum weight setting), such that when the user rotates the knob to a given setting, an appropriate number of weights are coupled to the bar to cause the total weight of the bar to correspond to the selected setting. In other examples, the markings associated with the predetermined weights settings may indicate the additional weight being added. For example, each setting may be associated with one of a plurality of predetermined weight increments (e.g., a first setting corresponds to +0 lbs, a second setting corresponds to +10 lbs, a third setting corresponds to +20 lbs, and so on), such that upon selection of a given setting the minimum weight of the bar is increased by the amount shown by the associated indicator or marking. In yet other examples, the barbell may be configured such that rotation of the knob allows the user to select the number of weights to be coupled to the bar (e.g., at each of the two ends of the bar). For example, each selection or setting of the knob may correspond to a different number of weights (e.g., one, two, three, and so on) and when the user rotates the knob to a desired setting, the selector assembly may couple a corresponding number of weights to the bar, with the associated indicator or setting showing the number of plates being coupled to the handle assembly. Other suitable ways of selecting and/or adjusting the weight of the bar may be used in other examples.

In some embodiments, each of the weight selector assemblies 200 operates independently and thus allows the weight to be set independently at each of the opposing ends of the bar 114. In some such examples, the markings of a given weight selector assembly may correspond to the combined (or total) weight of the barbell (e.g., assuming both selector assemblies 200 are equivalently set and thus a same number of plates are coupled to each end of the bar 114). In other examples, the markings of a given weight selector assembly 200 may correspond to the additional number of plates or the additional weight added at each selector assembly, or any other useful information relating to the weight adjustment being made. To change the weight of the barbell 110, the user may place the barbell 110 in the base 122, turn the selector knobs 220 at each end to the respective rotational positions corresponding to the desired weight, which causes each of the selector assemblies 200 to engage an appropriate combination of weights 117. The user may then remove the barbell 110 from the base 122 to perform a desired exercise. Weights not coupled to the barbell 110 may remain in the base 122. Should the user desire a different barbell weight, the user may place the barbell 110 back in the base 122, turn the selector knobs 220 to engage a new combination of weights, and remove the barbell 110 from the base 122 with the adjusted weight. While the barbell 110 allows for the easy adjustment of weight, such as by coupling or decoupling any of the plurality of removable weights 118 to the bar 114, the user may also perform exercise using the handle assembly 112 alone, which in effect provides the minimum weight of the adjustable barbell 110.

The base 122 is configured to support the barbell 110 when not in use. The base 122 may include, at each of its two opposite ends, a barbell seat 123 operatively arranged to support each of the weighted opposite ends of the barbell 110. In the present example, the first and second barbell seats 123-1 and 123-2, respectively, are connected by a base frame 124, which may be implemented using one or a plurality of beams joining the pair of barbell seats 123-1 and 123-2. In other examples, the first seat and second barbell seats 123-1 and 123-2 may extend toward and be directly joined to one another. Each of the barbell seats 123-1 and 123-2 includes a first portion 125-1, which extends generally horizontally and is configured to support at least a portion of the weight of the weight plates and barbell handle when the barbell is in the base. Each of the barbell seats 123-1 and 123-2 further includes a second portion 125-2 extending upright, not necessarily vertically, from the first or horizontal portion 125-1. As shown in FIGS. 1 and 2, the upright portions 125-2 of the base may be angled away from one another as they extend upward from the horizontal portions 125-1 thus producing a funnel-like shape, which may reduce the amount of care or precision needed for properly positioning the barbell 110 in the base. In effect, a base 122 with angled sides, as in the example in FIGS. 1 and 2, may provide a centering function, thus making it easier for the user to place the barbell 110 onto the base at the conclusion of an exercise, without requiring precision to properly align and/or nest the weights of the barbells, which can become increasing more difficult at heavier weight settings. The plurality of weights 117 may have their major faces angled relative to the bar 114, such as is shown in FIGS. 1 and 2 with the top of the weights 117 positioned outward from the center of the bar 114 relative to the bottom of the weights 117. This angled arrangement may create a funnel effect to help center the barbell 110 left and right when the bar 114 is placed in the base 122. In such configurations, the upright portion 125-2 may also support at least a portion of the weight of the weight plates and barbell handle when the barbell is in the base. In other examples, the upright portions 125-2 may be configured to extend substantially vertically. In some examples, the base 122 may include a media holder 128 configured to support electronic or paper media (e.g., an electronic multi-media device such as a tablet or smart phone, a book, notebook, magazine, printed instructions, or any other type of non-electronic media) or other user device in a convenient position during exercise.

Figure 3:
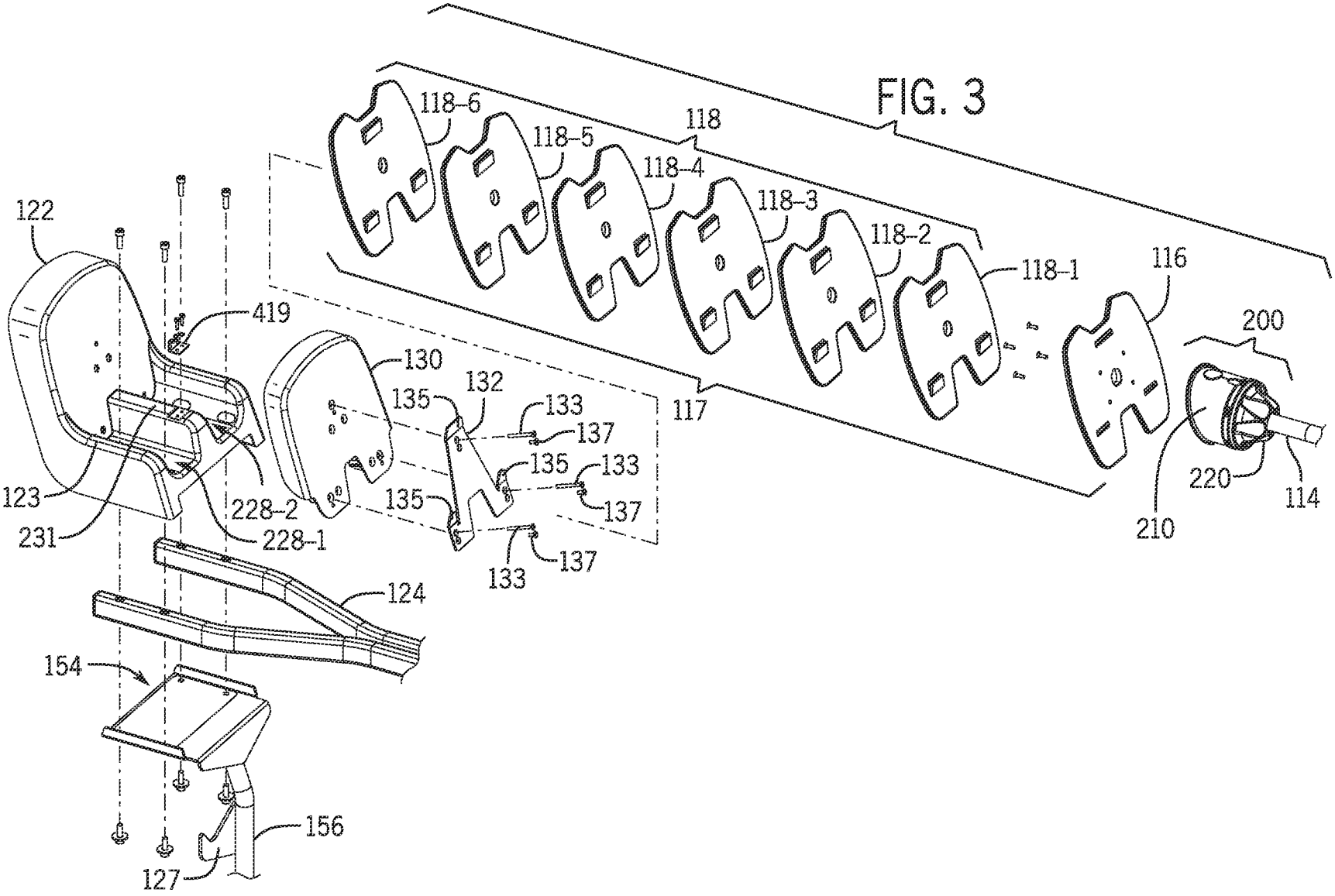
FIG. 3 shows an isometric exploded view of a portion of the adjustable barbell system of FIG. 1.

Referring also to FIG. 3, the base 122 and barbell seats 123 are configured to operatively position or seat the plurality of weights 117 in the base 122 to facilitate the selective engagement of removable weights 118 by the handle assembly 112. For example, each of the seats 123 may include, on its upward facing side, a pair of channels 228-1 and 228-2 separated by a rail 231. Each of the weights 117 may be shaped for a cooperating fit with the seat 123. For example, each plate 117 may define, by its peripheral edge or surface 163 a recess 166, which is configured to fit over the rail 231 such that the weight plates 117 straddle the rail 231, with a portion of each plate being received in the respective channel 228-1, 228-2, thereby non-rotatably positioning the weights 117 in the base 122. As will be described further below, in some examples, the base 122 may cooperate with the weight selector assembly 200 of the barbell 110 to automatically unlock the barbell 110 for adjustment upon placement of the barbell 110 on the base. In some examples, the base 122 may additionally or alternatively be equipped with a barbell retention feature configured to engage the barbell 110 to resist removal of the barbell 110 from the base 122 in certain circumstances. For example, the retention features may resist removal of the barbell from the base until the barbell 110 is in a configuration appropriate for removal, such as when the barbell 110 has been adjusted to one of the predetermined weight settings or selections. If the barbell 110, and specifically the selector assembly 200, is in a configuration that is between settings, the retention features on the base may cooperate with retention features on the barbell 110 to prevent its removal from the base. This may ensure that all desired weights have been securely attached to the barbell handle 112 before removal of the barbell 110 from the base is permitted, which may avoid injury.

The handle assembly 112 (also referred to as barbell handle or simply handle) of the barbell 110 includes a bar 114, a pair of weight selector assemblies 200, one at each end of the bar 114, and, in this embodiment, a pair of fixed weight plates 116, one at each end of the handle assembly. The fixed weight plates 116 may resemble (e.g., in shape, thickness or both) at least one or the rest of the plurality of weights 117, in some cases having the same shape and/or thickness, such that when multiple plates are attached to a given side, the fixed plate gives the appearance that it is one of the removable weights, which may enhance the aesthetic appearance of the barbell. In some embodiments, at least one of the plurality of weights 116 (e.g., the fixed weight plates 116 and/or one or more of the removable plates) may have a different thickness than other ones of the weight plates of the plurality of weights 117. The fixed plates 116, as the name implies, are rigidly (i.e., non-movably) coupled to the bar 114 (e.g., using fasteners as shown in FIG. 3) and are configured to remain fixed to the bar 114 at all times during use, including during adjustment of the weight of the barbell and following an adjustment to any weight setting. In some examples, the fixed plates 116 may be rigidly coupled to the bar 114 via a rigid connection between the plate 116 and the selector housing, which itself is fixed (i.e., non-movably coupled) to the bar 114. Thus, the fixed plates 116, need not be directly coupled to the bar 114 to be rigidly coupled thereto. The removable plates (e.g., 118 and the additional plates 138 in FIG. 4B) on the other hand are configured to be removably selectively coupled to the bar 114 for adjusting the weight of the barbell 110. By varying the number of removable plates that are selectively (e.g., by the user) coupled to the bar 114, the weight of the barbell 110 may be adjusted from its minimum weight, which includes the weight of the bar 114, the selector assemblies 200, and the fixed plates 116, to any one of a plurality of predetermined weight settings, each of which corresponds to an increment above the minimum weight by an amount based upon the number of removable plates 118 being coupled to the bar 114. FIGS. 1-3 and FIG. 4A illustrate an example in which the adjustable barbell 110 can selectively couple to six removable plates 118 (e.g., 118-1 through 118-6) at each of the opposite ends of the bar 114. The number of weights shown is illustrative only and in other examples, the number of removable plates may be different, for example fewer (down to only a single removable plate) or greater, such as in the example FIG. 4B, which illustrates an add-on weight plate kit, which facilitates adding up to four additional weight plates per side. The individual weights 117 may have the same weight and/or physical parameters (e.g., thickness, density, construction, etc.), or the individual plates 117 may differ from one another in this regard.

The bar 114 may be any elongate, slender rod of any suitable cross section that can be gripped by a user. In some examples, the bar 114 may be a straight bar, which may be implemented by a straight cylindrical rod of a suitable length. In other examples, the bar 114 may be a curl bar (e.g., as in the additional handle assemblies shown in FIGS. 1 and 2), which may be implemented by a contoured cylindrical rod that includes a pair of angled grip portion that enable a more natural orientation of the user's wrist during certain types of grips or exercises. The bar 114 may have any other suitable shape and/or cross-section, which in some cases may vary along the length of the bar, to allow for a variety of grip positioned and exercises.

As shown in FIGS. 1-3, the base 122 may, in some examples, be supported at an elevated position above ground by a stand 120, such as to provide the barbell 110 in an alternative or more convenient position for the user (e.g., obviating the need for the user to bend down to pick up the barbell). The stand 120 may include one or more base members 158 configured to be positioned on a support surface (e.g., the ground) and which may be equipped with leveling features (e.g., leveling feet 129). The stand 120 may further include one or more upright supports 156 extending form the base member(s) 158 and one or more mounts 154 configured for coupling the base 122 to the stand 120. In some examples, e.g., as shown in FIG. 1, the stand 120 is implemented using two separate legs 121-1 and 121-2. Each of the legs 121-1 and 121-2 includes a base member 158 and an upright support 156 terminating at a mount 154, in this case a plate-shaped bracket, for mounting the two legs 121-1 and 121-2 at two spaced apart locations on the base 122 (e.g., proximate a respective one of the barbell seats 123-1 and 123-2). The stand 120 may be configured differently in other examples, such as by having the two legs of the stand being connected by a truss structure to resist lateral movement, by having a single base member 158, fewer or greater number of upright supports 156, and/or differently configured mounts 154. In some embodiments, as illustrated in FIGS. 1 and 2, the stand 120 may have optional lateral supports 103 and 105 to increase rigidity, stability, and/or strength of the stand 120.

In some embodiments, an adjustable barbell system 100 may include a plurality of barbell handles 112, which may differ in configuration from one another (e.g., have differently shaped bars and/or be equipped for different maximum weight or with different weight increments). Some such systems may be configured to support or position the additional handles 112 in proximity to the user during exercise, e.g., to make it easier for the user to switch handles during an exercise routine. For example, the base 122 or the stand 120, as shown e.g., in FIG. 1, may be equipped with auxiliary barbell supports (e.g., hooks 127) for supporting or storing one or more additional barbell handle assemblies 112. The base 122 and/or stand 120 may be equipped with any other suitable storage location for the additional adjustable barbell(s). In some examples, the base 122 may be configured with multiple barbell seat sets (e.g., transversely adjacent to one another), such that the additional barbell handles can be supported directly in their respective barbell seats.

Figure 4B:
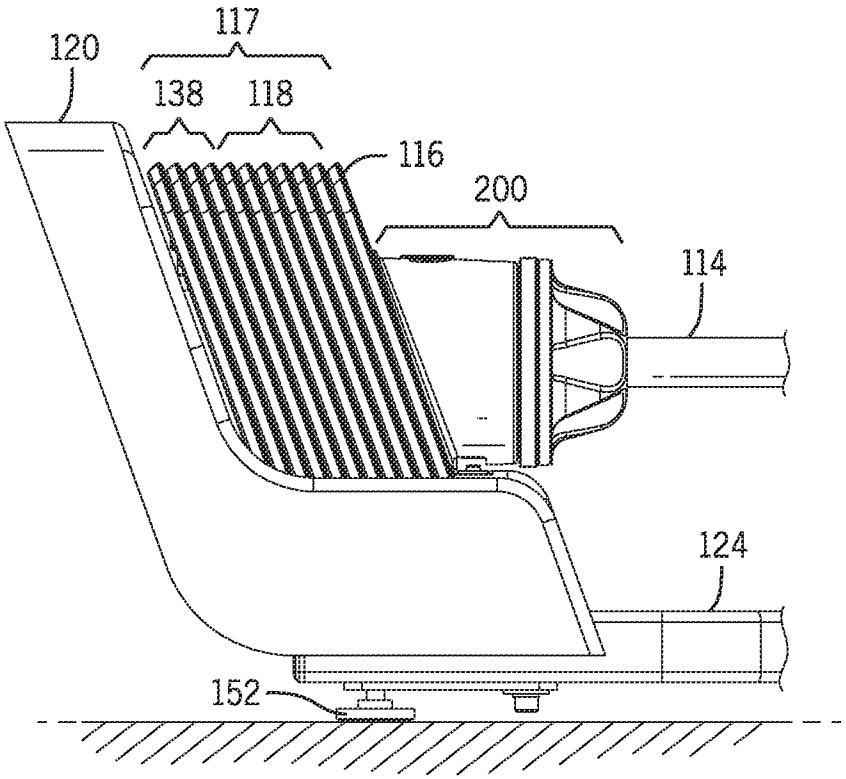
FIG. 4B shows a front elevation view of the adjustable barbell system of FIG. 4A in a second configuration.
Figure 4A:
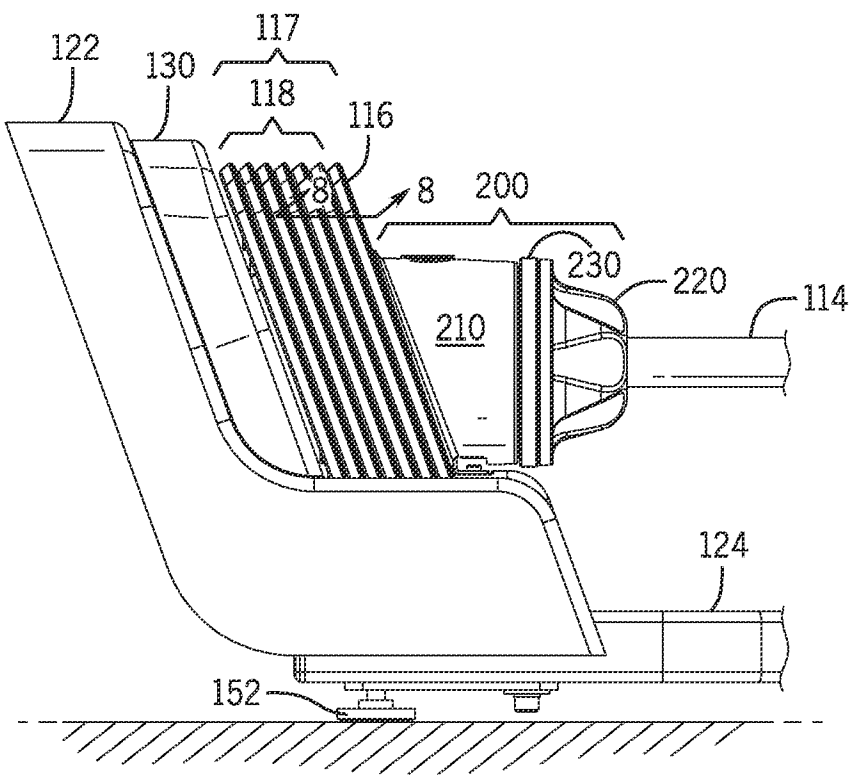
FIG. 4A shows a front elevation view of a portion of an adjustable barbell system in a first configuration.

While the base 122 is shown elevated (e.g., by stand 120) in FIGS. 1-3, the base 122 may be configured to be placed directly onto a support surface (e.g., the floor or ground or any other suitable support surface such as a platform or a table) as shown in FIGS. 4A and 4B. The base 122 may thus include its own leveling feet 152, e.g., to compensate for unevenness of the support surface. In some examples, the barbell system 100 may be configured to enable the user to increase the maximum weight of the barbell 110, e.g., with an add-on kit of additional weight plates 138 (see FIG. 4B). For example, the base 122 may be re-configurable to allow the same base to be used with different sets of removable weights, as shown in FIGS. 4A and 4B. When using the base 122 with a set that includes a smaller number of weight plates than the full capacity of the base (e.g., as shown in FIG. 4A), a spacer 130 may be provided between the base 122 and the last (or outer-most) plate 118 of the set. The spacer 130 may be of adequate size to appropriately position the weights 118 and the barbell handle 112 with respect to the base 122, e.g., to take advantage of the full functionality of the system (e.g., automatic unlocking and/or retention of the barbell during adjustment, where provided). A spacer bracket. 132, which includes additional positioning or holding features, may be coupled to the spacer 130 to aid in the positioning or holding of the weight plates 117 in the base. For example, the spacer bracket 132 may include tabs 135 configured to engage interlocking features of the outer-most plate of the plurality of plates 117 and thus further facilitate the positioning or holding of the plates 117 in the base 122. Additionally the spacer bracket 132, especially if manufactured from a relatively hard durable material such as steel or other suitable type of metal, may act as a hard stop for the telescoping rod 240 of the selector assembly to prevent over extension, particularly when the handle assembly 112 is configured to be used with an add-on kit and thus the rod 240 may be extendable beyond the axial position of the outer-most plate of the base kit.

The spacer 130 may be removable. For example, the spacer 130, when used, may rest on the base 122, such as by leaning against surfaces of the horizontal and upright portions 125-1 and 125-2. In other examples, the spacer 130 may be fixed to the base 122 (e.g., via fasteners 133). When the base 122 is to be used with a greater number of plates 117 (e.g., with an add-on kit of additional weights 138), the spacer 130 may be removed from the base 122 and replaced by the additional weights 138. In some such examples, the spacer bracket 132 may be removably coupled to the spacer 130 (e.g. fasteners 137). To facilitate the positioning and holding of the weights 117 in the base, the spacer bracket 132 may be removed from the spacer and affixed to the base (e.g., to the upright portion 125-2), such that the additional positioning/holding functionality previously provided by the spacer can be transferred to the base. In other examples, the positioning or holding interlocking features for retaining the weights to the base may be embedded in the base seat, even if concealed by a spacer in some use cases. In yet other examples, in which no spacer is used, the base itself (e.g., the upright portion 125-2) may be provided with the positioning or holding features (e.g., tabs 135). As previously noted, the individual weight plates 117 may be the same or differ in their weight and/or physical parameters. In one specific example, each of the plates 117 may weigh 5 lbs., thus if starting with a minimum handle weight of 20 lbs. as an example, each incremental adjustment to the barbell 110 may increase the weight of the barbell by 10 lbs for a maximum weight, without the add-on kit, of 80 lbs, and up to 120 lbs with the add on kid. Different increments of weight adjustments and/or different minimum and/or maximum weight of the barbell may be achieved by use of different combinations of weight plates, base size, etc. without departing from the scope of the present disclosure.

Referring now also to FIGS. 5A-5C, 9-13, the weight selector assembly 200 is operable to selectively engage any number of a plurality of removable weights 118 to selectively removably couple one or more of the weights 118 to the handle assembly 112 for adjusting the weight of the barbell 110. The weight selector assembly 200 includes a selector housing 210, which is fixed to the bar 114, and a selector ring 230 rotatably coupled to the selector housing 210. The selector assembly 200 further includes a selector knob 220, which is fixed to the selector ring 230 such that the ring 230 rotates when the knob 220 is rotated. Rotation of the knob 220 and consequently the selector ring 230 relative to the bar 114 allows the user to select the weight setting and thus the number of plates to be coupled to a respective end of the barbell 110. The selector assembly 200 includes a selector rod 240, which is movably coupled to the bar 114. In one example, the selector rod 240 is configured to move in the axial direction of the bar 114 (e.g., as indicated by arrow 201) responsive to rotation of the knob 220 (e.g., as indicated by arrow 203) to selectively engage one or more of the removable plates based upon the rotational position of the knob 220. As will be described further below, a transmission mechanism (e.g., a gear assembly 300) may be used to convert the rotational movement of the knob 220 and selector ring 230 to axial movement of the rod 240.

Figure 9:
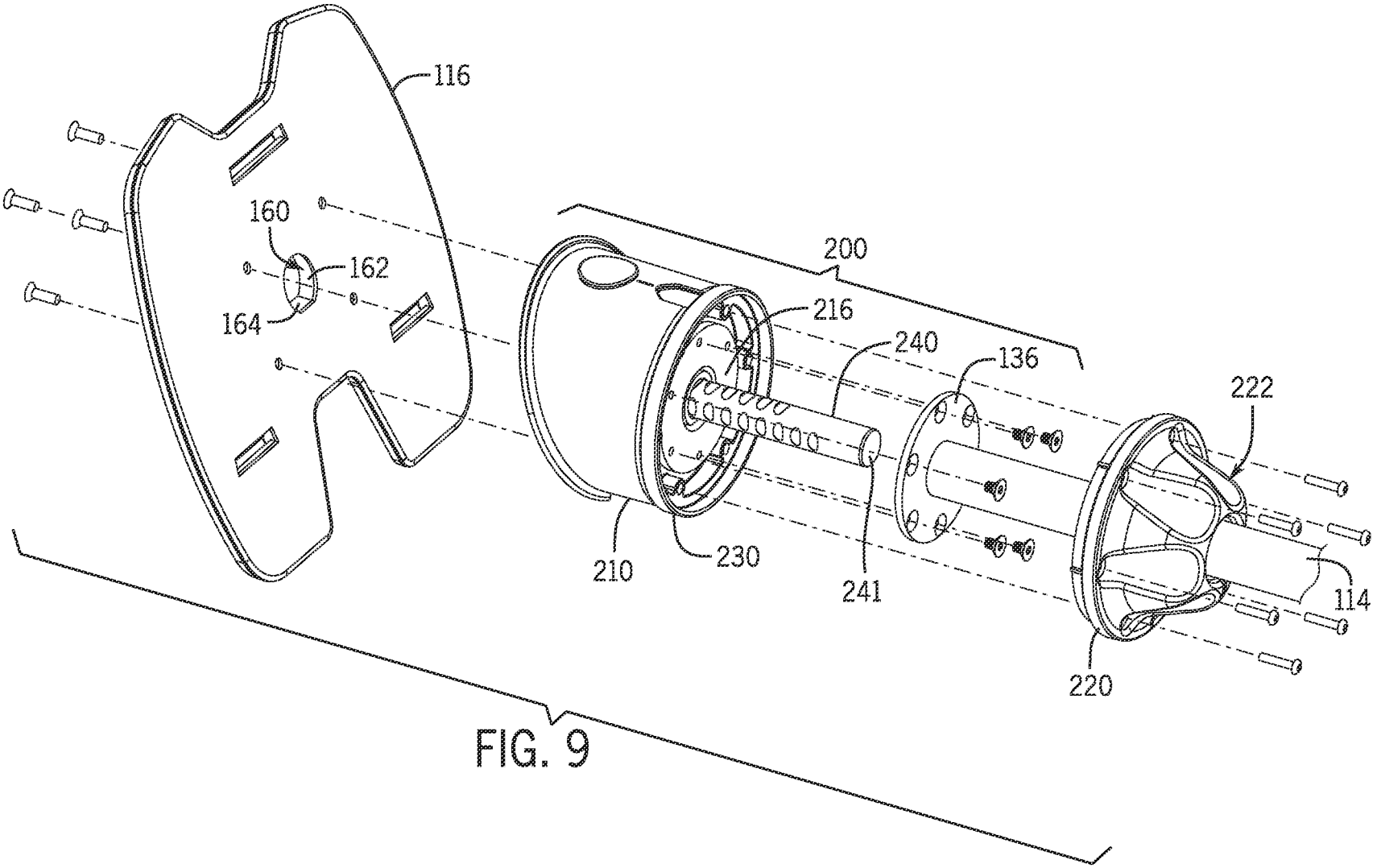
FIG. 9 shows a partially exploded isometric view of a portion of an adjustable barbell.
Figure 10:
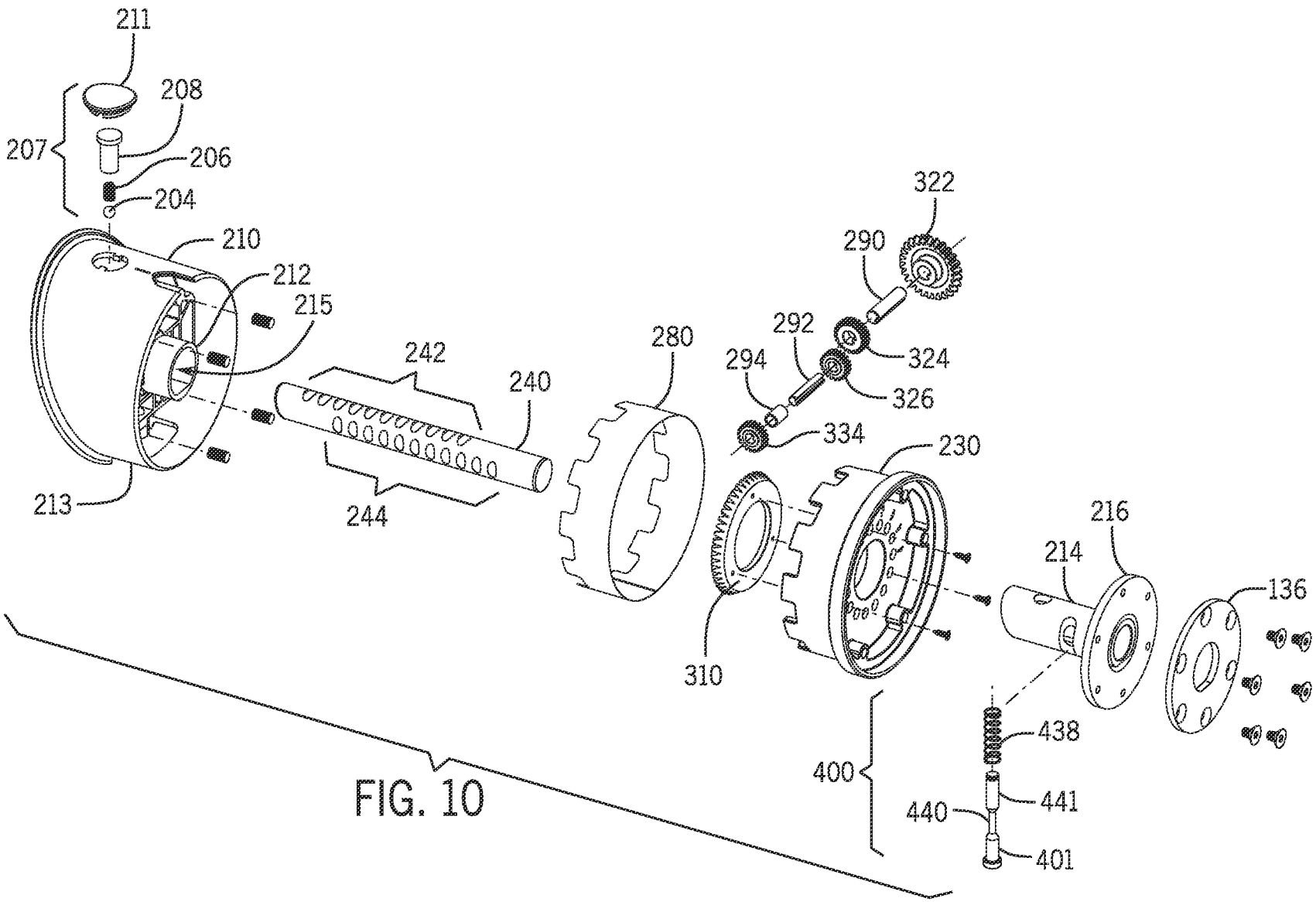
FIG. 10 shows an exploded view of a weight selector assembly according to some examples of the present disclosure.

As shown in FIGS. 9 and 10, the selector assembly 200 includes a selector housing 210, which encloses certain internal components of the selector assembly 200 (e.g., the gear assembly 300), so as to shield these components from view and/or protect the user's hand when operating the knob. The selector housing 210, which may be manufactured from any suitable rigid material such as a rigid plastic, metal, or composite, may have a generally cylindrical outer wall 213 and an internal structure that supports the internal components of the selector assembly 200. The selector housing 210 may include a collar 212 defining a passage 215 configured to allow the rod 240 to pass through the housing 210 and into the selection apertures of the weights 117. The rod 240 may be operatively coupled to the housing 210 via a tubular insert 214, which may be made from metal or other suitable rigid material, or the features of the tubular insert 214 may be integrated into the collar 212. When using an insert 214, the insert may be fixed to the housing 210, such as by being press fit, fasted or welded to the collar 212. The tubular insert 214, if used, or free end of the collar 212, if no insert is used, may be provided with a flange 216, which may be used for rigidly coupling the bar 114 to the housing (e.g., by fastening a flange 136 at the end of the bar 114 to the flange 216). The flange 216 of the insert 214 and/or the flange 136 of the bar 114 may be accommodated within a cavity on the proximal side of the selector ring. The insert 214 may be rotatably received through a central passage of the selector ring 230 such that a distal end of the insert 214 may extend into the collar 212 for coupling the insert 214 to the housing 210.

The knob 220 and selector ring 230 are rotatably coupled to the housing 210 to enable weight adjustments through extension of the rod 240 into and retraction of the rod 240 from the axial passage defined by the aligned selection apertures of plates 117 when positioned in the base 122. The knob 220 is configured to be grasped by the user for rotation and may thus include traction features 222 for reducing the slip between the user's hand and the knob. For example, the knob 220 may include divots on the outer surface configured to receive the user's finger or it may include other recessed or protruding structure configured to improve the user's ability to grip and manipulate the knob 220. The knob 220 may be fixed (e.g., fastened) to the selector ring 230 such that the selector ring 230 rotates in unison with the knob 220. In some examples, at least a portion of the selector ring 230 may be integrally formed with at least a portion of the knob 220.

Figure 15B:
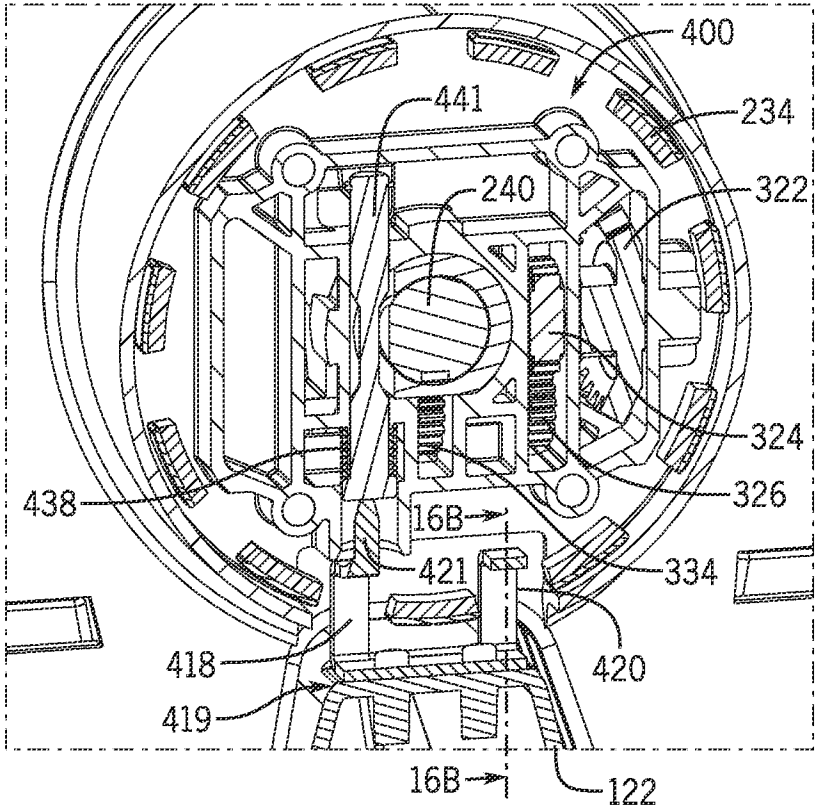
FIGS. 15A and 15B show cross-sectional views similar to the view in FIG. 14B but here illustrating a retention mechanism of the barbell, which prevents removal of the barbell from the base when a selector ring of the weight selector assembly is in a rotational position between weight settings, as shown in FIG. 15A, until the selector ring is provided in a rotational position corresponding to a weight setting, as shown in FIG. 15B.
Figure 15A:
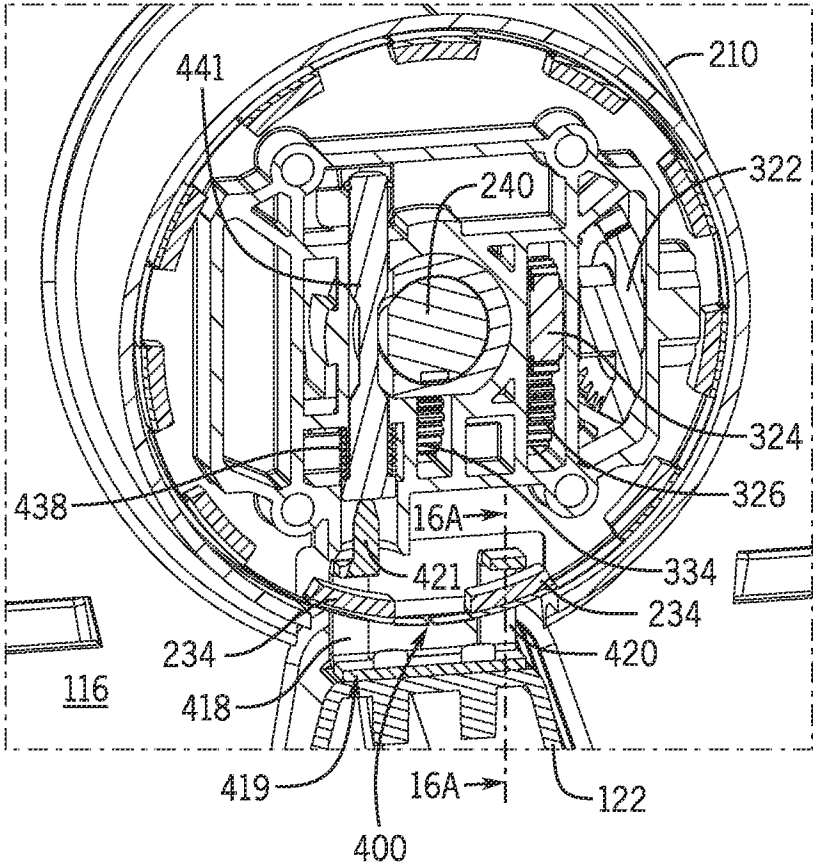

The selector ring 230 may transfer the rotation of the knob 220 to the transmission assembly (e.g. gear assembly 300) while facilitating a barbell retention function of the system 100 described further below with reference to FIGS. 15A and 15B. With respect to the latter, the selector ring 230 may be configured to engage a retention feature of the base 122 to resist removal of the barbell 110 from the base 122 in certain circumstances. In some such examples, the selector ring 230 may include a castellated ring body including a plurality of axially extending projections or teeth 234 spaced in a radial pattern around the perimeter of the ring 230. The teeth 234 define a plurality of recesses 236 therebetween, such that in operation the selector ring 230 is positioned to engage or to not engage a retention member (e.g., hook 420 on the base) depending on the rotational position of the knob 220 and ring 230.

As previously described, the weight selector assembly 200 may include a weight selection indicator (e.g., one or more markings 233) which indicates the selected weight setting. In some examples, the indicator may be provided by a combination of markings on the selector housing 210 and the knob 220 and/or selector ring 230. For example, the settings may be indicated by markings in a radial pattern around the periphery of one of the housing 210 or the knob 220/selector ring 230 combination, while an arrow or a different type of pointer is provided on the other one of the housing 210 or the knob 220/selector ring 230 combination. In some examples, the markings may be provided on the castellated body of the selector ring 230 (e.g., in a radial pattern around the periphery of the castellated body). In some such examples, the housing 210 may define a cutout or recess sized to expose only a small portion of the castellated body (e.g., a single marking at a time), such that when the knob 220 and ring 230 are rotated, different regions of the periphery of the castellated body becomes aligned with and thus exposed through the recess to reveal the corresponding marking. In some examples, the markings may be engraved, embossed, painted or otherwise formed directly on the castellated body. In other examples, the markings may be provided on a separate label or decal 280, which is attached to the castellated body. This may enable reconfiguration of the barbell handle assembly, such as during maintenance of the internal components, during which the indicator (e.g., decal 280) may be replaced with an indicated having different increments and/or weight settings for use with a different weights set.

The selector rod 240 may be an elongate member having a first or proximal end 241 and a second distal end 243. The terms proximal and distal may be used to describe the relative location of components or features in relation to the user during normal use of the barbell for performing exercise. For example a component or location described as proximal may be located relatively closer to the user than a component or location described as distal during normal use of the barbell. While the rod 240 is illustrated in the present example as a substantially cylindrical telescoping rod, a rod of any other suitable configuration, not necessarily cylindrical, which translates axially through the plates such as to retain the plates vertically/horizontally may be used. In various examples, the rod 240 may be a solid or a hollow (e.g., tubular) elongate member of any suitable cross-section such as hexagonal, square, rectangular, oval, or other polygon, either regular or irregular. The rod 240 may be made from any suitable material, such as metal, plastics, or composites such as fiberglass, carbon fiber, aramid, bound with various resins such as epoxy. The rod 240 and/or other structures that may be formed integrally therewith (e.g., the rack 336) may be manufactured by machining, casting, forging, stamping, or composite material layup, additive manufacturing or any other suitable technique.

In some embodiments, the proximal end 241 is positioned in the bar 114 when the rod 240 is in a retracted position. The distal end 243 portion may be positioned in the selector housing 210, in some cases the distal end 243 may be positioned in the tube 214 and/or extending into the selection aperture 160 of the fixed plate 116 when the rod 240 is retracted. As the rod 240 is extended into the removable plates 118, 138, the distal end 243 advances away from the selector housing 210. The selector rod 240 may be associated with a plurality of detent locations. For example, the rod 240 may include a plurality of detent divots or apertures 242, arranged in an axial pattern along one side of the rod 240 (e.g., a top side of the rod 240). The selector rod 240 may also include a plurality of locking divots 242 arranged on a different (e.g., a transverse or lateral) of the rod 240, which cooperate with an actuating pin 401 as described further below. The detent locations may be implemented using any suitable structures, such as notches, grooves, recessed areas, projections or other suitable structures that can delineate discrete axial positions along the longitudinal direction of the rod 240 and operatively engage with a detent selector (e.g., a ball detent coupled to the selector housing 210).

The selector rod 240 is configured to be advanced axially responsive to rotation of the knob 220. In some examples, this may be achieved using a gear assembly 300, which includes a rack and a pinion gear, the rack of which is fixed to (e.g., welded to or integrally formed with) the rod 240. The rack may be provided on yet another side (e.g., a bottom side) of the rod 240. In other examples, conversion of rotational to axial movement may be effected, in part, by a pin and slot arrangement in which a slot that extends axially while simultaneously wrapping around the rod is engaged by a pin operatively coupled to the knob such that rotation of the knob and pin pushes against the walls of the slot to cause the rod to extend and retract responsive to rotation of a knob. The rod 240 may additionally and optionally be facilitate an automatic locking function of the system 100, as will be described further below (e.g., with reference to FIGS. 11, 13, and 14A-16B).

Figure 24:
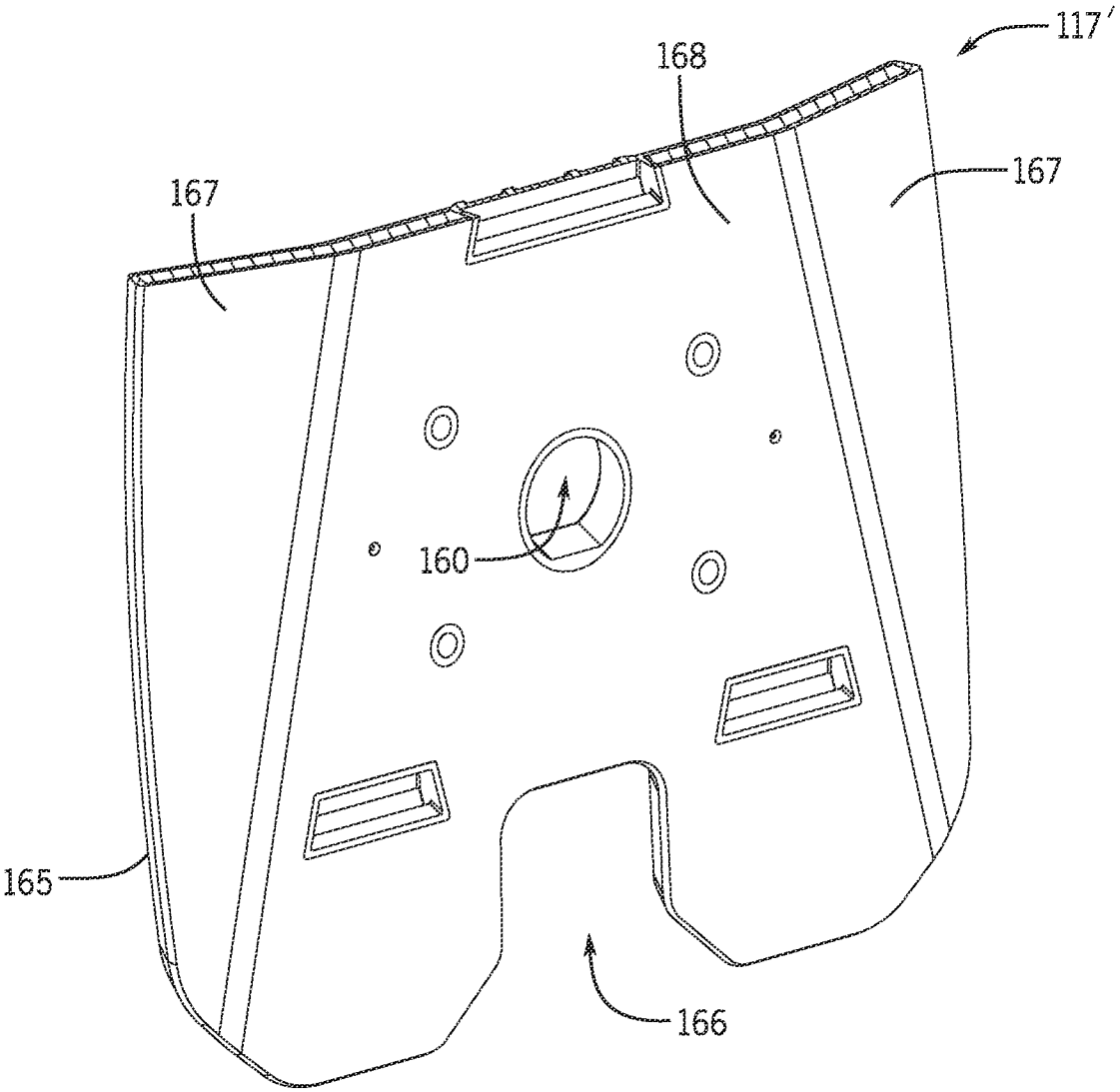
FIG. 24 is an isometric view section of an example of a weight including one or more peripheral portions that are out of plane relative to a central portion of the plate.

As shown in FIGS. 6A-8, each of the fixed weights 116 and the removable weights 118, 138, collectively referred to as weight plates 117 (or simply weights or plates 117), has a through-aperture that acts as the selection aperture 160. The selection aperture 160 may be generally centrally located on the weight plate 117. The selection aperture is configured to allow passage of the selector rod 240 through the thickness of a respective weight plate 117. Each weight plate 117 may have first and second opposing major surfaces or faces connected by a peripheral or edge surface or face 165. For example, the fixed weight 116 has a first face 161 and a second face 163. Likewise, the removable weights 118, 138 each have a first face 171 and a second face 173 In the present example, the individual plates 117 are substantially planar in that each major surface lies substantially in a plane. In other examples (e.g., as shown in FIG. 24), the plates may be differently shaped, for example having the major surface of the plate being contoured to provide a weight plate with a non-planar geometry. As shown for example in FIG. 24, a plate 117' may include one or more peripheral portions 167 that are out of plane (e.g., curved or angled relative to a central portion 168 of the plate 117'). In the example in FIG. 24, both of the side peripheral portions 167 are angled with respect to the central portion 168 in a direction away from the bar 114. In other examples, only one side may be angled. In some examples, such contouring may aid with the centering of the barbell when it is being placed on base, e.g., against removable weights supported on the base. In some examples, the contouring may additionally serve an aesthetic purpose. In some examples, the contouring may be purely aesthetic. In the present example, the portion that is angled (also referred to as angled peripheral portion) may narrow along the vertical direction. In other words, the angled portion 167 is wider near the top of the weight plate 117' than near the bottom of the weight plate 117', creating an inverted funnel-like shape, with the wider end of the funnel at the bottom. The inverted funnel shape may help guide the weight plate 117' into proper position (e.g., with respect to a plate in the base), which may reduce the amount of care or attention exerted by the user in aligning the barbell when returning it to the base. Returning to FIGS. 6A-8, and as shown e.g., in FIG. 5C, in use, the plates 117 are configured to be stacked in the base 122 side by side with the first face of one plate adjacent to, although not necessarily in contact with, the second face of another plate 117. Each of the plates 117 include interlocking features for engaging and interlocking with adjacent plates.

The weight plates 117 may be made of a unitary piece of material of selected density to achieve the desired weight properties for each of the given plates 117. For example, the weights 117 may be made from a plate of steel, lead, iron, tungsten, or other suitably dense material. In some examples, the weights 117 may include a core of one material (e.g., metal core) with a cladding, coating, shell, or skin of another material (e.g., a plastic shell). In some such examples, the core may be clad with the external shell using a variety of suitable processes, such as co-molding the core with the shell, or by otherwise applying an external plastic, rubberized, anodized, painted, or powder coated finish around the metal core. In other examples, the weights 117 may be implemented in the form of a shell filled with particulate matter, such as sand, or metal particles, such as lead or steel shot.

As previously described, the weights 117 may be configured to sit in the seat of the base (e.g., base 122 or 522) in a non-vertical position. That is, when seated in the base (e.g., base 122 or 522), each of the weights 117 may have their major faces inclined to the vertical as dictated by the angle of inclination of the upright portions of the base. The selection aperture 160 of each of the weight plate 117 may thus extend through the thickness of each plate in a non-normal direction to the major faces of the plate. The selection apertures 160 may extend through the plates at an orientation aligned with the axial direction of the bar 114. When the plates 117 are in the base (e.g., base 122 or 522), the selection apertures 160 of the plates 117 may align sufficiently to provide a generally axially extending passage through the stack of plates. In some examples, the walls 162 that define the respective selection apertures 160 of the plates 117 may include one or more anti-rotation features 164, such as a flattened portion 164 configured to cooperate with a similar anti rotation feature on the selector rod (e.g., rod 240 or 540) to resist rotation of the plates when coupled to the handle assembly 112. In some examples, one or more of the plates 117 may not include anti-rotation features 164 (e.g., as shown the example plate 118 of FIGS. 7A and 7B).

Figure 8:
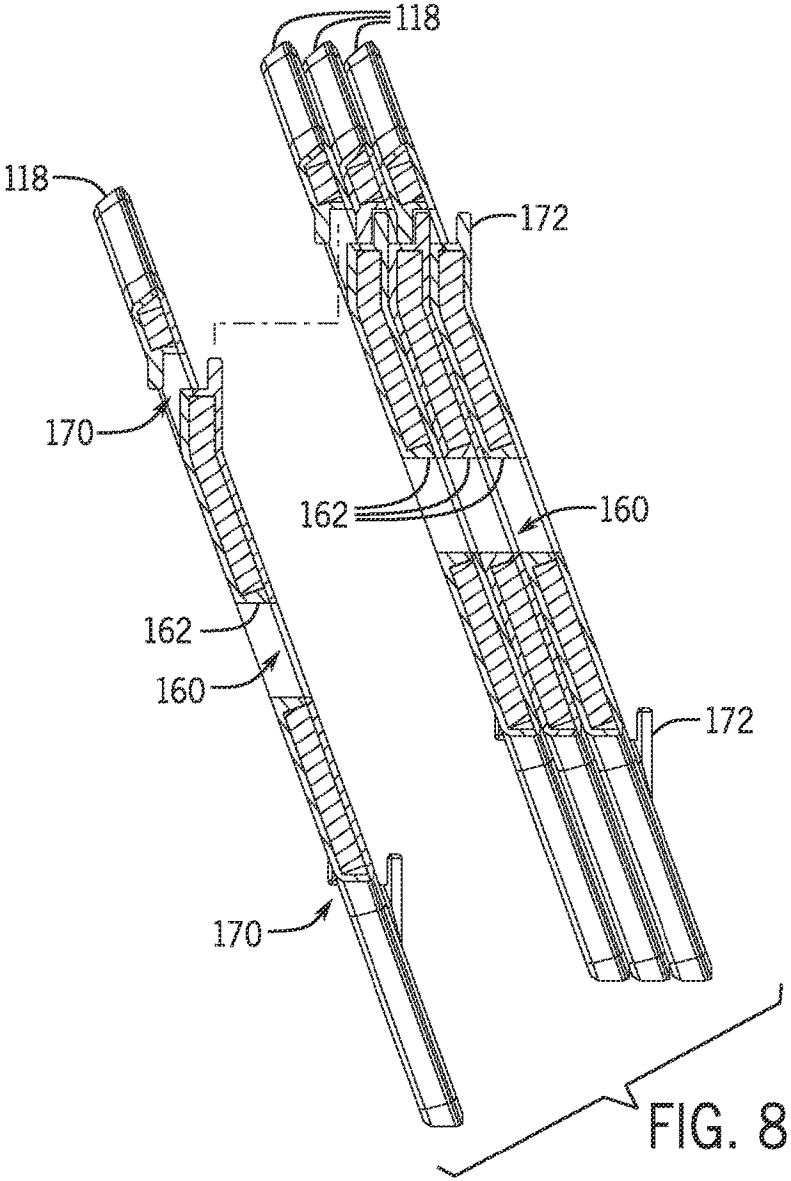
FIG. 8 shows a section view of a number of the removable weight plates illustrating interlocking of the plates.

Referring also to FIG. 8, the interlocking features of the plates 117 may be configured to prevent separation of the plates along the axial direction. As such, the interlocking features may include any suitable combination of structures that mechanically interfere with the movement of the plates 117 along the axial direction when the interlocking features of two adjacent plates are engaged. For examples, the interlocking features may be implemented using tabs 172 that extend from one of the major faces of a plate 117 and slots 170 configured for cooperating fit with the tabs 172 provided on the opposite major face of the plate 117. As previously discussed, the plates 117, when positioned in the base (e.g., base 122 or 522), may not be strictly vertical but rather at an angle to the vertical direction. Thus, the tabs may extend at an angle to a major face, for example such that the tabs are oriented substantially vertically when the plates are positioned in the base. The tab-receiving slots 170 may be defined by walls that are inclined to the major face an angle similar to that of the tab (e.g., the walls may be substantially vertical when the plates are in the base) so as to be configured for a cooperating fit with the tabs of an adjacent plate. This resulting vertical alignment of the tabs and slots may aid the centering function and ease of placement of the barbell 110 in the base (e.g., base 122 or 522), as the barbell may naturally tend to travel generally vertically downward as the user places the barbell 110 in the base. The tabs 172 and slots 170 may be differently configured as long as the tabs 172 of a given plate are configured to be received in corresponding slots 170 of an adjacent plate, while the slots 170 of the given plate located on its opposite face receive the tabs 172 of another adjacent plate. For example, the tabs may be implemented as L-shaped structures, with the vertical portion of the L being generally parallel to the major face. Different suitable types of interlocking features, other than tabs and apertures, may also be used.

In some embodiments, since the first plate 116 of the plurality of weight plates is a fixed plate (e.g., fixed to the selector housing 210 or 510 for example via fastener holes), the first plate 116 may only include interlocking features (e.g., either slots or tabs, in this case slots 170) on the second major face 163 of the plate 116. In some examples, the slots may extend through the thickness of the plate to the opposite face. As shown in FIG. 8, in the present example the tabs are provided on the faces of the plates facing the bar, while the apertures are on the opposite face that faces away from the bar. In other examples, the arrangement may be reversed and downward facing tabs may instead be provided on the second faces of the plates, while apertures are provided on the first faces of the plates. Any suitable combination of interlocking features that retain the plates axially and rotationally may be used. With continued reference to FIG. 8, the interlocking features of each of the weight plates (e.g., removable plates 118) engage with the interlocking features of an adjacent weight. The outermost weight of a set may engage with the interlocking features of the spacer bracket 132 or when an add-on kit is used, with interlocking features of the additional weights 138. An arrangement of interlocking tabs 172 and slots 170 may allow the weights to be tightly nested together in the base, providing for a more compact form factor of the adjustable barbell system. When the interlocking features of the weights are engaged, the selection apertures 160 of the weights (e.g., 116, and 118) align, allowing the rod 240 to be moved axially through the passage extending through the stack of weights. As shown in FIGS. 6A-8, the interlocking features may be arranged using any suitable pattern, such as in a peripheral pattern on the major faces of the plate, to avoid interference between the interlocking features when the barbell is placed in the base. For example, the interlocking features may be vertically offset to reduce or avoid interference when placing the barbell on the base In the examples in FIGS. 6A-8, a single tab-slot combination is located generally laterally centered above the selection aperture 160 and a pair of tab-slot combinations are located on laterally opposite sides of the selection aperture 160 below the selection aperture 160, each tab-slot combination having a non-interfering vertical axis of insertion relative to another tab-slot combination. Different arrangements may be used, such as using a pair of laterally spaced tab-slot combinations above and a single generally centered tab-slot combination below the aperture, or using pairs of tab-slot combinations above and below, each pair spaced differently with respect to the vertical midline so as not to interfere during placement of the barbell on the base.

Figure 5A:
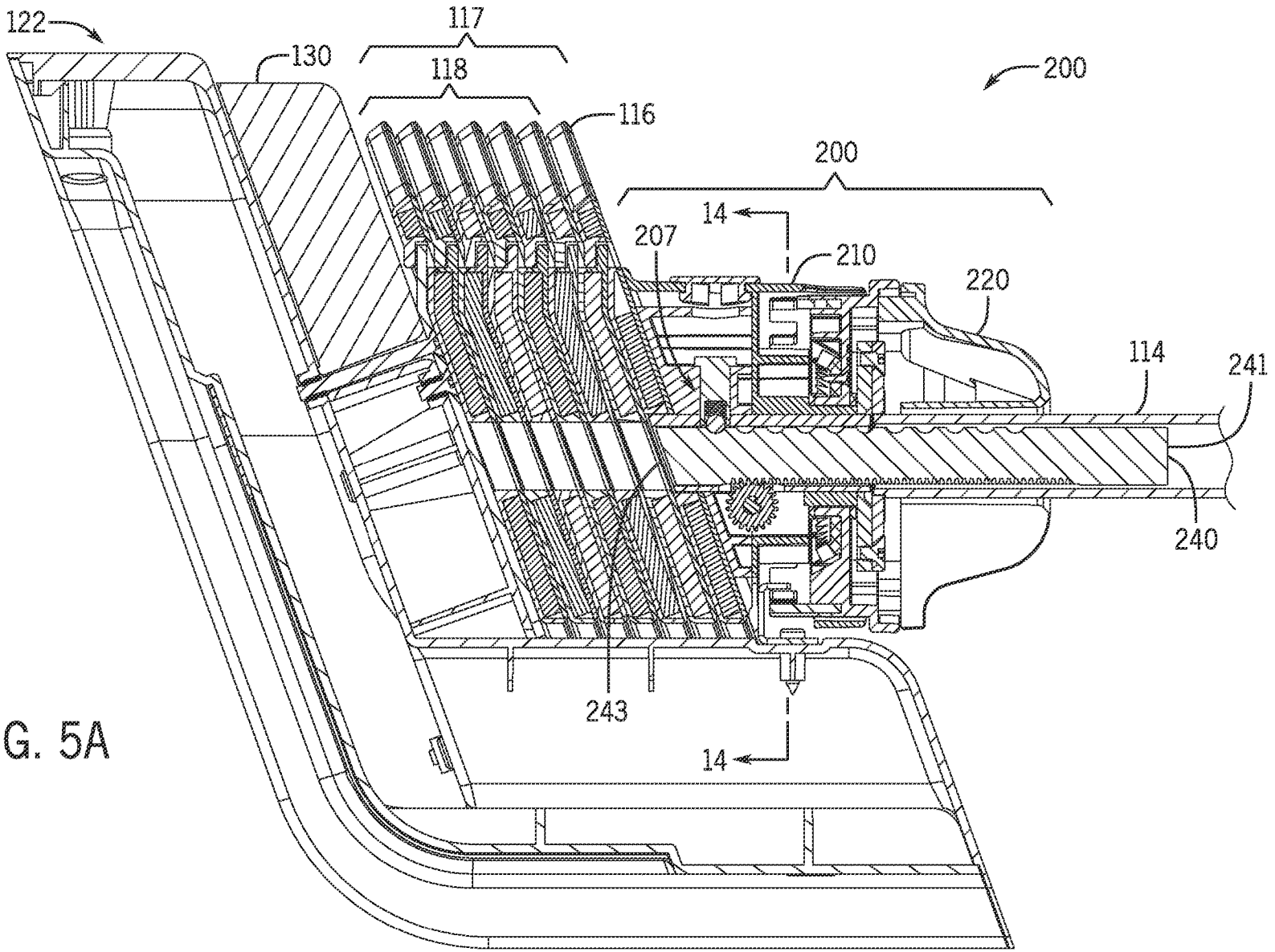
FIG. 5A shows a cross-sectional view of a portion of the adjustable barbell system of FIG. 1 taken along line 5A-5A in FIG. 1.

Referring back to FIGS. 5A-5C the operation of the weight selector assembly 200 will be described in more detail. FIG. 5A illustrates a portion of the adjustable barbell system 100 in a first configuration, with the selector rod 240 in a retracted position within the handle assembly 112. In some examples, the selector rod 240 may, in this configuration, pass through the selection aperture 160 of the fixed weight 116. However, as this configuration reflects the minimum weight setting of the barbell (i.e., the weight setting corresponding to the weight of the bar, selector assembly and fixed plate only), the rod 240 does not pass through and thereby engage any of the removable plates 118.

To change the weight of the barbell 110, the user may turn the selector knob 220 (as shown by arrow 203), which causes the selector rod 240 to advance axially with respect to the bar 114 (as indicated by arrow 201), and to engage one or more of the removable weights 118 depending on the amount of rotation of the knob 220. For example, the portion of the barbell 110 in FIG. 5A is shown in another configuration, in FIG. 5B, in which the rod 240 has been advanced to an axial position in which the rod passes through the selection apertures of four of the removable weights 118. The selector rod 240 may be equipped with detent apertures 242 (see FIG. 10), each of which corresponds to one of a plurality of predetermined axial position of the rod in which the rod engages one or more predetermined number of the removable weights 118. In examples in which the selector assemblies at each end of the bar are independently operable, the user may repeat the process with the weight selector assembly 200 on the opposite side of the barbell 110, e.g., selecting the same weight setting and thus a same number of weights 118 at the opposite end of the barbell 110, for a balanced barbell, before lifting the barbell off the base 122, as shown in FIG. 5C. Upon the completion of an exercise, the user may replace the barbell 110 in the base 122, turn the knob 220 to another setting to engage more or fewer of the removable weights 118. Alternately, the user may return the weight selector assembly 200 to the minimum weight setting as shown in FIG. 5A, and remove the barbell handle 112 from the base 122. The user may then select a second barbell handle 112, e.g., with a different shaped bar 114, or configured with different weight settings, optionally reconfigure the base such as by adding an add-on kit, and similarly make adjustments to the barbell 110 via the selector assembly 200 to selectively couple weights to the handle 112.

With further reference to FIGS. 10-13, an example transmission assembly for converting the rotational movement of the knob 220 to axial movement of the rod 240 is described. In the present example, the selector ring 230 drives a gear assembly 300 that advances and retracts the telescoping rod 240 such that the rod 240 can engage or disengage one or more of the removable weights 118 and 138. The gear assembly 300 may include a main bevel gear 310, which is fixed to, and thus rotates in unison, with the selector ring 230. The gear assembly may also include a rack and pinion gear set 330 operatively coupled to the rod 240, and a plurality of intermediate gears that transfer the rotation of the main bevel gear 310 to the pinion gear of the rack and pinion gear set 330. For example, the main bevel gear 310 may be engaged or meshed with an intermediate bevel gear 322 thereby reorienting the rotational axis of the gear assembly from the axial direction to a direction transverse to the axial direction. The intermediate bevel gear 322 may drive one or more additional gears (e.g., spur gears 324 and 326), which in turn drive the rotation of the pinion gear 334. In this example, the intermediate bevel gear 322 and a first spur gear 324 are mounted coaxially to a common shaft 290 such that the first spur gear 324 rotates in unison with the intermediate bevel gear 322. The first spur gear 324 is engaged or meshed with a second spur gear 326, in some examples of a same diameter as the first spur gear 324. The second spur gear 326 is mounted coaxially on a common shaft 292 with another spur gear 334 such that the spur gears 326 and 334 rotate in unison. Spacers (e.g., sleeve or collar 294) may be provided on the shaft between any of the gears mounted on a common shaft (e.g., between gears 326 and 334) such as to control the spacing between the gears on the common shaft. The second spur gear 326 may be used to reverse the direction of rotation such that, as an example, a clockwise rotation of the knob 220 (as indicated by arrow 203) causes an axial movement of the distal end of the rack 336 away from the main bevel gear and thus an extension of the rod into the selection apertures of the weights. Conversely, counterclockwise rotation of the knob 220 (i.e. in a direction opposite that indicated by arrow 203) causes an axial movement of the distal end of the rack toward the main bevel gear and thus a retraction of the rod into the selector assembly. The spur gear 334 may be a pinion gear (or simply pinion) that engages a rack 336 positioned longitudinally to the rod 240. In other examples, instead of gears, transmission of the rotation to axial displacement may be achieved using different types and/or combinations of transmission members such as hubs, pulleys, belts, linkages or others.

The rack gear (or simply rack) 336 may be integrally formed with the rod 240. For example, the rack 336 may be formed by forming (e.g., machine or laser cutting) the gear teeth into a surface (e.g. a bottom surface) of the rod 240. In other examples, the rod 240 may be formed together with the rack 336, such as by casting, molding, or additive manufacturing. The rack 336 may include a plurality of teeth that engage the teeth of the third spur gear (or pinion) 334 such that the rack and pinion gear set 330 is operatively associated with the rod 240 to enable torque and rotation applied to the pinion 334 (via the preceding gears in the gear train) to translate or convert into linear thrust and movement of the selection member 240 axially along the bar 114.

The transmission assembly (e.g., gear assembly 300 or other suitable arrangement of transmission components) may be used, in addition to converting rotational to linear movement, to adjust the torque and speed between the input and output of the transmission assembly. In the case of a gear assembly, gears of different configurations (e.g., size, type, etc.) may be used in different examples to obtain a desired gear ratio. For example, the main bevel gear 310 may be larger in diameter than the intermediate bevel gear 322 (e.g., a 2:1 ratio or greater) to increase the rotational speed and decrease the torque (i.e. gear up) from the input to the main bevel gear to the output of the intermediate bevel gear 322. In some examples, multiple gearing states may be used. In the present example, another gearing stage is provided by the diameter size difference between the intermediate bevel gear 322 and the first spur gear 324, which has a smaller diameter than the input gear at this stage. As the intermediate bevel gear 322 and the first spur gear 324 are on the same shaft, the speed ratio between the two would be the same as they rotate synchronously. However, a change in torque would be effected given the difference in diameter, in this example a reduction in the output torque from the spur gear 324 relative to the torque input to the intermediate bevel gear 322 would be observed. The specific example here is provided for illustration only and a variety of other arrangements may be used to achieve different gearing, as may be desired. For example, a gear ratio that instead increases the input torque may be used, e.g., to overcome resistance (e.g., due to friction or biasing forces) from mechanical components of the system (e.g., resistance applied by the detent mechanism). In other examples, a suitable gear ratio may allow a more compact selector knob 220 to effect a greater amount of extension of the selector rod than may otherwise be possible with a 1:1 gear ratio. In some examples, the selector assembly 200 may be configured such that the knob 220 completes less than a full revolution (e.g., up to 330 degrees or up to 350 degrees) for a full extension of the telescoping rod 240 and thus an adjustment up to the maximum available weight setting for the barbell handle. In examples, an appropriate gear ratio may be selected to speed up the axial movement of the rod 240 and thus reduce the time for making adjustments to the barbell 110.

Figure 5B:
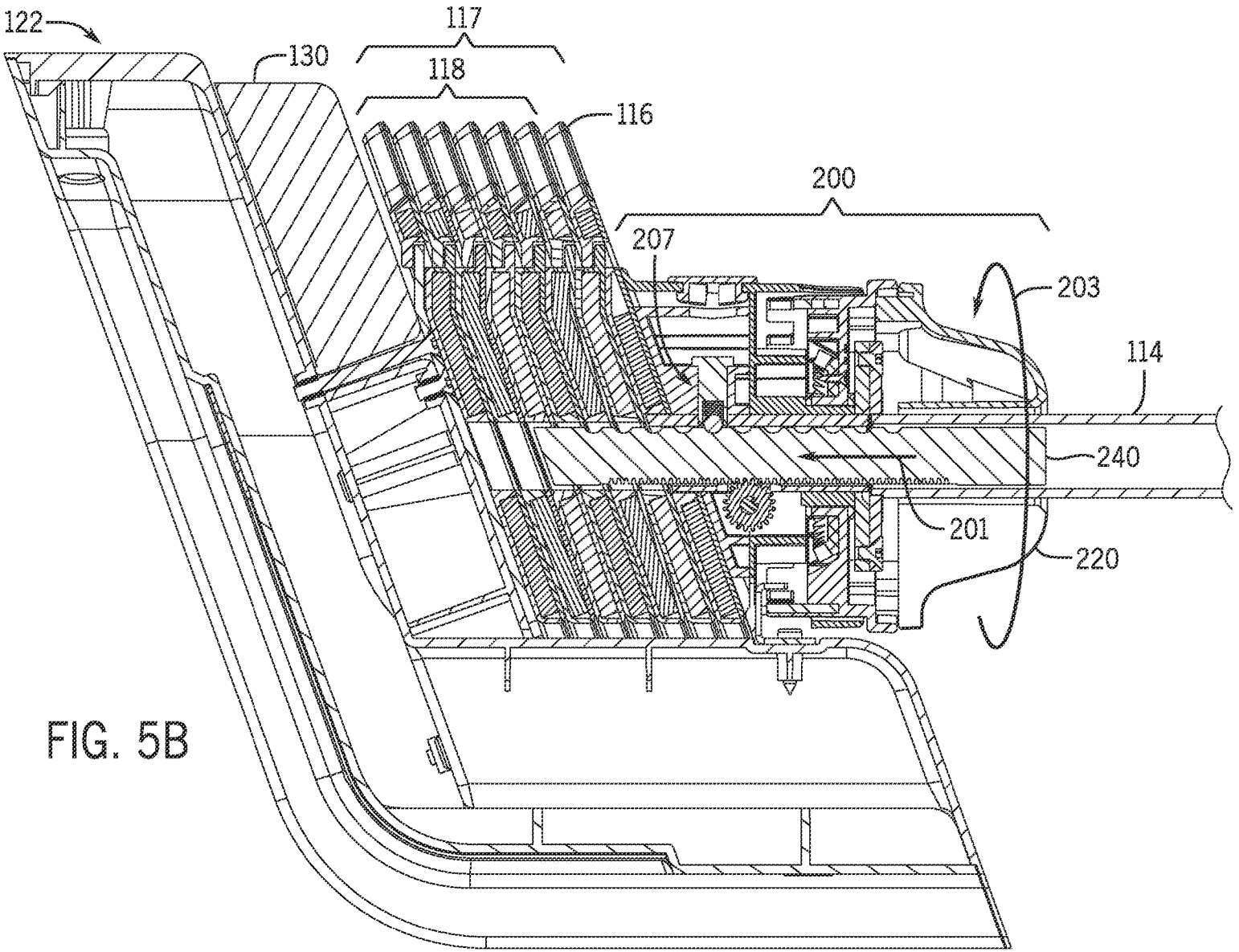
FIG. 5B shows the same view shown in FIG. 5A following an adjustment of the weight selection of the barbell.
Figure 5C:
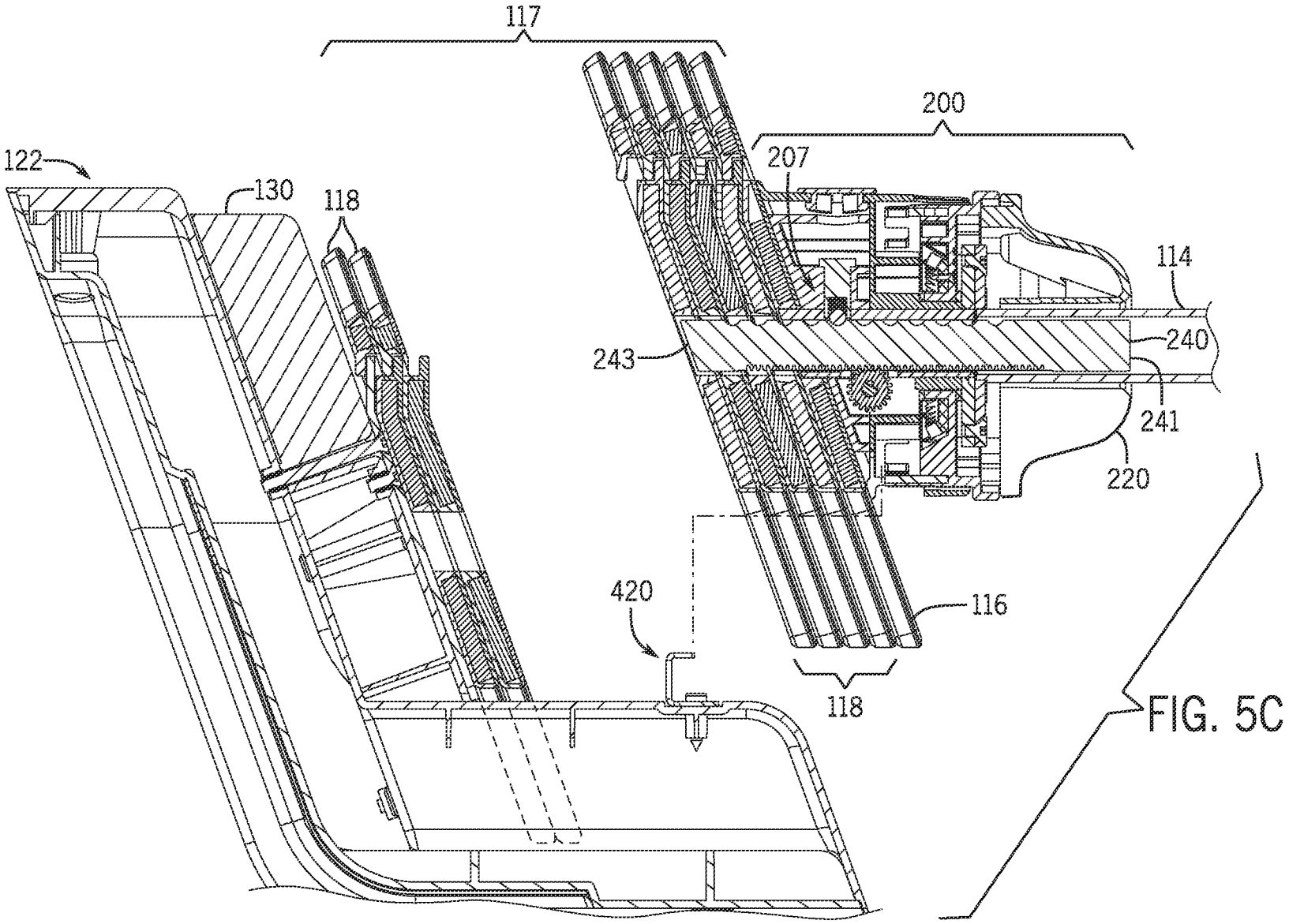
FIG. 5C shows the same view in FIG. 5B but with the barbell removed from the base.
Figure 6B:
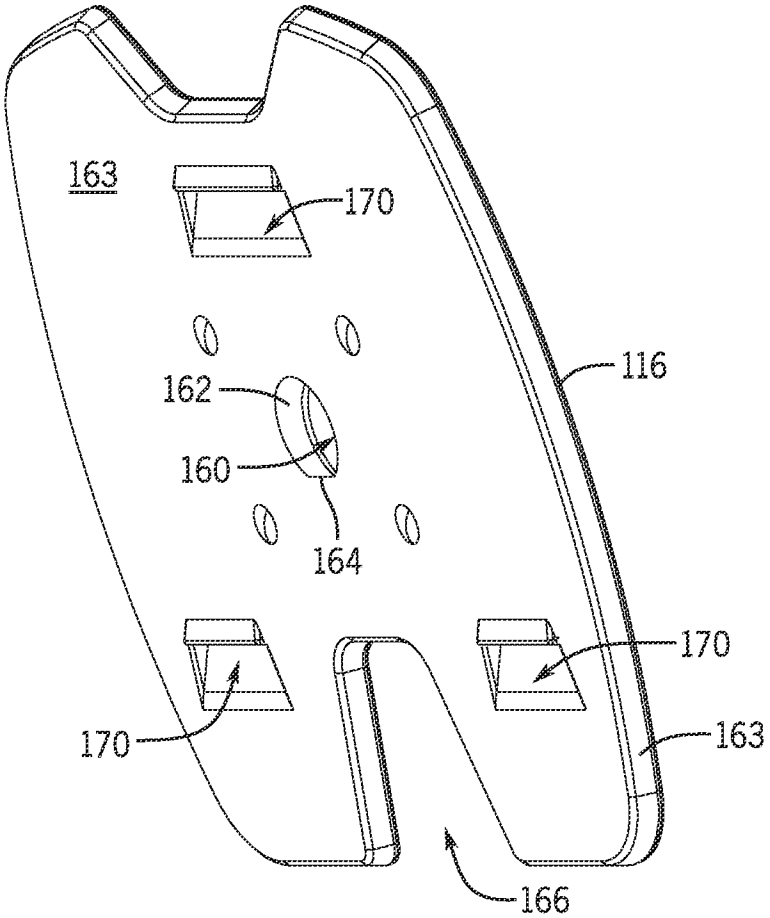
FIGS. 6A and 6B show isometric views of a fixed weight plate according to examples of the present disclosure.
Figure 6A:
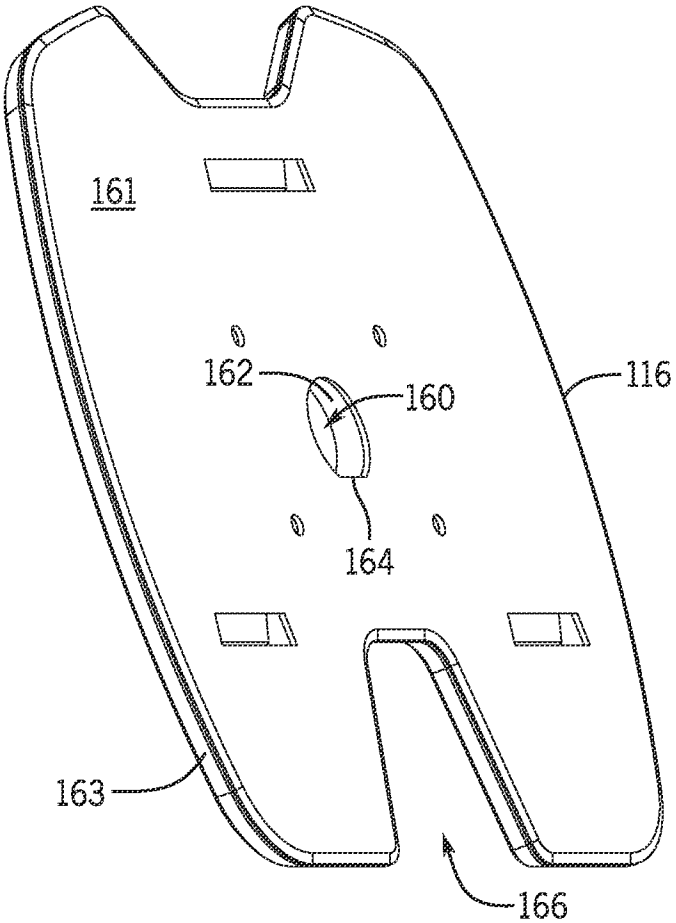
Figure 7B:
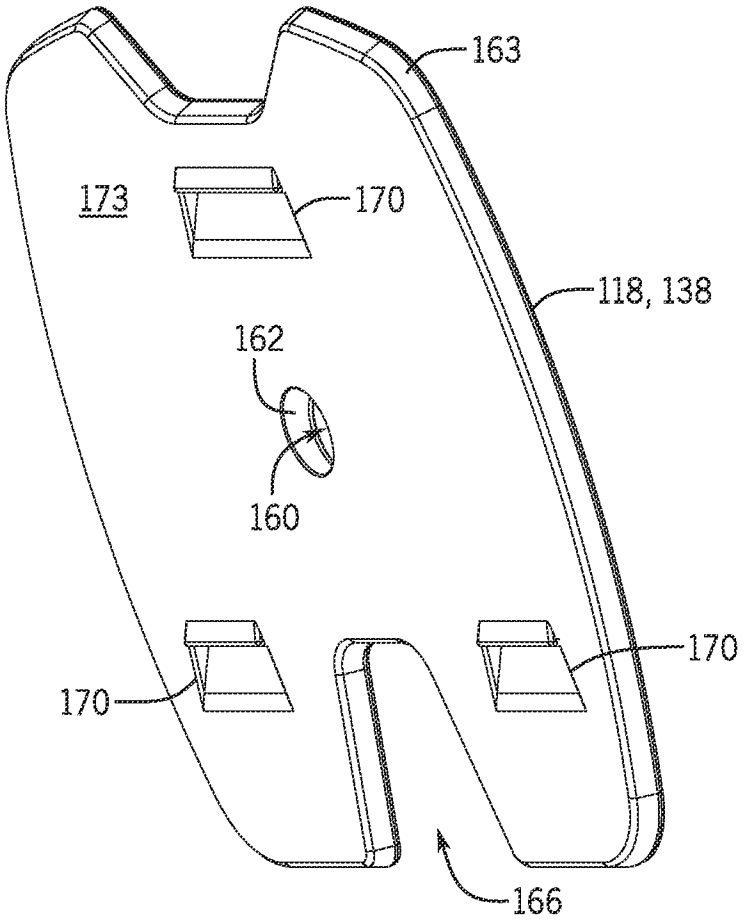
FIGS. 7A and 7B show isometric views of a removable weight plate according to examples of the present disclosure.
Figure 7A:
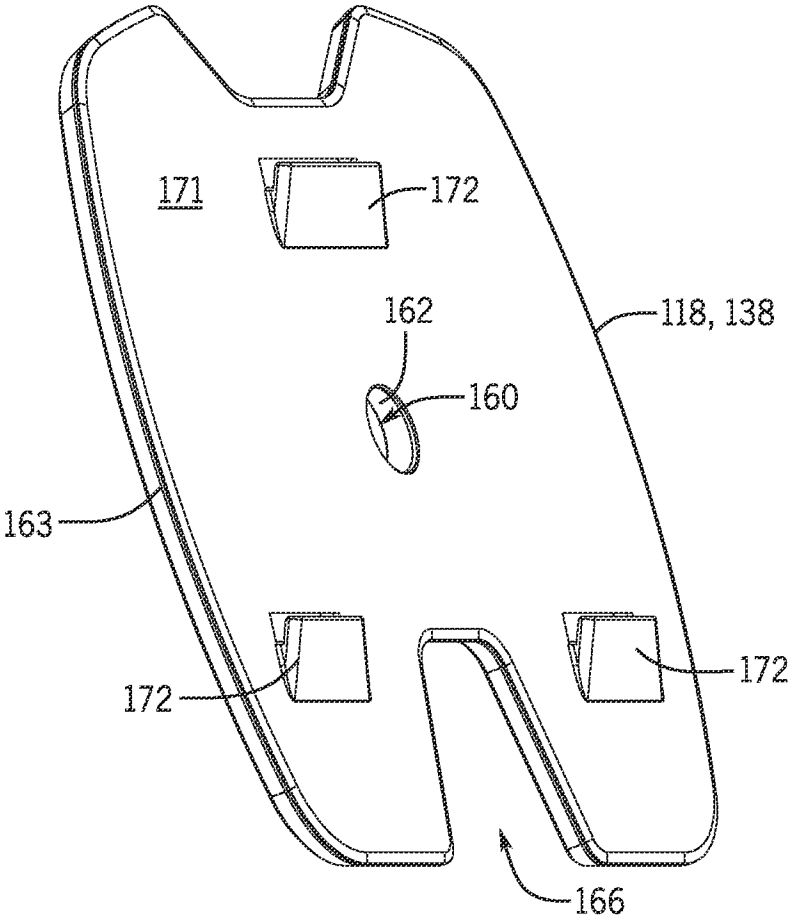
Figure 11:
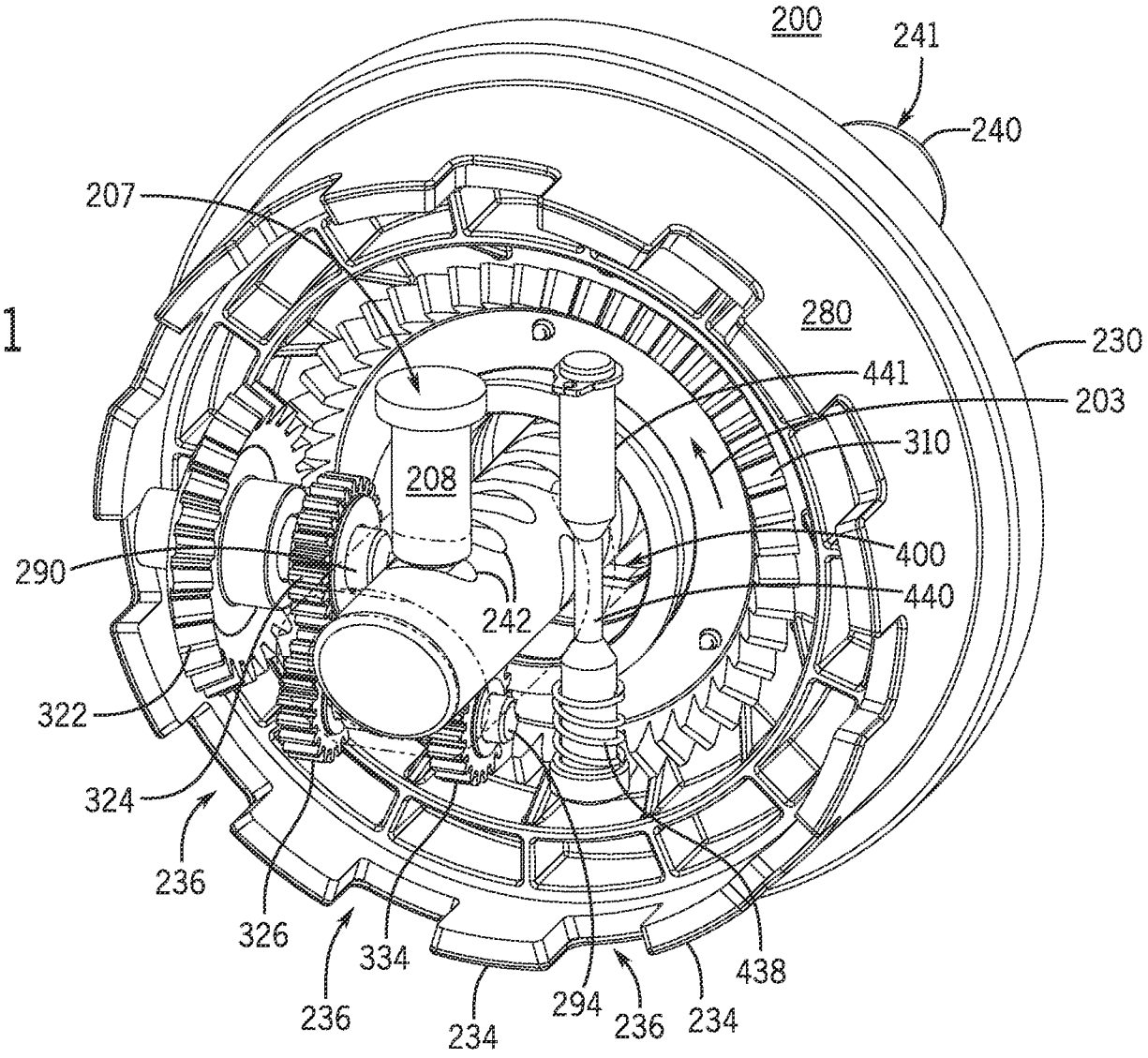
FIG. 11 show an isometric view of a portion of the weight selector assembly of FIG. 10.
Figure 12:
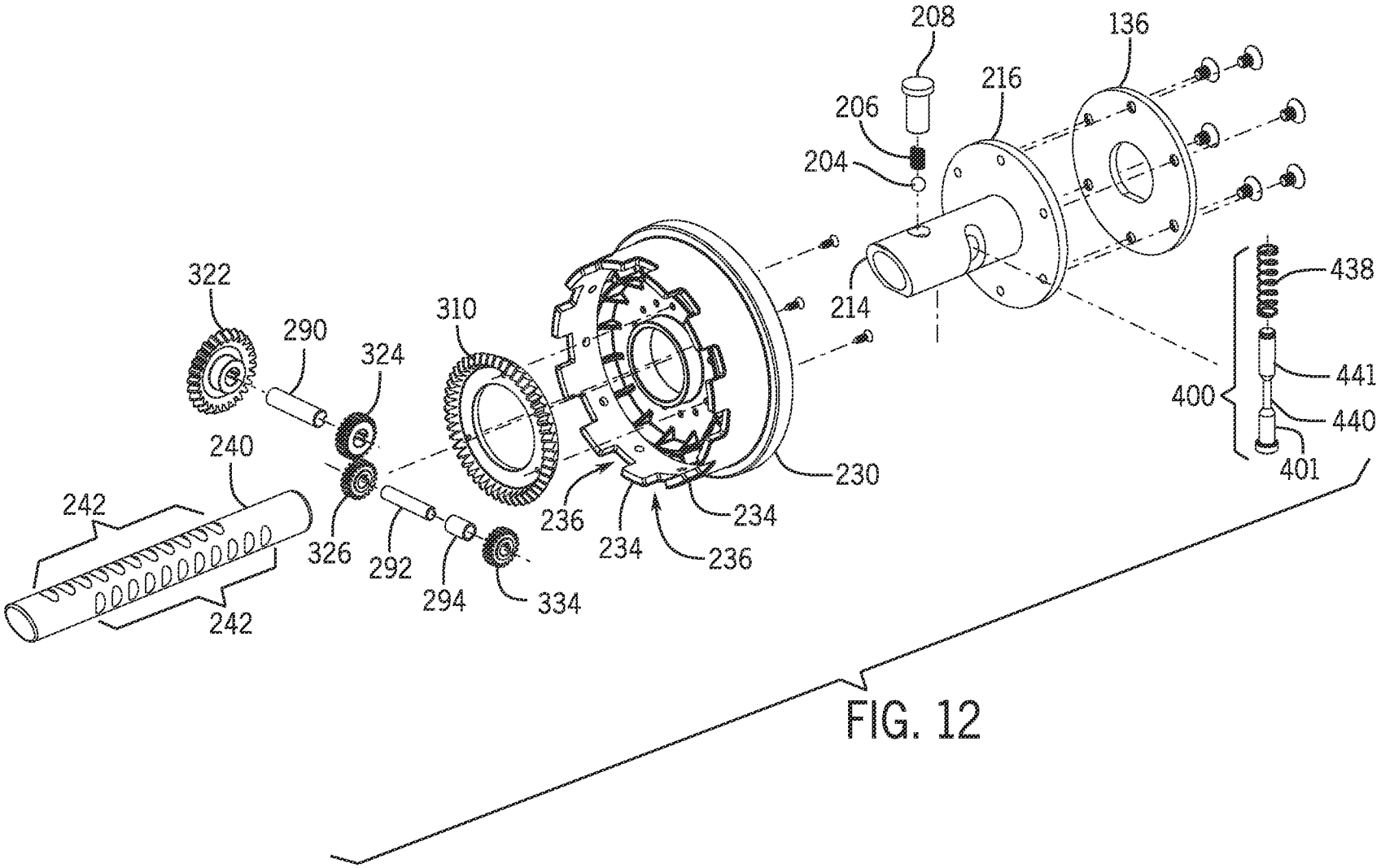
FIG. 12 shows an exploded view of the portion of the weight selector assembly of FIG. 10.
Figure 13:
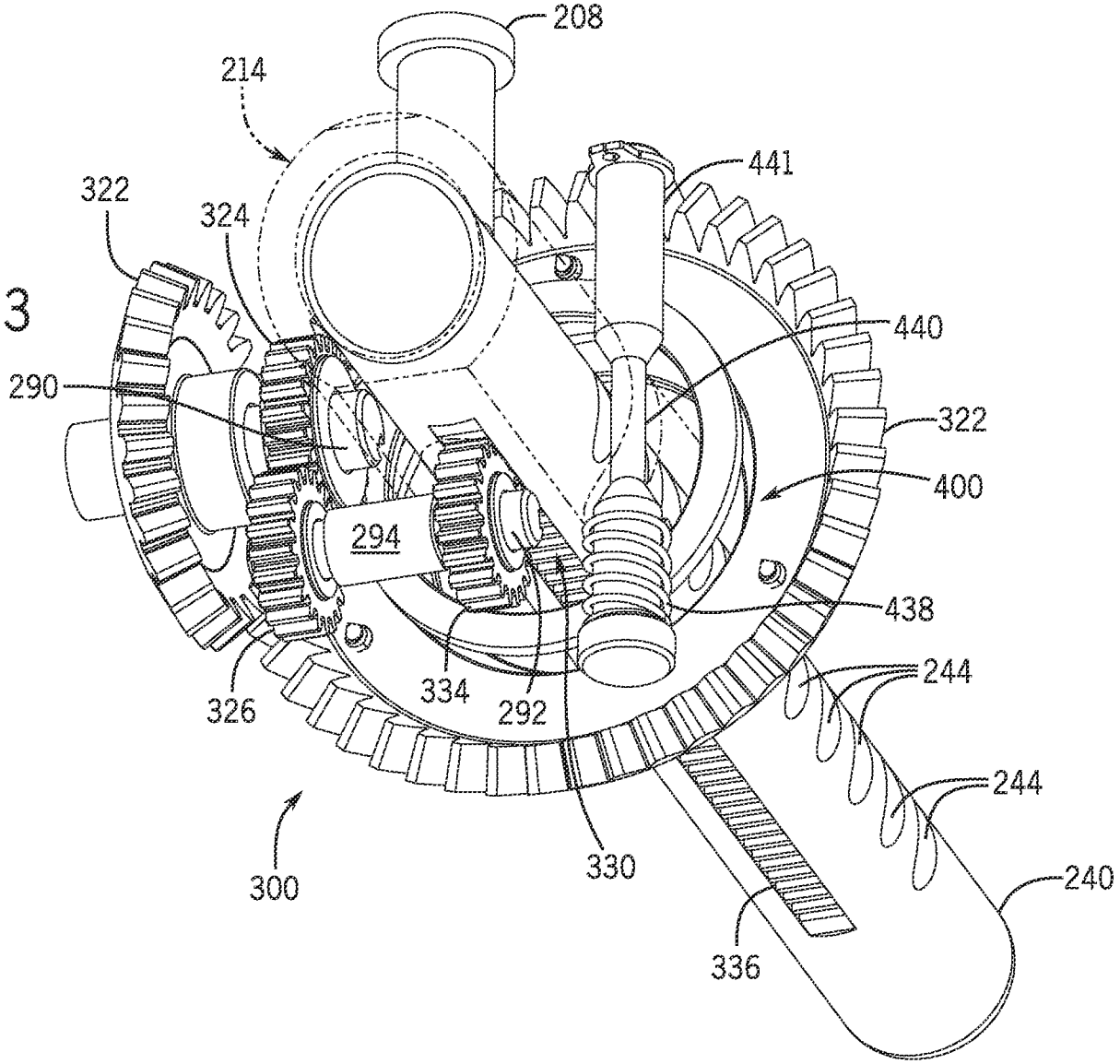
FIG. 13 shows an isometric view of the gear assembly of the weight selector assembly of FIG. 10.

The selector assembly 200 may be associated with a detent mechanism, an example of which is shown in the cross-sectional views in FIGS. 5A-5C and in FIGS. 10-13. In some examples, the detent mechanism may be implemented using a ball detent mechanism 207. One example of a ball detent mechanism 207 includes a tip (e.g., ball 204) and a biasing member (e.g., spring 206), which biases the ball 204 toward the detents, in this case towards the detent apertures 242 of the selector rod 240. In the present example, the ball 204 is received in a detent pin 208 and the spring 206 is positioned between the ball 204 and the pin 208 such that the spring 206 and pin 208 together bias the ball 204 towards the detents. In other examples, the tip may be integrated into a detent pin 208 (i.e., as one end of the pin) and the spring may be configured to bias the pin 208 towards the detents. The pin 208 may be coupled to the selector housing 210, such as by being received in a cavity of body of the housing, which cavity may be enclosed by a cap 211. As illustrated in FIG. 11, the detent mechanism (e.g., ball detent mechanism 207) cooperates with the plurality of detent apertures 242 to urge the rod 240 toward one of a plurality of axial positions, at each of which the rod 240 engages a different number of the weights 117, and each of which thus corresponds to one of the plurality of predetermined weight settings. For example, the detent apertures 242 may be longitudinally spaced on the rod 240 such that a distance between two adjacent apertures 242 corresponds to the thickness a given weight plate that is associated with that particular detent and weight setting. For example, some of the weights of the plurality of weights 117 may be thicker than others, and the detents in such examples would be spaced further apart to engage a thicker plate, and closer to engage a thinner plate. In examples where equally sized plates (e.g., of equal thickness) are used, the apertures 242 may be equally spaced along the longitudinal direction of the rod 240 such that each detent is associated with an equal amount of extension of the rod into the stack of plates. In operation, when the detent mechanism is engaged at a given detent location, the ball 204 is received within one of the plurality of detent apertures 242, urged toward the detent aperture by the spring 206. When an adjustment to the weight of the barbell is being made, the ball 204 is forced against the biasing force of the spring 206 due to the axial movement of the rod 240, which forces the ball 204 out of the aperture until the ball 204 is aligned with the next aperture, whereby under the biasing force of the spring 206 the ball 204 settles into the adjacent aperture, temporarily resisting axial movement of the rod 240 until another weight adjustment is made. Other types of detent mechanisms, such as a ratchet and pawl or other suitable mechanisms capable of resisting the axial movement of the rod, may be used.

As previously described, the adjustable barbell 110 may be configured to be in a locked configuration preventing weight adjustments when the barbell 110 is off the base 122. The barbell 110 may thus include a locking mechanism 400, and example of which is described further with reference now also to FIGS. 14A and 14B. The locking mechanism 400 may include a locking member (e.g., locking pin 401) on the barbell 110 that cooperates with an actuating member (e.g., lock disengagement pin 421) positioned on the base 122. The actuating member (e.g., lock disengagement pin 421) may be provided in any suitable location or configuration on the base 122 to engage, e.g., actuate such as by temporarily translating, rotating, or both a component of, the locking mechanism 400 (e.g., locking pin 401) of the barbell. In one example, the actuation member (e.g., lock disengagement pin 421) may be co-located with the retention features of the base. For example, the lock disengagement pin 421 may extend from the same bracket 419 that includes the one or more retention features (e.g., one or more hooks 418 and 420) and which may be located laterally centrally on the base with respect to the barbell (e.g., on the rail 231). In one such example, a lock disengagement pin 421 may be provided on (e.g., fixedly coupled to or integrally formed with) the free end of at least one of the hooks 418 or 420. In another example, the lock disengagement pin 421 may be a separate pin attached to the base 122 at any suitable location on the base.

The actuating member (e.g., lock disengagement pin 421) may be arranged at a suitable location on the base (e.g., on the rail 231 of the barbell seat 123) that that it actuates, in this case pushes up, on the locking pin 401. The locking pin 401 includes a first wider portion 441 and a second portion 440, which is narrower than the first portion 441 and thus also referred to as neck portion or simply neck 440. The locking pin 401 is positioned transverse to the longitudinal direction of the rod 240, in this case oriented vertically) such that, in the locked configuration, the wider portion 441 is received in one of the plurality of locking divots 244, the interference between the walls of the divots 244 and the wider portion 441 of the locking pin 401 preventing axial movement of the rod 240. The second portion 440 is sufficiently narrower than the first portion 441 such that when the pin is shifted along is axial direction to align the neck portion 440, the neck portion 440 is not received within the divots 244 and thus the locking pin 401 does not mechanically interference with the axial movement of the rod 240. The locking pin 401 may be biased (e.g., using a spring 438 or other suitable biasing member) toward the locked configuration (i.e., with the wider portion 441 received in a divot 244).

Figure 14B:
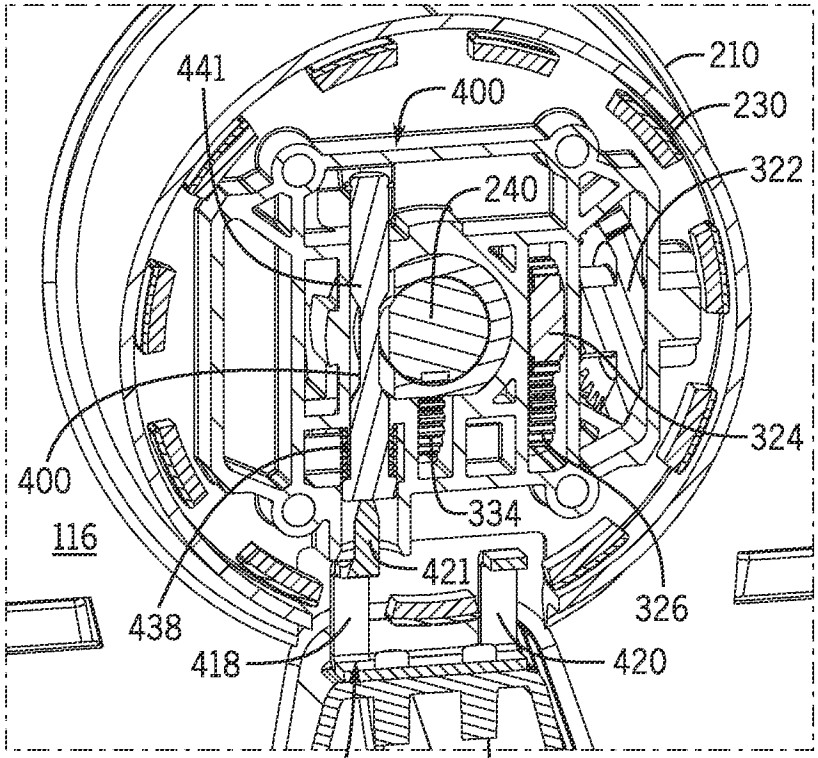
FIGS. 14A and 14B show cross-sectional views of a portion of the adjustable barbell and base taken along line 14-14 of FIG. 5A illustrating operation of automatic unlocking of the adjustable barbell for weight selection upon placement of the barbell on the base from the locked configuration shown in FIG. 14A to the unlocked configuration shown in FIG. 14B.
Figure 14A:
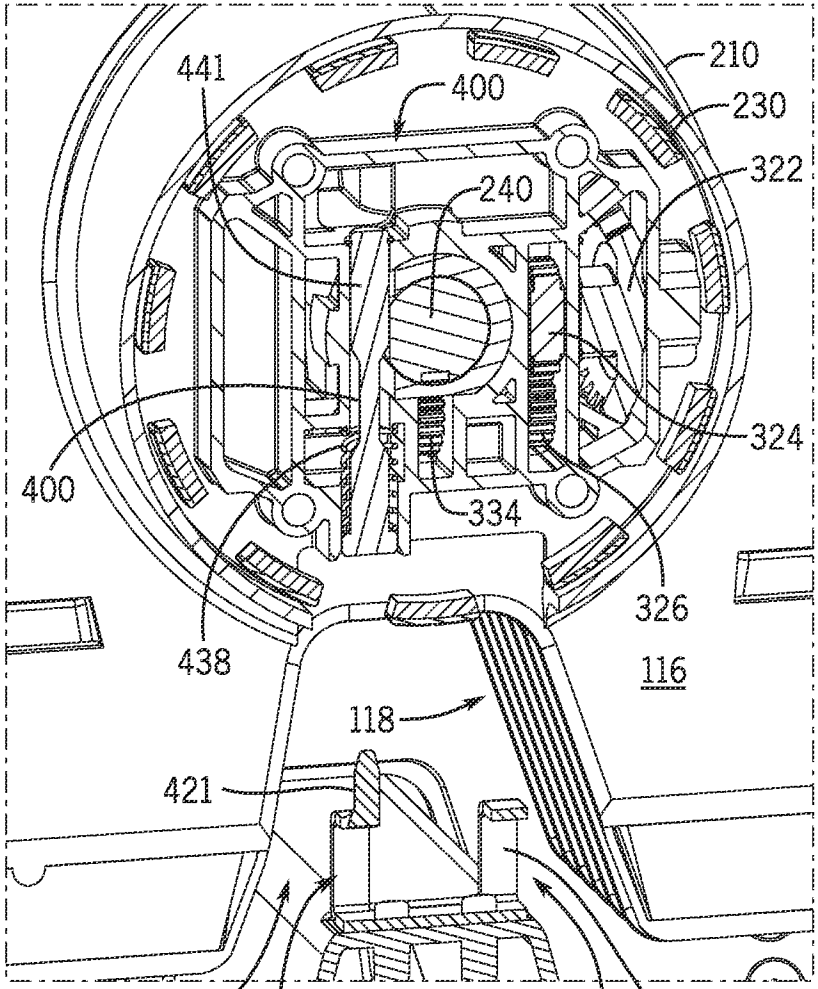

As show in FIGS. 14A and 14B, in some embodiments, the displacement of the locking member (e.g., pin 401) may be automatic upon placement of the barbell 110, thus also the barbell handle 112, on the base 122. That is, in some such examples, the base 122 may be configured (e.g., with actuating features) that automatically actuate the locking mechanism 400 and thus unlock the barbell handle 112, and thus also the barbell 110, for weight adjustment when the barbell 110/handle 112 is placed on the base. FIG. 14A illustrates an actuating member (e.g., lock disengagement pin 421) extending upwardly toward the barbell, with the barbell being shown lifted off the base 122, and the locking pin 401 positioned (by the biasing force of the spring 438) in the locked configuration in which the wider portion 441 engages a locking divot on the rod 240. When the barbell is placed on the base 122, the free end of the lock disengagement pin 421 actuates, in this case pushes up on, the locking pin 401 actuating the pin 401, in this case vertically, to the unlocked position shown in FIG. 14B. Conversely, as illustrated in FIG. 14A, when the barbell 110/handle 112 is removed from the base 122, the biasing member 438 biases the locking pin 401 to the locked position, in which the wider portion 441 engages one of the plurality of locking detents 244. A locking mechanism as described prevent or reduce the risk of injury to the user as adjustments to the barbell 110 and consequently separation of the removable weights 118, 138 from the bar handle 112 may be prevented when the barbell 110/handle 112 are not in the base, and possibly in use by the user. Moreover, an automatic locking mechanism as described herein may further enhance the user experience by increasing the efficiency of exercise by obviating the need for the user to manually unlock the barbell for adjustment each time the user wishes to make an adjustment to the weight of the barbell. While the barbell system 100 of the present example is configured for automatic unlocking (e.g., by actuation of the locking pin 401 by the lock disengagement pin 421 upon placement of the barbell on the base), in other examples the barbell system may be configured for manual unlocking. For example, the locking mechanism of the barbell (e.g., locking pin 401) may instead be actuated to an unlocked position by manipulation of a manual actuator (e.g., a dial, switch, or button), which may be located on the barbell itself, by the user.

Figure 16B:
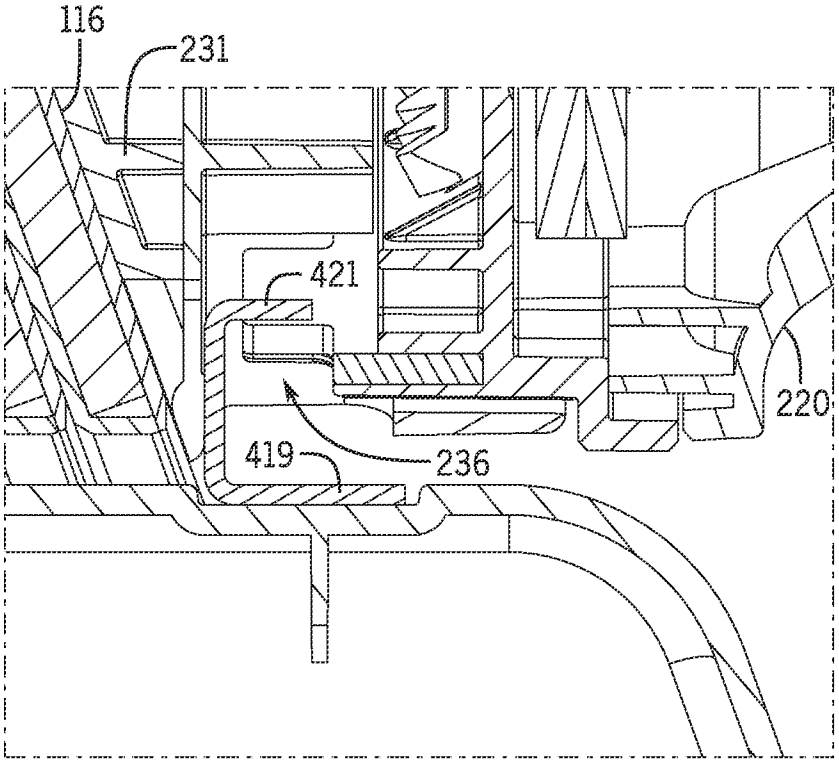
FIG. 16B illustrates a cross-sectional view of the barbell retention mechanism in the configuration shown in FIG. 15B and taken along line 16B-16B of FIG. 15B.
Figure 16A:
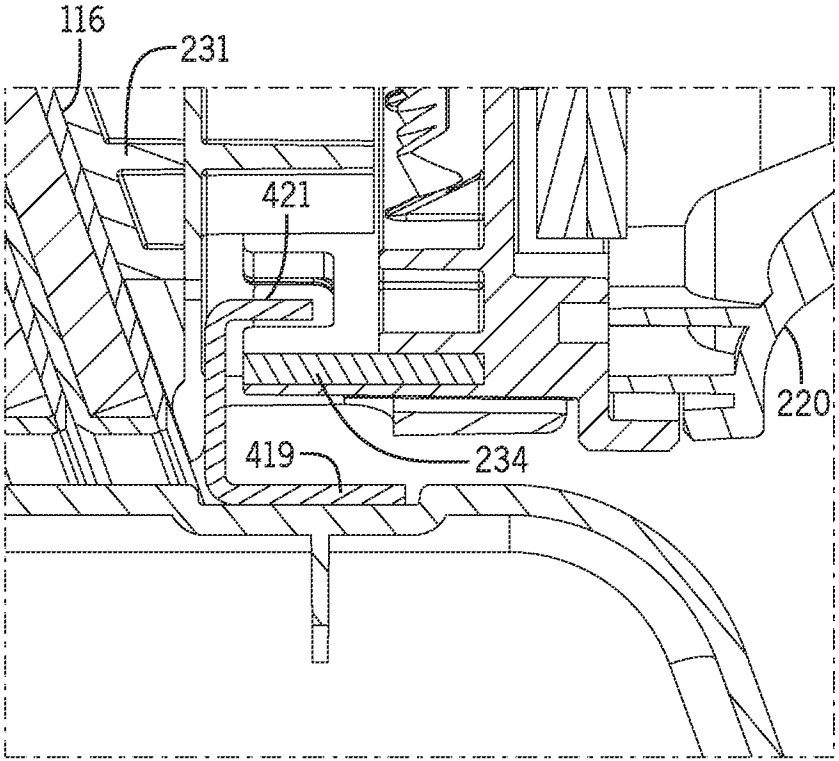
FIG. 16A illustrates a cross-sectional view of the barbell retention mechanism in the configuration shown in FIG. 15A and taken along line 16A-16A in FIG. 15A.
Figure 17:
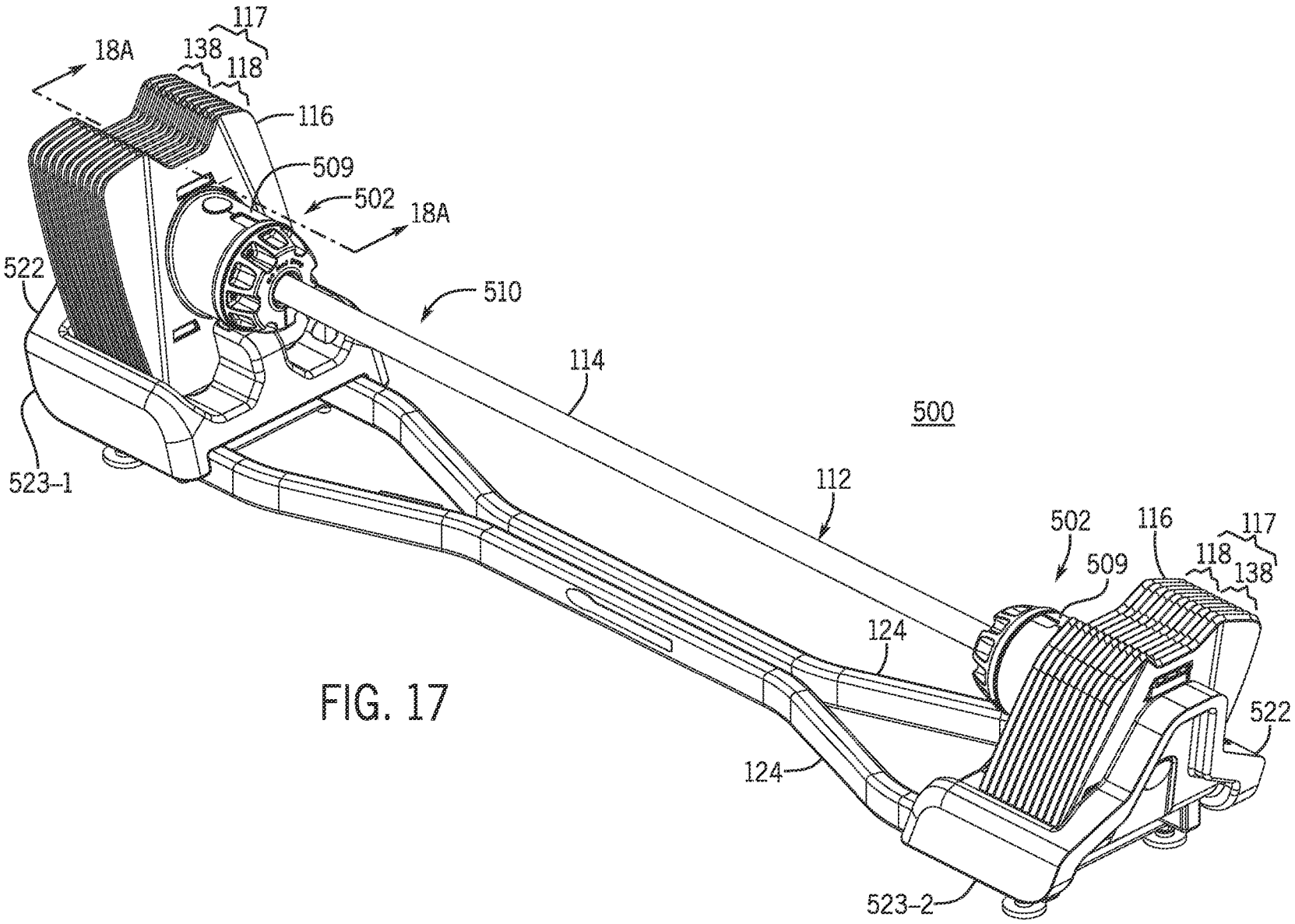
FIG. 17 shows an isometric view of an adjustable barbell system according to further examples of the present disclosure.

The barbell system 100 may also be equipped with a barbell retention mechanism configured to prevent removal of the barbell handle 112, and thus the barbell 110, from the base in certain situations. An example of such a retention mechanism is illustrated and described further with reference to FIGS. 15A, 15B, 16A, and 16B. The retention of the barbell may be achieved by providing one or more suitably shaped structures (e.g., one or more catches or hooks 418, 420) on the base, which extend from the base 122 toward the barbell. The base may be provided with a single or a plurality of hooks, e.g., as in the example illustrated in FIGS. 15A and 15B, each of which may be configured to interfere with removal of the barbell from the base when the barbell is between settings. In the example in FIGS. 15A and 15B, the hooks 418, 420 are co-located, in this case provided on one bracket 419, which also includes the lock disengagement pin 421. However, in other examples, the hooks 418, 420 may be separately attached to the base 122, they may be located at different locations on the base (e.g., to engage opposite sides of the selector assembly or the fixed weight). In yet other examples, only a single hook or other suitable retaining structure may be used for each barbell side or for the entire barbell system, which may be located at either one of the barbell seats, or more centrally on the base. The hooks 418, 420 may be operatively arranged on the base such that at least a portion of a hook, e.g., a free end of the hook, interferes with a component of the barbell, in this case by the teeth of the selector ring 230, when the ring 230 is in a rotational position between the predetermined weight settings. As shown in FIG. 15A, in which the selector ring 230 is between settings, upward (e.g., vertical) movement of the teeth 234 is blocked by the free ends of the hooks 418, 420 which prevents vertical movement and thus removal of the barbell from the base. This interference is also illustrated in FIG. 16A, which shows a partial sectional view of the retention mechanism taken along line 16A in FIG. 15A. Conversely, as shown in FIGS. 15B and 16B when the selector ring 230 is in a rotational position that corresponds to a setting, the hooks are aligned with the recesses 236, removing the previously described interference and allowing removal of the barbell from the base.

FIGS. 17-26C show an adjustable barbell system 500 in accordance with further examples of the present disclosure. Similar to the adjustable barbell system 100, the adjustable barbell system 500 includes an adjustable barbell 510 and a base 522, which may have features and components similar to those of the barbell 110 and base 122. For example, the barbell 510 includes a handle assembly 112 (also referred to as barbell handle or handle), which has a pair of weight selector assemblies 502, one at each of the opposite ends of the bar 114. A fixed weight plate 116 may be rigidly (e.g., non-movably) coupled to each of the opposite ends of the handle assembly, and more specifically to the weight selector assembly 502 disposed at each end of the bar 114. Each weight selector assembly 502 includes a selector knob 520, which is rotatably coupled to the bar 114, and which allows the user, responsive to rotation of the knob 520 relative to the bar 114, to set the weight of the barbell 510. As such, each of the weight selector assemblies 502 is operable to engage a plurality of removable weight plates (also referred to as weights or plates) 118 and/or 138 to selectively couple one or more of the plurality of removable weights to the handle assembly 112 based on a rotational position of the selector knob 520 with respect to the bar 114. Similar to the base 122 of the barbell assembly 100, the base 522 of the barbell assembly 500 is configured to support the barbell 510 (e.g., the handle assembly 112 and/or any of the individual removable weights 118) when not in use. The base 522 includes first and second barbell seats 523-1 and 523-2, whose features and operation are similar to those of the seats 123-1 and 123-2 of the adjustable barbell assembly 100. For example, each of the barbell seats 523-1 and 523-2 includes a first portion that extends generally horizontally to support the stack of weights 117 and further including a second upright portion that supports the stack of weights 117 in an upright position (e.g., with the weights generally resting on their peripheral faces). The upright portions may be at an angle greater than 90 degrees to their respective first portion so as to provide a funnel-like shape that may facilitate an easier placement of the barbell 510 on the base 522 (e.g., without precise centering or alignment by the user). In other embodiments, the upright portions of the seats 523-1 and 523-2 may be configured to extend substantially vertically. The upward facing side of the seats 523-1 and 523-2 may be configured to receive (e.g., non-rotatably) and align (e.g., with respect to the longitudinal axis of the base 522) each of the individual weight plates 117 in the base 522. For example, like the seats 123-1 and 123-2, each of the seats 523-1 and 523-2 may include a cavity 237 with a rail 231 extending upward from the cavity 237 to define a pair of channels 228-1 and 228-2 extending along the longitudinal direction of the base 522. The barbell seats 523-1 and 523-2 are spaced apart and connected by a base frame 124, which may be implemented using one or more beams or any other combination of suitable structural members.

The base 522 may be configured for placement onto a support surface (e.g., the ground) and may include leveling feet such as to compensate for an uneven support surface. The base 522 may be supported at an elevated position above the support surface (e.g., the ground) by a stand such as the stand 120 shown in FIGS. 1 and 2. Like the barbell system 100, the barbell system 500 may include a plurality of barbell handles 112, with different handles having a different configuration such as having a bar with a different shape (e.g., one or more straight bars and one or more curl bars) and/or having selector assemblies configured to couple a different maximum amount of weights and/or different increments of weights to the handle 112. The maximum number of weight plates and thus the maximum weight for a given handle 112 of the barbell system 500 may be reconfigurable similarly to the barbell system 100 using an add-on kit as described with reference to FIGS. 4A and 4B.

Figure 18A:
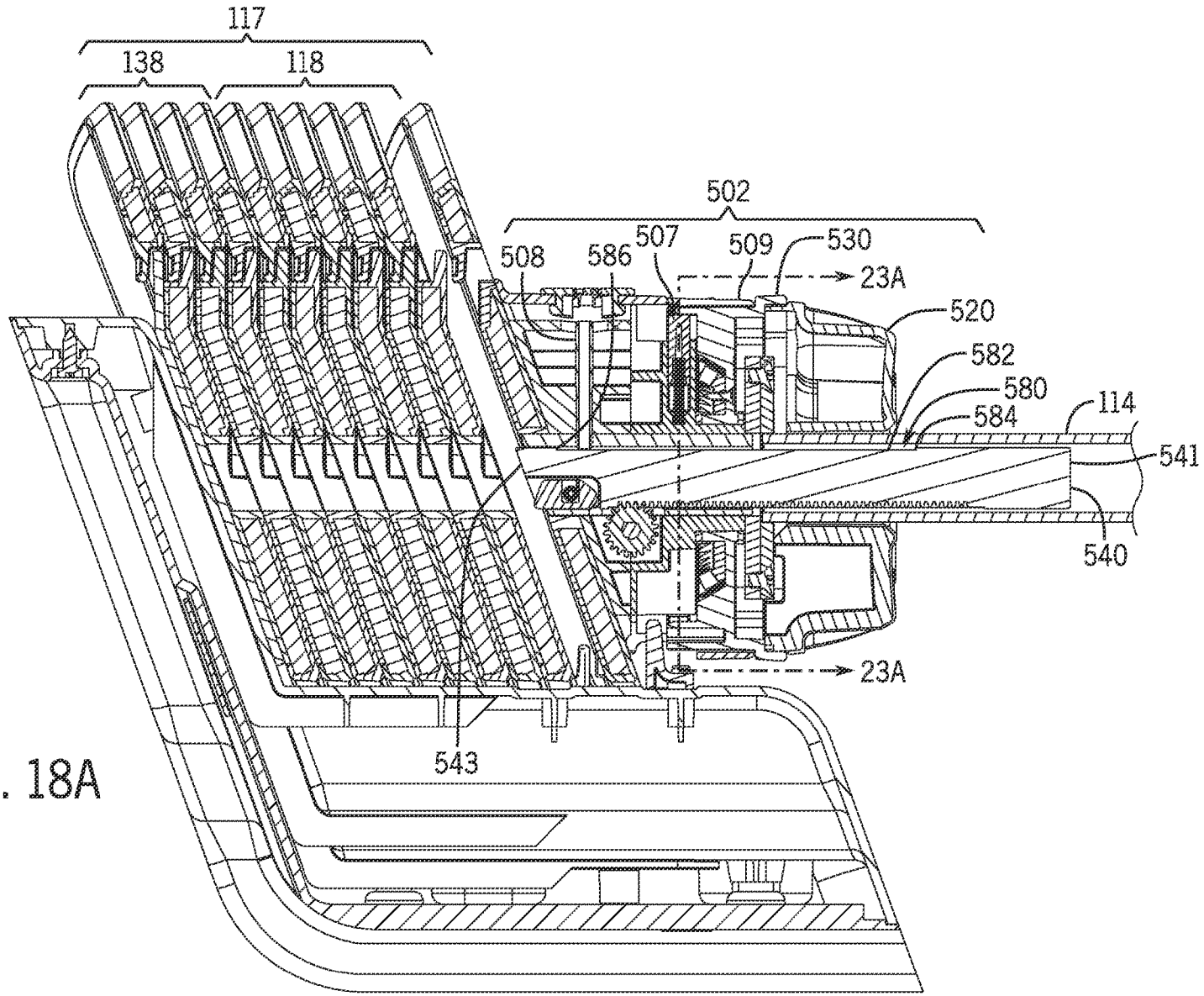
FIG. 18A shows a cross-sectional view of a portion of the adjustable barbell system of FIG. 17 taken along line 18A-18A in FIG. 17, with one of the weight plates of the stack removed.
Figure 18B:
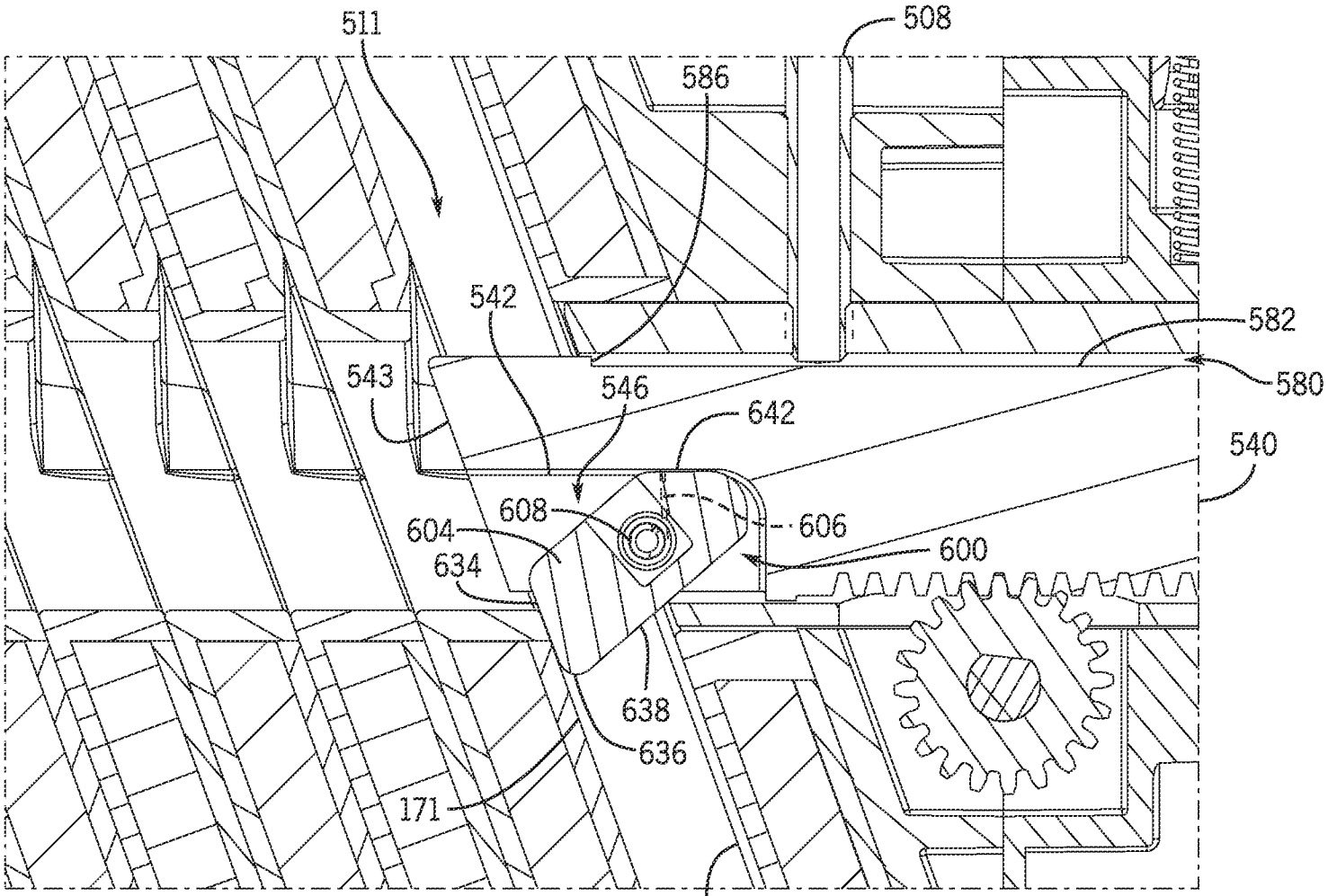
FIG. 18B shows the same view shown in FIG. 18A following an adjustment of the weight selection of the barbell with an extension prevention mechanism preventing extension of the selector rod past the gap formed by the missing weight plate of FIG. 18A.
Figure 18C:
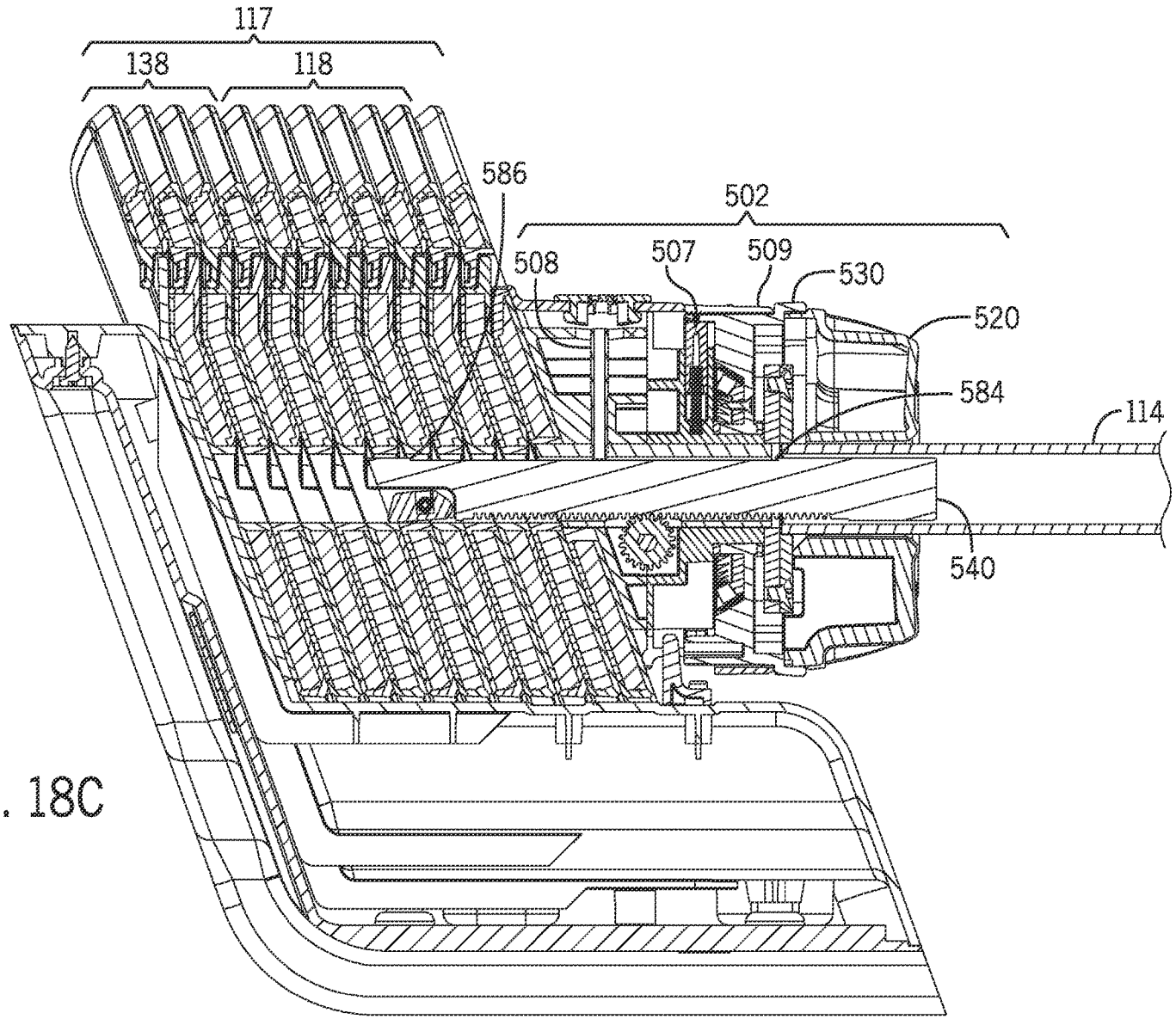
FIG. 18C shows the same view shown in FIG. 18A following an adjustment of the weight selection of the barbell with the missing weight plate of FIG. 18A replaced and the extension prevention mechanism allowing extension of the selector rod through the selection apertures of successive removable weights.

Referring now also to FIGS. 18A-18C, the weight selector assembly 502 is operable to selectively engage any number of the plurality of removable weights 118 and/or 138 to selectively removably couple them to the handle assembly 112 for adjusting the weight of the barbell 510. The weight selector assembly 502 includes a selector housing 509, which is fixed to the bar 114, and a selector ring 530 rotatably coupled to the selector housing 509. The selector assembly 502 further includes a selector knob 520, which is fixed to the selector ring 530 such that the ring 530 rotates when the knob 520 is rotated. Rotation of the knob 520 and consequently the selector ring 530 relative to the bar 114 allows the user to select the weight setting and thus the number of plates 117 to be coupled to a respective end of the barbell 510. In some embodiments, each of the weight selector assemblies 502 operates independently, allowing the weight attached to each of the opposite ends of the bar 114 to be independently selected or set. To change the weight of the barbell 510, the user may place the barbell 510 in the base 522, turn one or both of the selector knobs 520 to the rotational position(s) corresponding to the desired weight thereby causing one or both of the selector assemblies 200 to engage an appropriate combination of weights 117. The user may then remove the barbell 510 from the base 522 to perform a desired exercise. While the barbell 510 is removed from the base 522, a locking mechanism, such as locking mechanism 400, prevents changes to the weight selection of the barbell 510. When the barbell 510 is on the base 522, a locking pin 401 of the locking mechanism 400 may be held in a disengaged position by the lock disengagement pin 421. When the barbell 510 is removed from the base 522, the locking pin 401 returns to an engaged position in which the locking pin 401 is biased into a divot 544 by a biasing member 428 whereby the locking mechanism 400 prevents extension of the rod 540, as previously described with respect to FIGS. 14A and 14B. Thus the locking mechanism 400 may resist rotation of the knob relative the bar when the barbell is removed from the base. Weights not coupled to the barbell 510 may remain in the base 522. Should the user desire a different barbell weight, the user may place the barbell 510 back in the base 522, turn one or both of the selector knobs 520 to a different rotational position to engage a different set of the removable weights or none of the removable weights, and remove the barbell 510 from the base 522 to continue to perform exercise with the adjusted weight.

The selector rod 540 is movably coupled to the bar 114. The selector rod 540 may be implemented by a generally straight elongate rigid member, which may have circular or non-circular cross section. The selector rod 540 has a first (or proximal) end 541 and a second (or distal) end 543. In one example, the selector rod 540 is configured to move in the axial direction of the bar 114 (e.g., as indicated by arrow 501) responsive to rotation of the knob 520 (e.g., as indicated by arrow 503 in FIG. 20.) to selectively engage one or more of the removable plates based upon the rotational position of the knob 520. A transmission mechanism (e.g., a gear assembly 300), as described above, may be used to convert the rotational movement of the knob 520 and selector ring 530 to axial movement of the rod 540.

Figure 25:
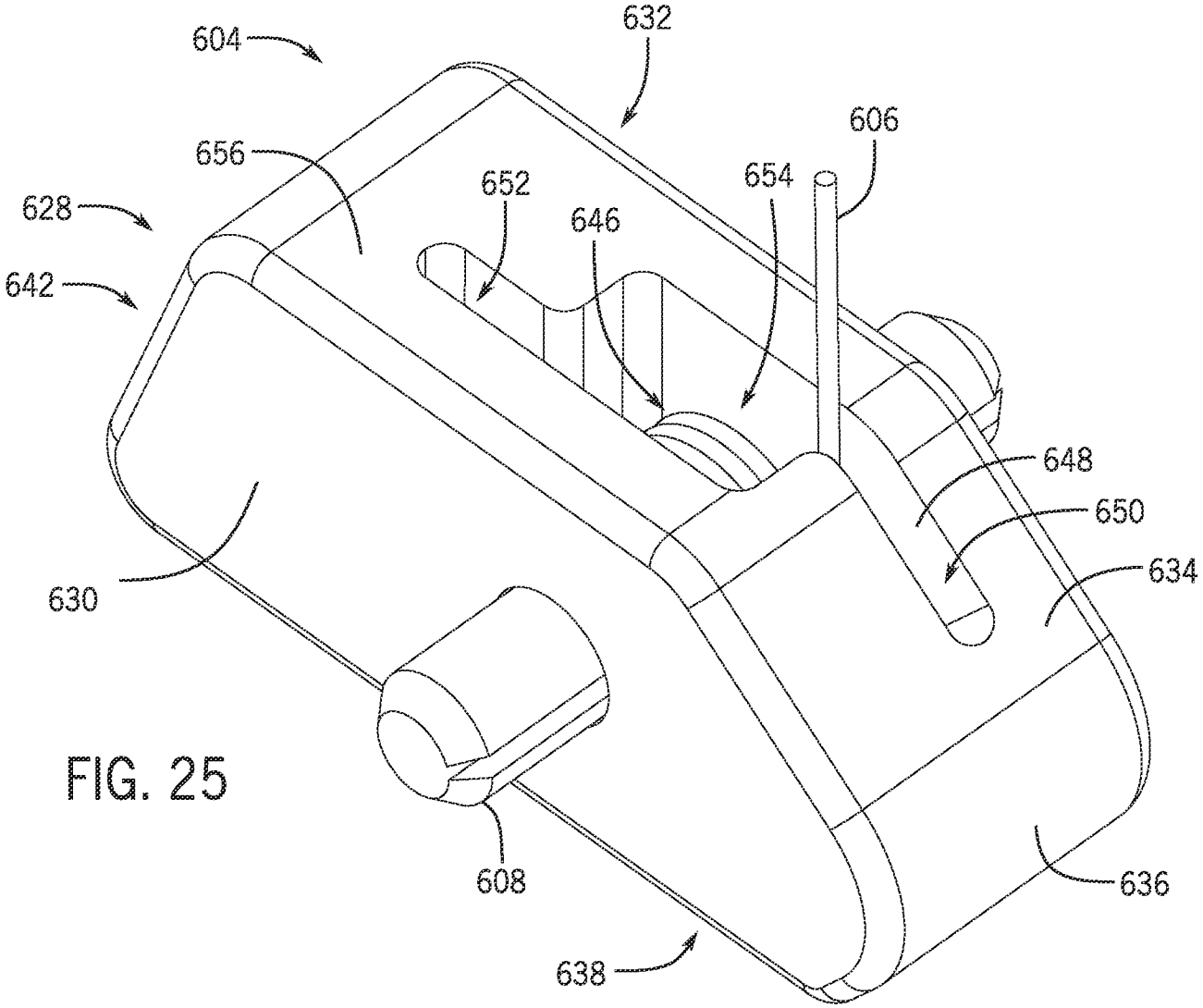
FIG. 25 is an isometric view of a portion of an extension prevention mechanism.

With reference also to FIGS. 18B and 25, the adjustable barbell 510 may include an extension prevention mechanism 600. The extension prevention mechanism 600 prevents the weight selector assembly 502 from selecting additional weights, such as by preventing further axial extension of the selector rod 540 into the plurality of weights (also referred to as weight stack), when a weight is detected as missing from the weight stack. An extension prevention mechanism 600 may be provided in each of the selector assemblies 502, e.g., at the distal end 543 of the respective selector rod 540. The extension prevention mechanism 600 may include a gap-detecting member 602 (e.g., a pawl 604), which is biased, generally radially, away from the selector rod 540. The biasing force acts to move at least a portion of the gap-detecting member 602 radially away from the selector rod 540 in the presence of a sufficiently large gap between two adjacent plates (e.g., a gap greater than the nominal distance due to freeplay between two interlocked weight plates). The gap-detecting member 602, when deflected away from the selector rod 540, interferes with the further axial extension of the selector rod 540 such as by pressing against the weight plate located distally across the gap. The gap-detecting member 602 may be movably (e.g., pivotally) coupled to the distal end 543 of the selector rod 540 and biased away from the selector rod 540 (e.g., via a biasing element or spring 606) that urges at least a portion of the gap-detecting member 602 radially away from the selector rod 540. The gap-detecting member 602 may be movably attached to a distal end of the rod 540 to prevent the rod 540 from coupling a weight to the weight selector assembly unless the weight is interlocked to a distal face of another weight of the plurality of weights that is already coupled to the weight selector assembly.

The gap-detecting member 602 may include a pawl 604 which has a generally rigid body 628 (see e.g., FIG. 25). The body 628 has a rear face 642, opposing sides 630 and 632, a lower face 638, a nose portion 636, a leading face 634, and a top face 656. The nose portion 636 includes a curved surface that connects the lower face 638 to the leading face 634. The biasing element 606 is received within the body 628. In some embodiments, the body 628 may include a biasing element receiving portion 654 defined by an internal wall 648. The biasing element receiving portion 654 may include extension portions 650 and 652 leading away from the central area of the biasing element receiving portion 654. In the example shown in FIG. 25, the biasing element 606 is a coil spring. The coil spring has legs that are received within the extension portions 650 and 652, to retain the spring 606, and provide locations for the biasing element 606 to push against the body 628 to rotate it about the axle 608. In the example shown, the axle 608 extends through the opposing sides 630 and 632, and through the center of the biasing element 606. The ends of the axle 608 extend through cooperating apertures formed in the distal end of the selector rod 540, thus capturing the pawl 604 and the biasing element 606 in a pawl receiving slot 546 formed in the distal end 543 of the selector rod 540.

In the event that the weights 117 are improperly stacked such as by missing a plate in the stack and/or failing to interlock the adjacent plates, a gap 511 of sufficiently large size for activation of the extension prevention mechanism 600 may be formed between the weights 117 in the stack. In such a situation, it may be advantageous to prevent the selector rod 540 from advancing into the selection apertures 160 of weights 117 that are located distally across the gap 511 and thereby preventing the coupling of those weights 117 to the handle 112, e.g., to prevent undesired axial movement of weights 117 when the barbell 510 is lifted from the base 522. The gap-detecting member 602 (e.g., pawl 604) may be received in a pawl receiving slot 546 (e.g., extending lengthwise) along the distal end 543 of the selector rod 540. The gap-detecting member 602 (e.g., pawl 604) is biased radially away from the selector rod 540 by the biasing element 606. In the presence of a gap 511 (see FIG. 18B), as the distal end 543 of the selector rod 540 moves into the gap 511, the biasing element 606 causes a portion of the gap-detecting member 602 (e.g., the nose portion 636 of the pawl 604) to move (e.g., rotate about axle 608) radially away from the selector rod 540 and into the gap 511. In this deflected configuration, the gap-detecting member 602, e.g., the leading face 634 of the pawl 604, contacts the face 171 of the weight 117 located distal to the gap 511 preventing further axial extension of the selector rod 540, thereby preventing the coupling of any of the weight plates 117 distally to the gap 511 to the handle assembly 112. In some embodiments, the movement of the gap-detecting member 602 (e.g., the rotation of pawl 604 about axle 608) may be limited. For example, the rear face 642 of the pawl 604 may contact an upper internal face 542 of the pawl receiving slot 546, preventing over-rotation of the pawl 604 into the gap 511. In other examples, the pawl receiving slot 546 may be a through slot and/or over-rotation may be limited such as by engagement of the pawl 604 with one or both weights located on the opposite sides of the gap 511. When the gap 511 has been removed, such as by the replacing the missing weight and/or by properly interlocking the adjacent plates, the gap-detecting member 602, in this example the lower face 638 of the pawl 604, may slide or ride along the wall of the passage formed by the axially aligned selection apertures 160 of the weight plates 117 under the biasing force of the spring 606.

Figure 19:
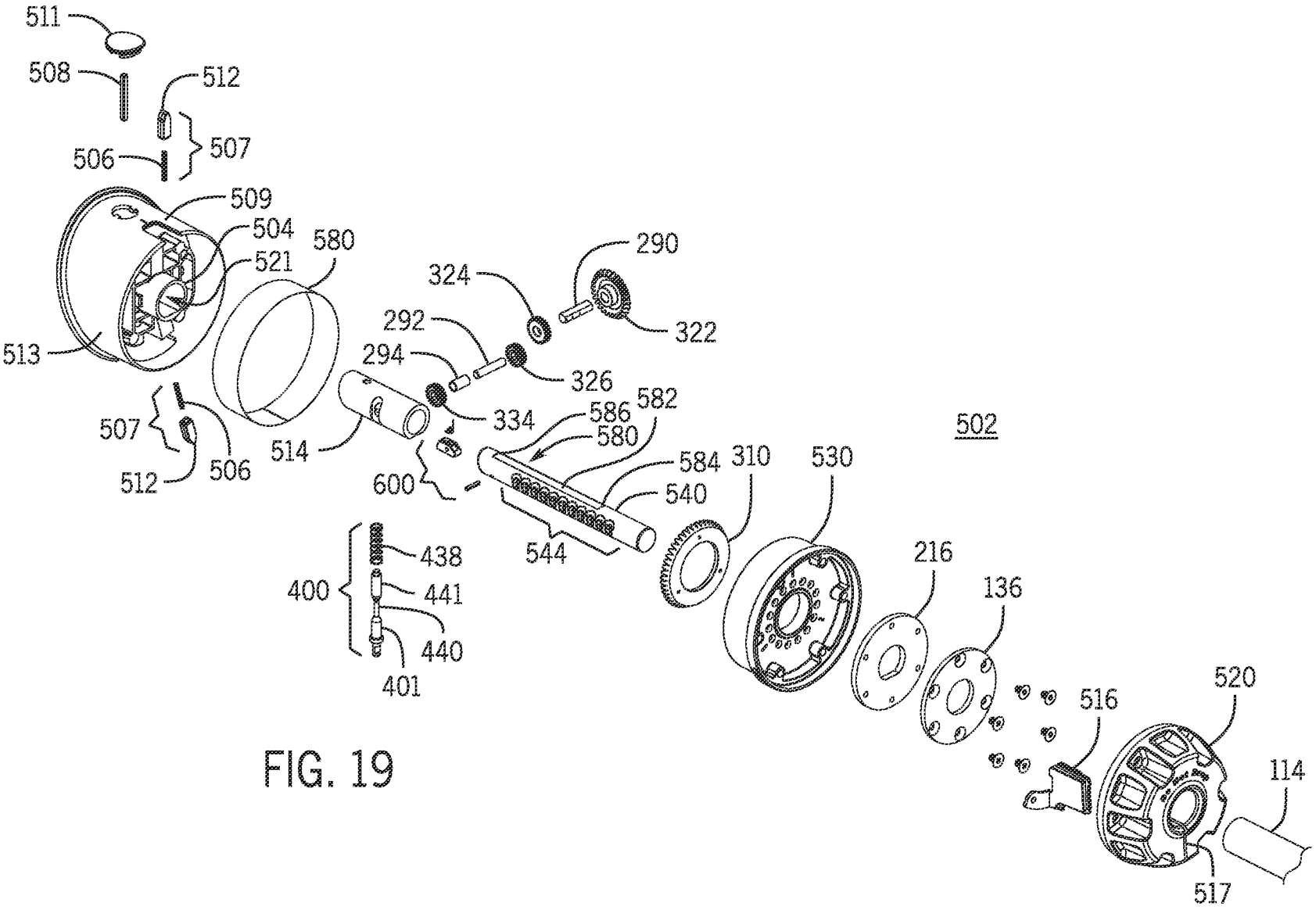
FIG. 19 shows an exploded view of a weight selector assembly according to the examples of the present disclosure.
Figure 20:
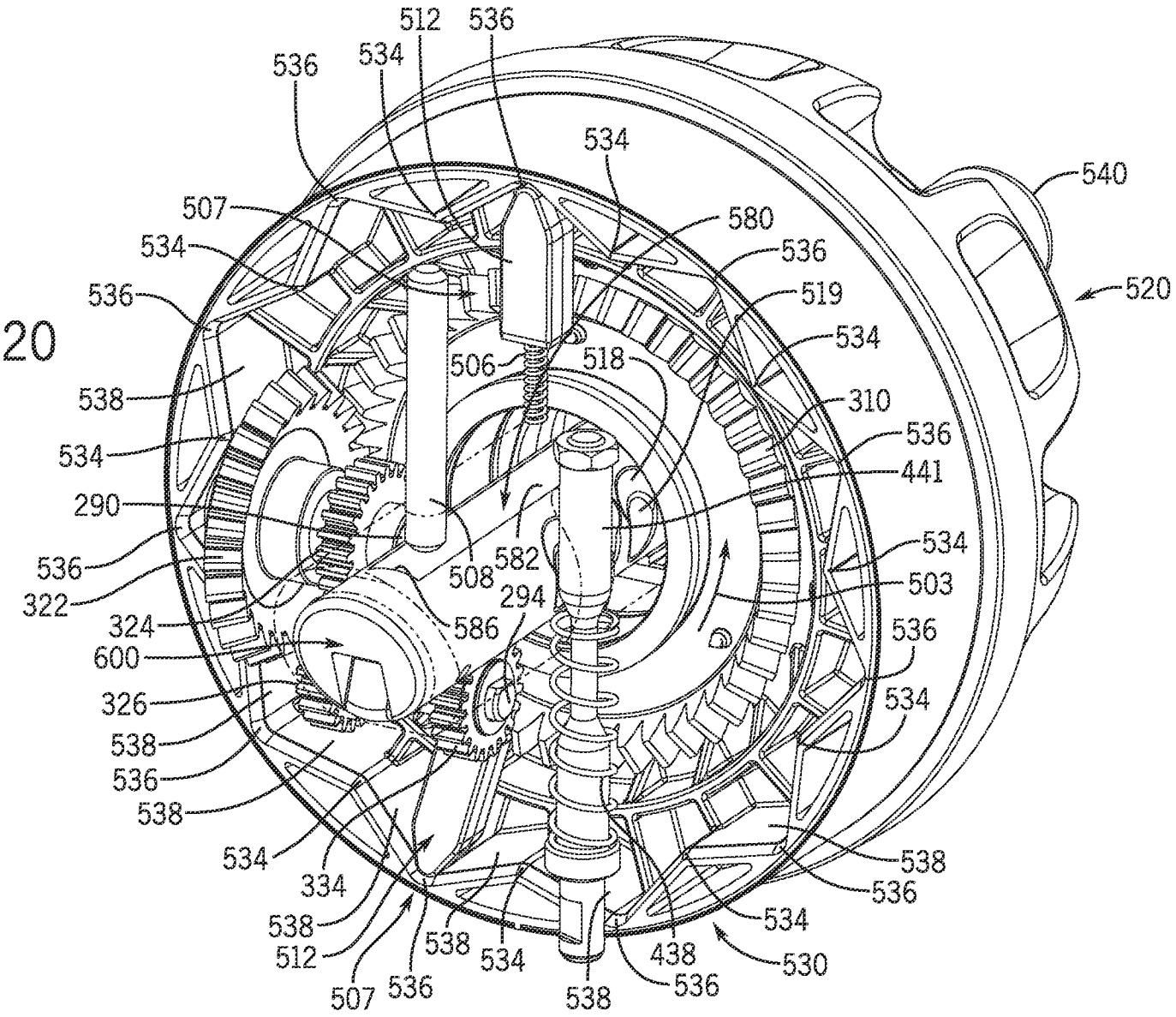
FIG. 20 show an isometric view of a portion of the weight selector assembly of FIG. 19.
Figure 21:
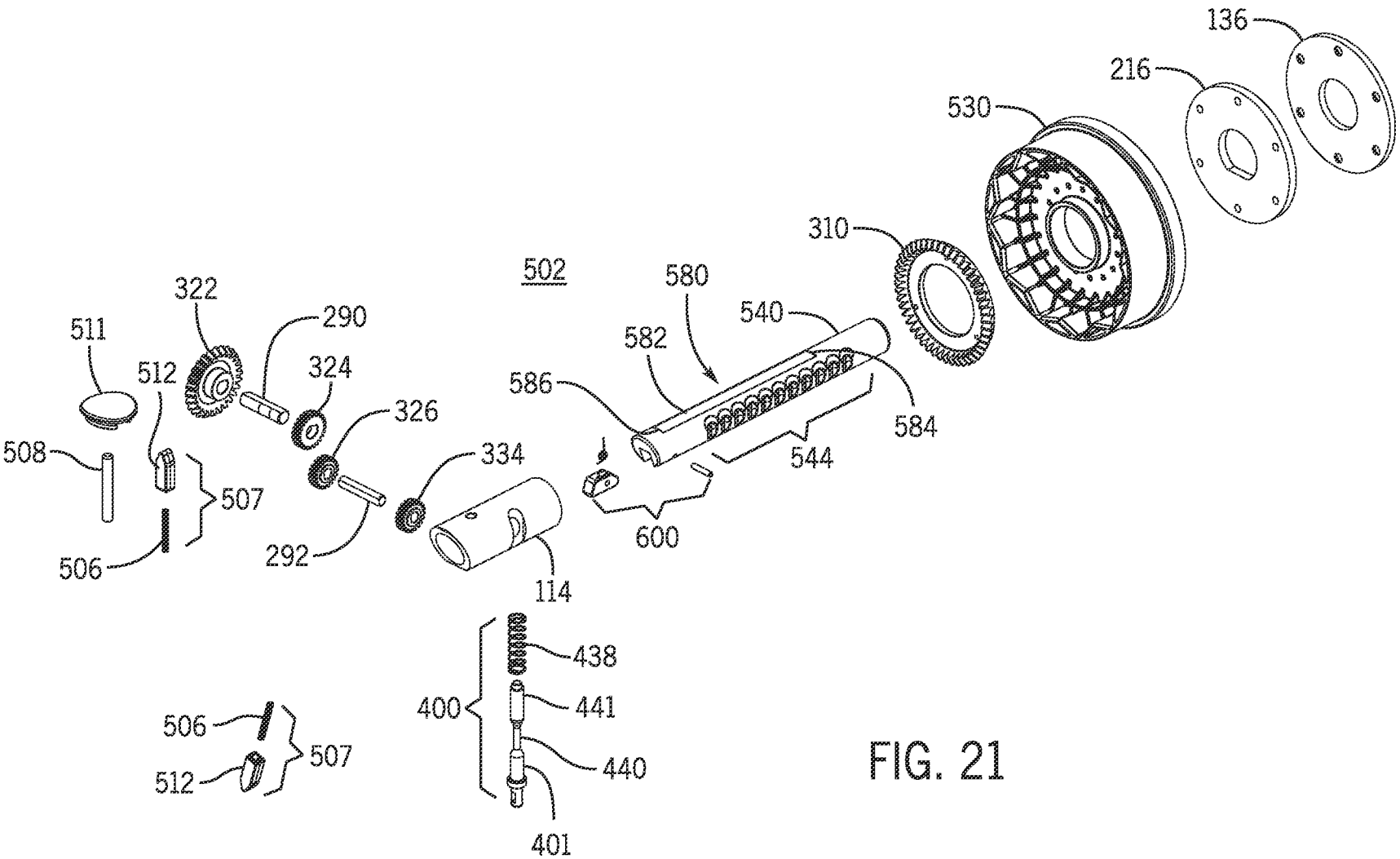
FIG. 21 shows an exploded view of the portion of the weight selector assembly of FIG. 19.
Figure 22:
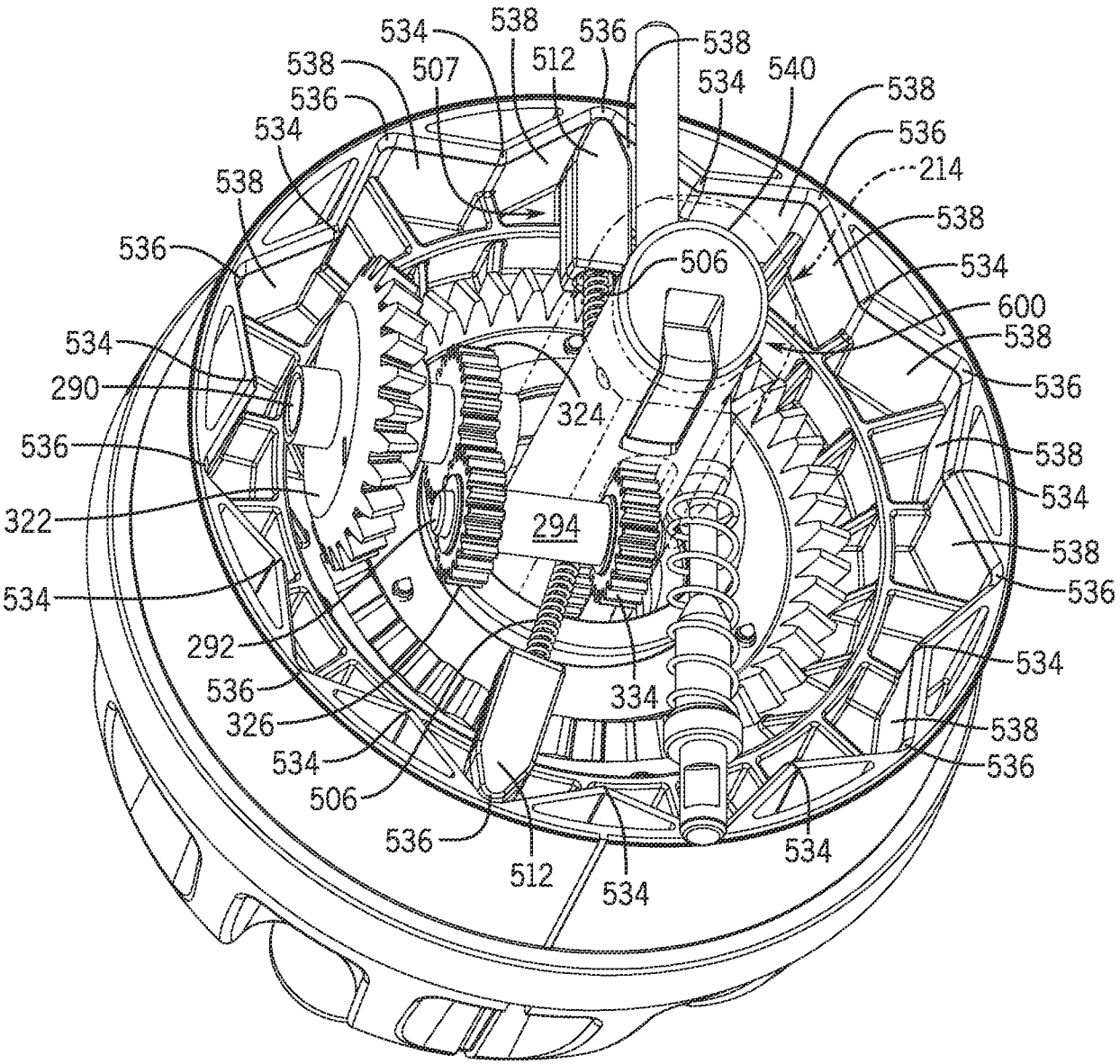
FIG. 22 shows an isometric view of the gear assembly of the weight selector assembly of FIG. 19.
Figure 23A:
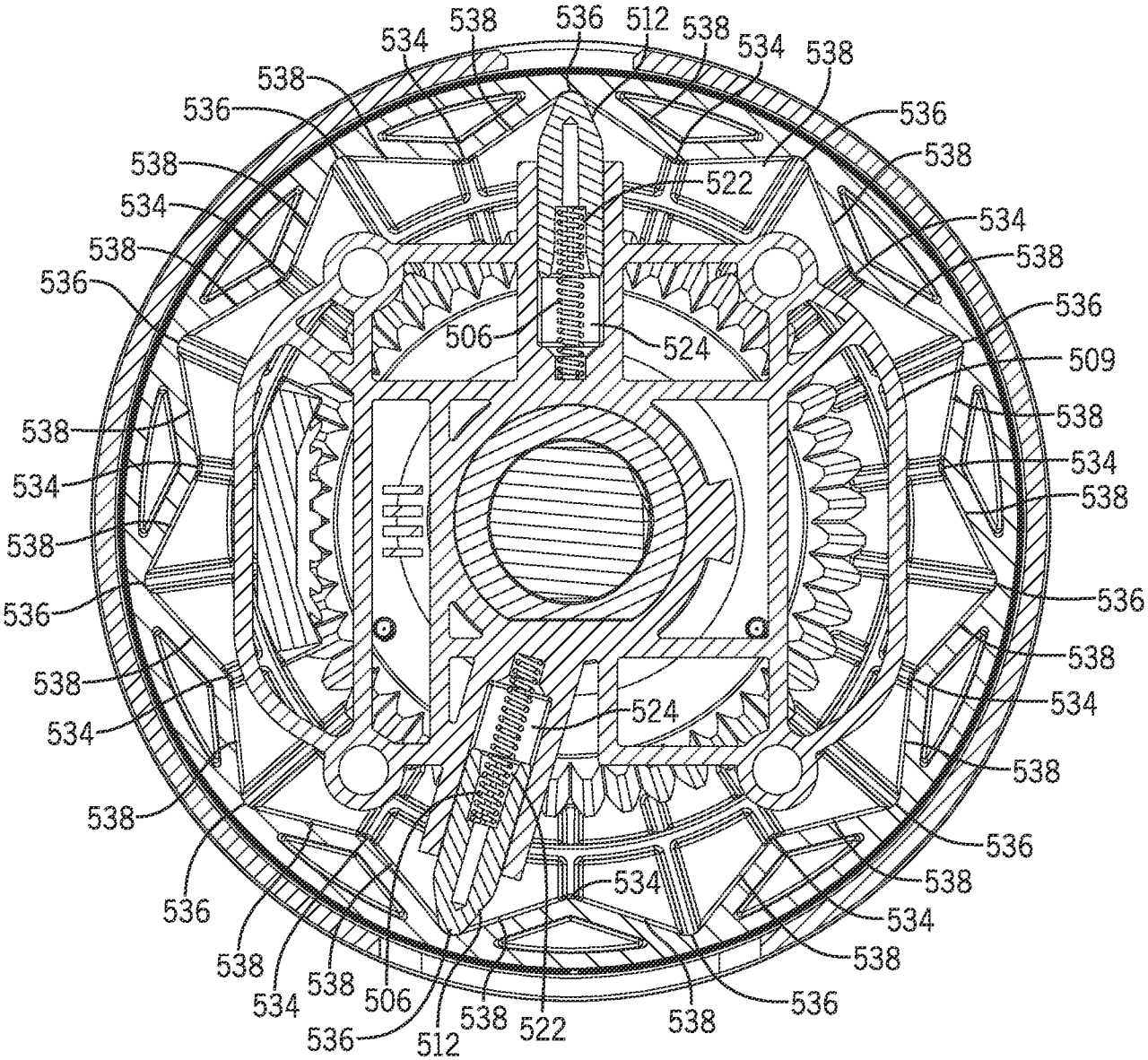
FIGS. 23A and 23B show cross sectional views of a portion of the adjustable barbell of FIG. 17, taken along line 23A-23A of FIG. 18A here illustrating a retention mechanism of the barbell, which prevents a selector ring of the weight selector assembly from remaining in a rotational position between weight settings, thus preventing removal of the barbell from the base until the selector ring is provided in a rotational position corresponding to a weight setting, as shown in FIG. 18B.
Figure 23B:
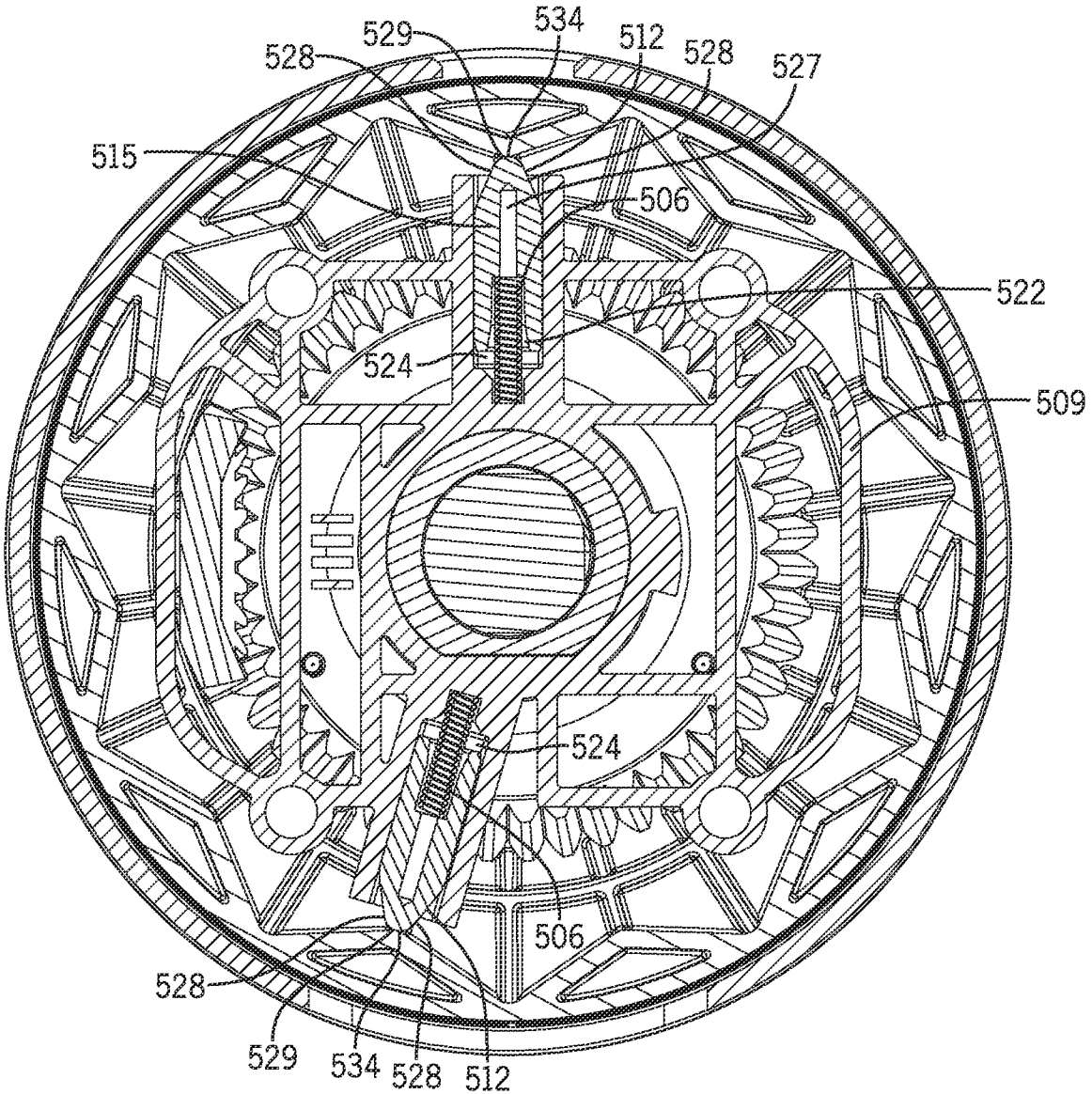

Referring now also to FIGS. 19 and 21, the selector assembly 502 includes a selector housing 509, which encloses certain internal components of the selector assembly 502 (e.g., the gear assembly 300), so as to shield these components from view and/or protect the user's hand when operating the knob. The selector housing 509, which may be manufactured from any suitable rigid material such as a rigid plastic, metal, or composite, may have a generally cylindrical outer wall 513 and an internal structure that supports the internal components of the selector assembly 502. The selector housing 509 may include a collar 504 defining a passage 521 configured to allow the rod 540 to pass through the housing 509 and into the selection apertures 160 of the weights 117. The rod 540 may be operatively coupled to the housing 509 via a tubular insert 514, which may be made from metal or other suitable rigid material, or the features of the tubular insert 514 may be integrated into the collar 504. When using an insert 514, the insert may be fixed to the housing 509, such as by the passage of the passage of an axial limiter pin 508 through a suitably sized transverse opening in the insert 514. The axial limiter pin 508 can be a pin, screw, bolt, key, spring pin, dowel, shaft or other suitable structure that extends generally transverse to the insert 514 and selector rod 540. The axial limiter pin 508 may pass through an aperture in the housing 509 and a corresponding aperture in the insert 514 such that the axial limiter pin 508 resists shear forces applied to it that would tend to move the insert 514 and housing 509 relative to one another, either longitudinally, or rotationally. In some embodiments, the selector rod 540 includes a recessed upper face 582 that defines an extension limiting slot 580 with a distal end 586 and a proximal end 584. The extension limiting slot 580 may extend longitudinally along a portion of the rod 540 between the distal end 586 and the proximal end 584. The extension limiting slot 580 may allow for a clearance between the axial limiter 508 and the selector rod 540, so that the selector rod 540 can freely extend and retract into the selector assembly 502. Respective distal and proximal ends 584, 586 of the extension limiting slot 580 may interfere with the axial limiter pin 508, inhibiting over-extension or over-retraction of the selector rod 540, and prevent the selector assembly 502 from becoming jammed, for instance if a user were to extend the selector rod 540 until the pinon 334 was at an end of the rack 336. The insert 514 may be fixed to the housing 509, additionally or alternatively, by being press fit, fasted or welded to the collar 504 or using any other suitable technique. The tubular insert 514, if used, or free end of the collar 504, if no insert is used, may be provided with a flange 216, which may be used for rigidly coupling the bar 114 to the housing such as by fastening a flange 136 coupled (e.g., welded) to the end of the bar 114 to the flange 216 of the insert 514. The flange 216 of the insert 514 and/or the flange 136 of the bar 114 may be accommodated within a cavity on the proximal side of the selector ring 530. The insert 514 may be rotatably received through a central passage of the selector ring 530 such that a distal end of the insert 514 may extend into the collar 504 for coupling the insert 514 to the housing 509.

The selector knob 520 and selector ring 530 are rotatably coupled to the housing 509 to enable the selective coupling of weights 117 to the bar 114 through extension of the selector rod 540 into and retraction of the selector rod 540 from the axial passage defined by the aligned selection apertures 160 of plates 117 when positioned in the base 122. The selector knob 520 is configured to be manipulated (e.g., manually rotated) by a user and may thus include traction features, such as divots sized to receive a user's finger or other recessed or protruding features configured to improve the user's ability to grip and manipulate the knob 520. The knob 520 may be fixed (e.g., fastened) to the selector ring 530 such that the selector ring 530 rotates in unison with the knob 520. For instance, as shown in FIG. 19, a flange 516 may be anchored to the selector ring 530, and may be adapted to be received in a slot 525 formed within the knob 520 The slot 525 may be formed in the knob 520 to allow the knob 520 to be assembled over the bar 114. For instance, if the knob 520 is made of a resilient material like plastic, the slot 525 may allow the knob 520 to be snapped over the bar 114. The interface between the internal faces of the slot 525 and the flange 516 may help transmit torque between the knob 520 and the slot 525. The flange 516 may also stabilize the knob 520 and fill the slot 525. In some embodiments, at least a portion of the selector ring 530 may be integrally formed with at least a portion of the knob 520. The selector ring 530 may transfer the rotation of the knob 520 to a transmission assembly such as the gear assembly 300, which was described above e.g., with reference to FIGS. 10-13. The selector rod 540 may be implemented and function similarly to the selector rod 240, and thus, for succinctness, its description will not be repeated in its entirety. The selector rod 540, which need not be cylindrical in shape, may be configured to be received within the bar 114. The adjustable barbell 510 may be locked (e.g., preventing weight adjustments) when the barbell 510 is off the base 522. The barbell 510 may be equipped with a locking mechanism, like the locking mechanism 400 described previously with respect to the adjustable barbell 110. The selector rod 540 may include one or more divots 544 or other suitable surface features adapted to receive a locking pin 401 of the locking mechanism 400 for preventing rotation of the selector knob 520, and thus locking the selector assembly 502, when the barbell 510 is removed from the base 522. The divots 544 may have tapered openings 545 (see, e.g., FIG. 20) that receive a corresponding portion of the locking pin 401, such as a transition section between the wider portion 441 and the neck 440. As previously described, when the locking pin 401 is operatively seated in a divot, such as one of the divots 544, the selector rod (e.g., rod 540) is prevented from moving in the axial direction and thus weight setting adjustments are inhibited when the barbell 510 is not seated in the base 522. Conversely, when the locking pin 401 is transversely displaced out of a divot, such as by placement of the barbell 510 on the base 522 which moves the pin 401 out of the divot 544, the selector rod 540 is able to move in the axial direction for changing the weight setting of the barbell 510.

With reference now also to FIGS. 20, 22, 23A, and 23B, the adjustable barbell 510 may include a detent assembly 505 that urges the selector knob 520 toward one of the predetermined rotational positions that correspond to discrete weight settings. The detent assembly 505 may thus substantially prevent the selector knob 520 from being placed in a rotational position between weight settings, which may reduce the risk of improper or incomplete coupling of weights 117 to the bar 114. The detent assembly 505 may be implemented using an over-center mechanism 531, the unstable positions of which correspond to rotational positions of the knob 520 between weight settings. The over-center mechanism 531 may be implemented using a contoured surface or cam 517. The cam 517 includes one or more raised surfaces 518 (e.g., hills 528) interspersed or delineated by depressions or detents 527 (e.g., troughs 536). The raised surfaces 518 of the cam 517 correspond to the unstable positions of the over-center mechanism 531, while the depressions or detents 527 of the cam 517 corresponds to the stable position of the over-center mechanism 531. Each raised surface 518 may be provided by a hill 528 having generally straight sloping sides 538 that meet at a peak 534 and terminate at a trough 536. In some embodiments, at least a portion of a side 538 may be curved between the peak 534 and the trough 536. A cam follower 507 (e.g., plunger 512) engages the cam 517. For example, the cam follower 507 may be biased into engagement (e.g., contact) with the cam 517 using a biasing element 506 that urges the cam follower 507 toward the cam 517.

The cam 517 may be provided by a suitably shaped inner surface of an annular structure (e.g., the selector ring 530) of the selector assembly 502. For example, the inner surface of the selector ring 530 may be shaped to include a radial array of hills 528 with their peaks 534 facing the longitudinal axis of the bar 114, and troughs 536 interspersed between adjacent hills 528. The raised surfaces 518 (e.g., the hills 528) may span the angular segments of the inner surface of the selector ring 530 between the selectable rotational positions of the selector knob 520 (e.g., between discrete weight settings), while each detent 519 is located, along the inner surface of the ring 530, at a radial position that corresponds to a discrete selectable rotational position of the selector knob 520 (e.g., any one of the predetermined weight settings of the barbell 510). The cam follower 507 may include a plunger 512 biased toward the cam 517 by a biasing element or spring 506. The plunger 512 may be a substantially rigid elongate body 515 arranged transversely to the longitudinal axis of the bar 114 (e.g., transversely to the selector rod 540). The engagement end 529 of the cam follower 507 (e.g., plunger 512) may be tapered to a size, which may be narrower than the rest of the body 515, such that the engagement end 529 can engage (e.g., be received within) any of the detents 527 (e.g., troughs 536). The biasing element 506 biases the plunger 512 radially outward from the longitudinal axis of the bar 114. The biasing element 506 engages the body 515 in any suitable way to press or urge the plunger 512 radially outward toward the cam 517. For example, the biasing element 506 may be inserted into and rest against any suitable inner surface of the body 515 (see e.g., FIGS. 23A and B) to apply a spring force in the radial direction. In other embodiments, the biasing element 506 may be sleeved over a protrusion extending from the end of the body 515 opposite the engagement end 529 such that the biasing element 506 can apply a spring force in the radial direction. Any suitable arrangement may be used to urge the cam follower 507 (e.g., plunger 512) toward the cam 517.

The cam follower 507 (e.g., plunger 512) is non-rotatably coupled to the selector housing 509 (see e.g., FIG. 19) such that the cam follower(s) 507 remain in a fixed radial position with respect to the bar 114 and respective selector rod 540 while being free to move toward and away from the bar 114 and rod 540 under the forces of the spring 506 and cam 517 as the selector knob 520 is rotated. For example, the cam follower 507 (e.g., plunger 512) may be movably received within a pocket or receptacle 524 attached to or integrally formed as part of the housing 509. As the cam follower 507 follows the shaped surface of the cam 517 (e.g., the plunger 512 travels over peaks 534 and trough 536), the cam follower 507 (e.g., plunger 512) moves into and out of the receptacle 524 (see FIGS. 23A and 23B) as shown by arrow 539. In some embodiments, a plurality of cam followers 507 may be used, which may provide a greater amount of force against the cam 517 to cause the cam 517 to rotate to a stable position when the knob 520 is released. The cam followers 507 may be positioned at two different radial locations of the selector housing 509, e.g., at two non-diametrically opposite radial locations. In some embodiments, first and second cam followers 507 may be disposed at diametrically opposite radial locations and optionally one or more additional cam followers may be provided at radial locations between the diametrically opposite radial locations.

In use, manual rotation of the selector knob 520 (e.g., by the user) rotates the selector ring 530, which causes the cam 517 (e.g., the shaped inner surface of the selector ring 530) to rotate relative to the selector housing 509 and, thus, to the one or more cam followers 507, positioning a different portion of the cam 517 in contact with the engagement end 529 of the cam follower(s) 507. As a raised surface 518 (e.g., a hill 528) passes into contact with a plunger 512, the plunger is forced radially inward by the raised surface 518, compressing the plunger(s) 512 against the force of the biasing element(s) 506. If manual rotation of the selector knob 520 is terminated before the one or more cam followers 507 are aligned with a stable position (e.g., with a detent 527) of the over-center mechanism 531, the over-center mechanism 531 automatically adjusts to a stable position, e.g., by the compressed plunger 512 acting against a side 538 of a raised surface 518 to force the cam 517 to a rotational position in which the cam follower 507 is seated in a detent 527. When seated in a stable position (e.g., a detent), the cam follower 507 resists free rotation or free play of the knob 520 until the knob 520 is manually rotated by the user for adjusting the weight of the barbell. If the knob 520 is released when the plunger 512 is aligned with a peak 534, which is an unstable configuration, the over-center mechanism (e.g., the stored energy in the spring 506) may urge the cam 517 toward either one of the stable positions on opposite sides of the peak, thus rotating the selector ring 530 toward selectable rotational position of the knob 520 (e.g., a discrete weight setting). Thus, upon the user releasing a selector knob 520, and thus before the barbell 510 is removed from the base 522, the selector assembly 502 of the barbell 510 automatically adjusts to a permitted rotational position (e.g., a discrete weight setting) avoiding a situation in which the barbell 510 is removed from the base 522 with an incomplete or improper coupling of weight plates 117 (e.g., due to incomplete extension of the rod 540 through a selection aperture of a weight plate 117).

Figure 26A:
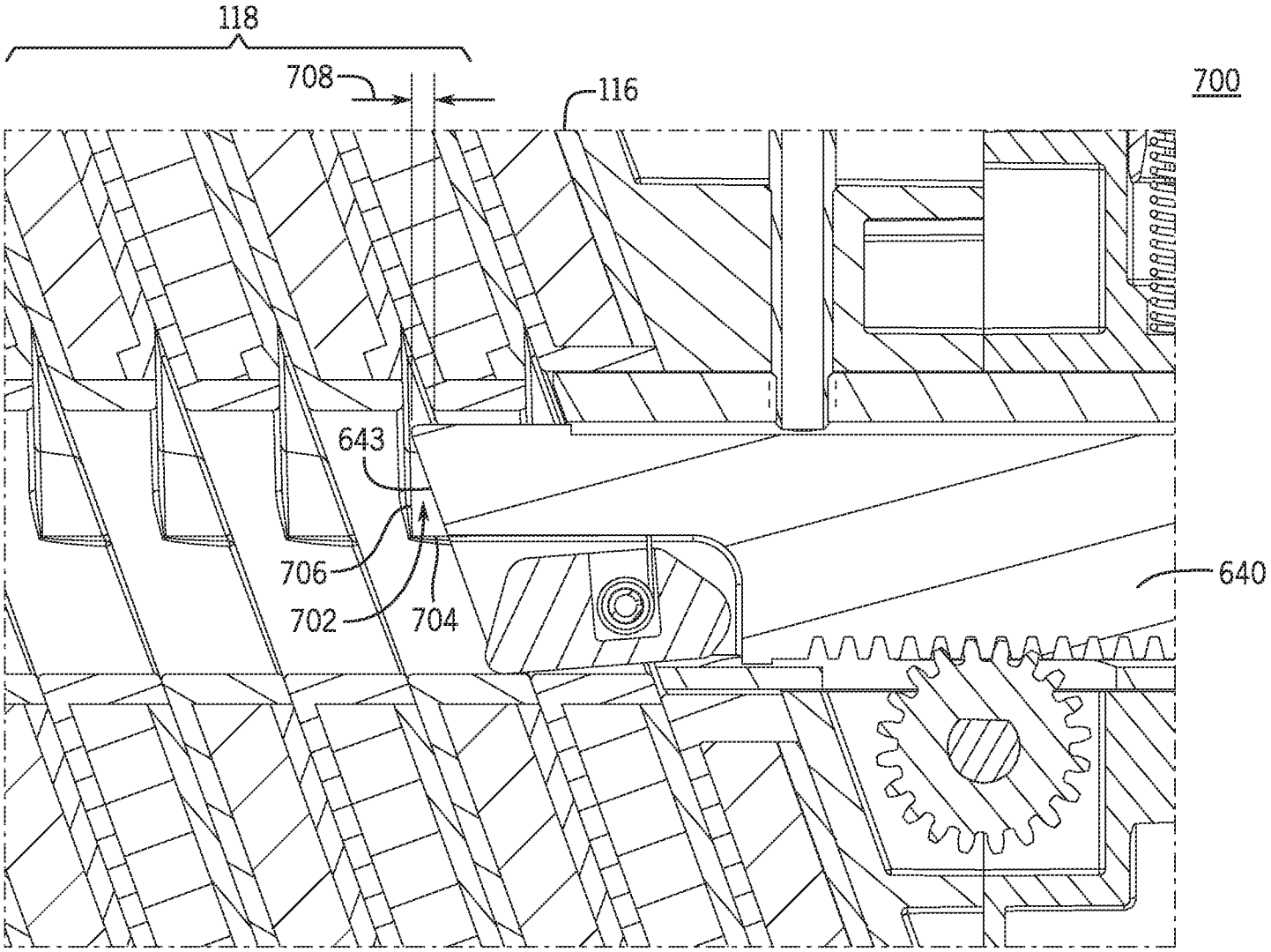
FIG. 26A shows the same view shown in FIG. 18A, illustrating relief features near the selection apertures of an example weight plate.
Figure 26C:
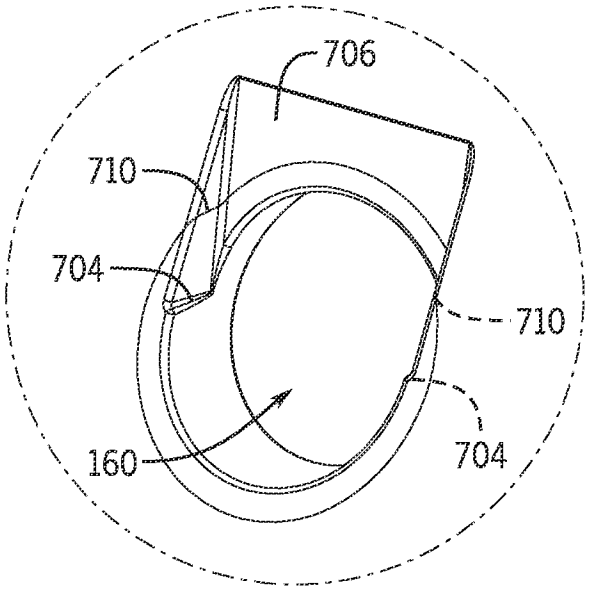
FIG. 26C is a detailed isometric view of the relief features near the selection aperture of the weight plate of FIG. 26A.
Figure 26B:
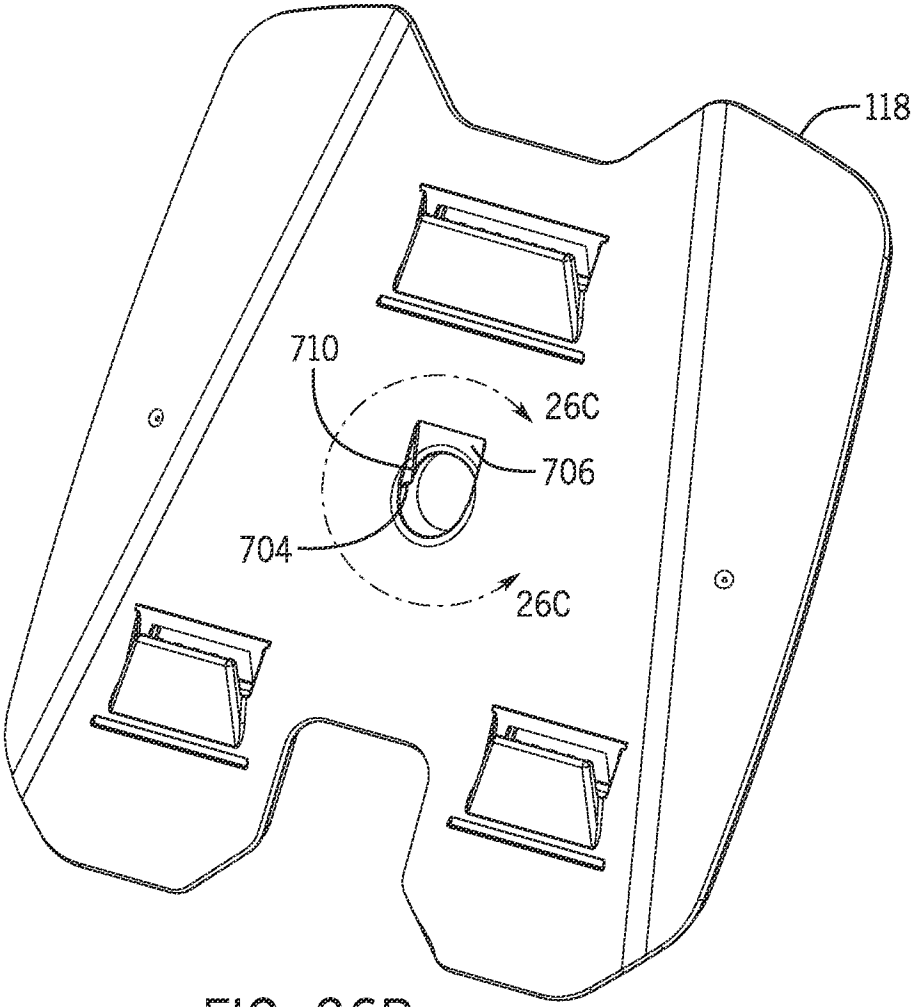
FIG. 26B is an isometric view of the example of a weight of FIG. 26A.

Referring now also to FIGS. 26A-26C, the individual weights (e.g., plates 118) may be configured such that when the plates are interlocked, the selector rod 540 may be extended an additional distance 708 beyond the distal face of one weight plate 118 without selecting the next (distally adjacent) weight plate 118. For example, a weight 118 may include a relief feature 703 on the proximal major face (e.g., first face 171) adjacent to the selection aperture 160 (e.g., as shown in FIG. 26B). The relief feature 703 may be defined by a cutout extending generally vertically from the selection aperture 160 and extending in the axial direction, into the thickness of the weight 118. The cutout 704 may be defined by a vertical wall 706 and two lateral walls 710, extending from the major face (e.g., face 171) into the thickness of the plate 118. The relief feature 703 defines a generally L-shaped pocket 702 that can receive a portion of the distal end 643 of the selector rod 640 (see FIG. 26A).

The relief features 703 allow further extension of a selector rod 640 past a first (selected) weight 118 an additional distance 708 without causing the selector rod 540 to engage the next (non-selected) distal weight 118. The distal end 643 of the selector rod 640 being received in the pocket 702 allows the user to remove the adjustable barbell from the base, allowing the distal end to clear the next distal (non-selected) weight 118. Extending the selector rod 540 slightly beyond the distal face of the last selected weight 118 in a given weight configuration of the barbell 510 may prevent the last selected weight 118 from accidentally unintentionally disengaging from the end of the adjustable barbell 110, e.g., in situation in which the barbell is dropped or otherwise placed on the ground more forcefully. In some embodiments, the relief feature 703 may accommodate an extension of the rod 540 by an additional distance 708 of up to about 10 mm, in some cases up to about 5 mm, or up to about 3 mm. While the extension prevention mechanism 600 and the relief feature 703 are described here with reference to the adjustable barbell 510, these features may be included in other embodiments of an adjustable barbell according to the present disclosure, e.g., in the adjustable barbell 110.

FIGS. 27 through 33B show another example of a locking mechanism 804 for use with a selectable weight exercise device, such as in one example an adjustable barbell systems 100 or 500 as described above. The lock mechanism 804 may be incorporated into use on a selectable weight exercise device in the form of a dumbbell.

As with the previously described locking mechanisms, the lock mechanism 804, as shown in FIGS. 27-33B may be configured to be in a locked configuration preventing weight adjustments when the barbell is removed from the base 782, and in an unlocked configuration allowing weight adjustment when the barbell is positioned on the base 782. The locking mechanism 804 may include a lock lever 806 and a locking pin 808 on the barbell that cooperates with an actuating member (e.g., lock disengagement pin 812) positioned on the base 782.

Figure 27:
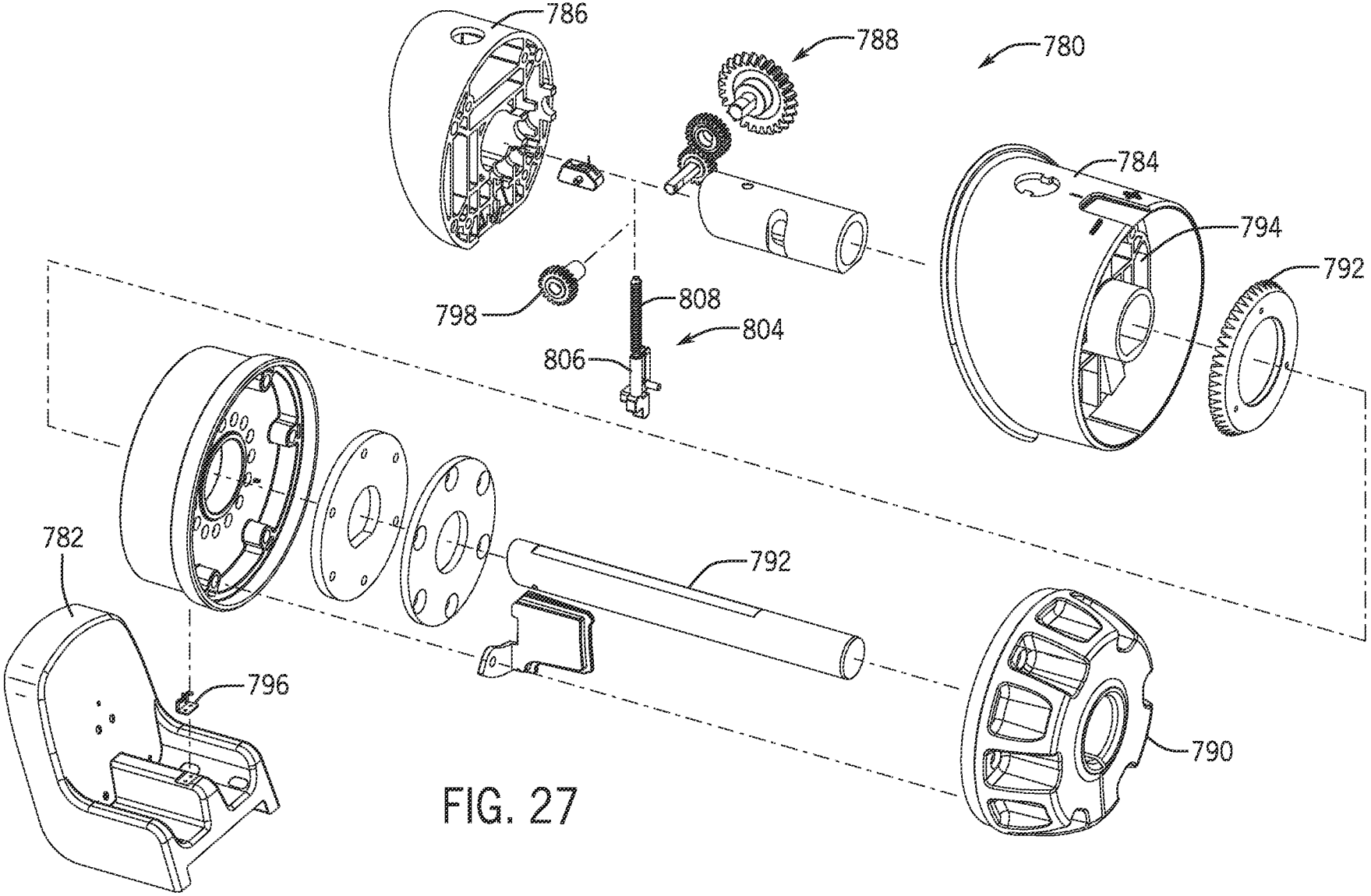
FIG. 27 is a partial exploded view of a selectable weight exercise device, such as a barbell, including the lock mechanism of another example.
Figure 28:
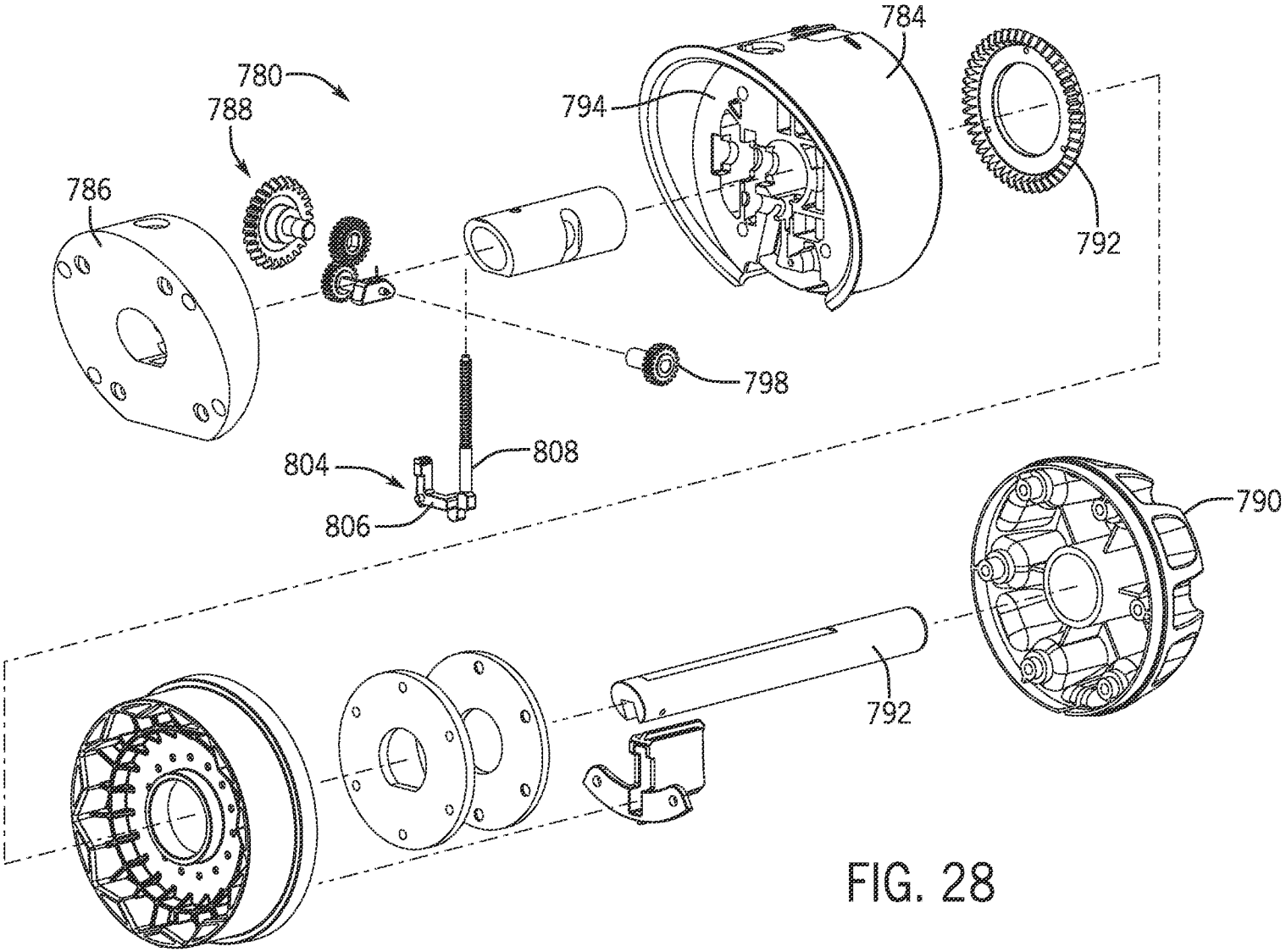
FIG. 28 is a partial exploded view similar to FIG. 27 of a selectable weight exercise device from a reverse angle.
Figure 29A:
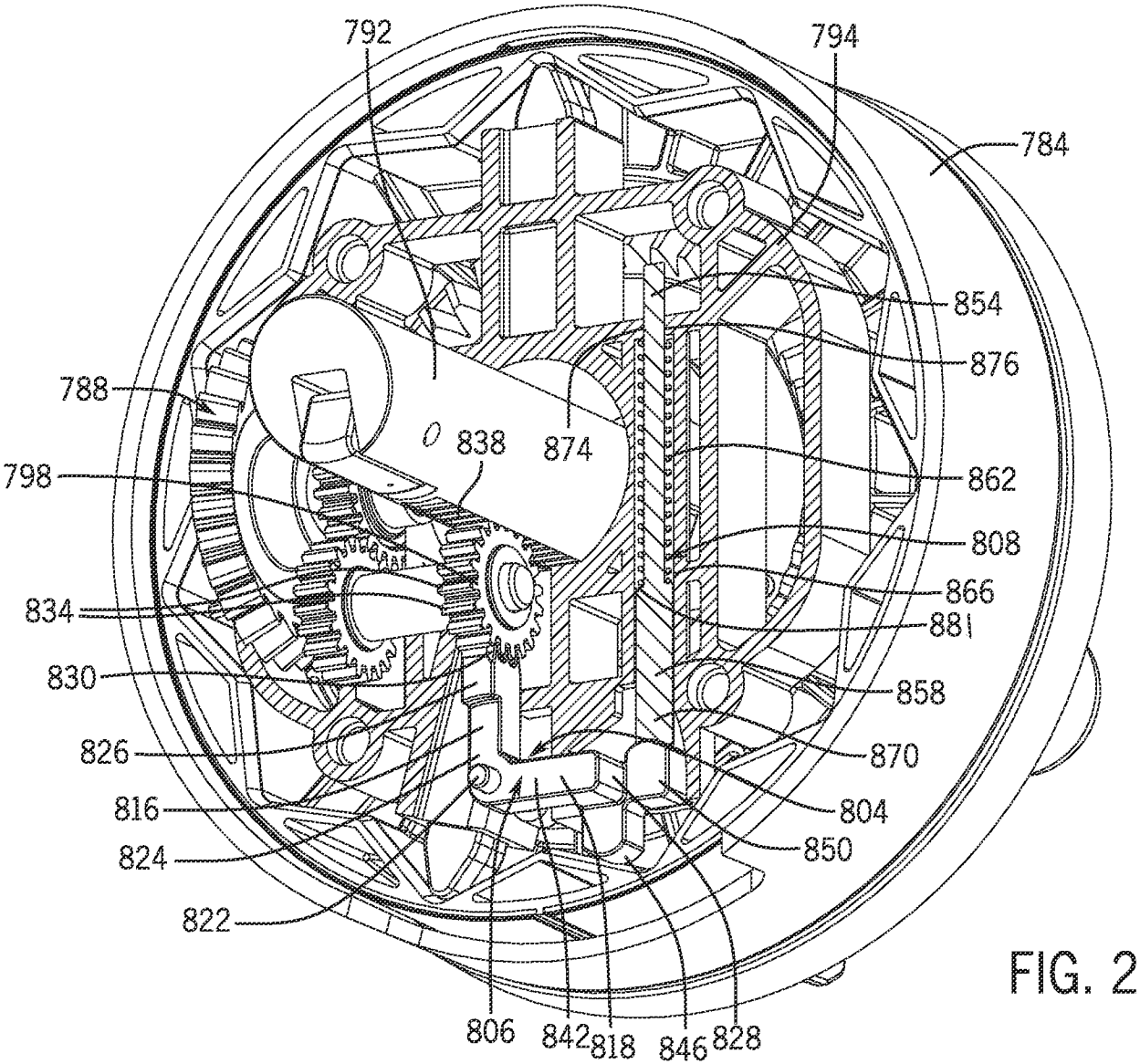
FIG. 29A is an isometric view with a partial section of a weight selector assembly including the lock mechanism of this example.
Figure 29B:
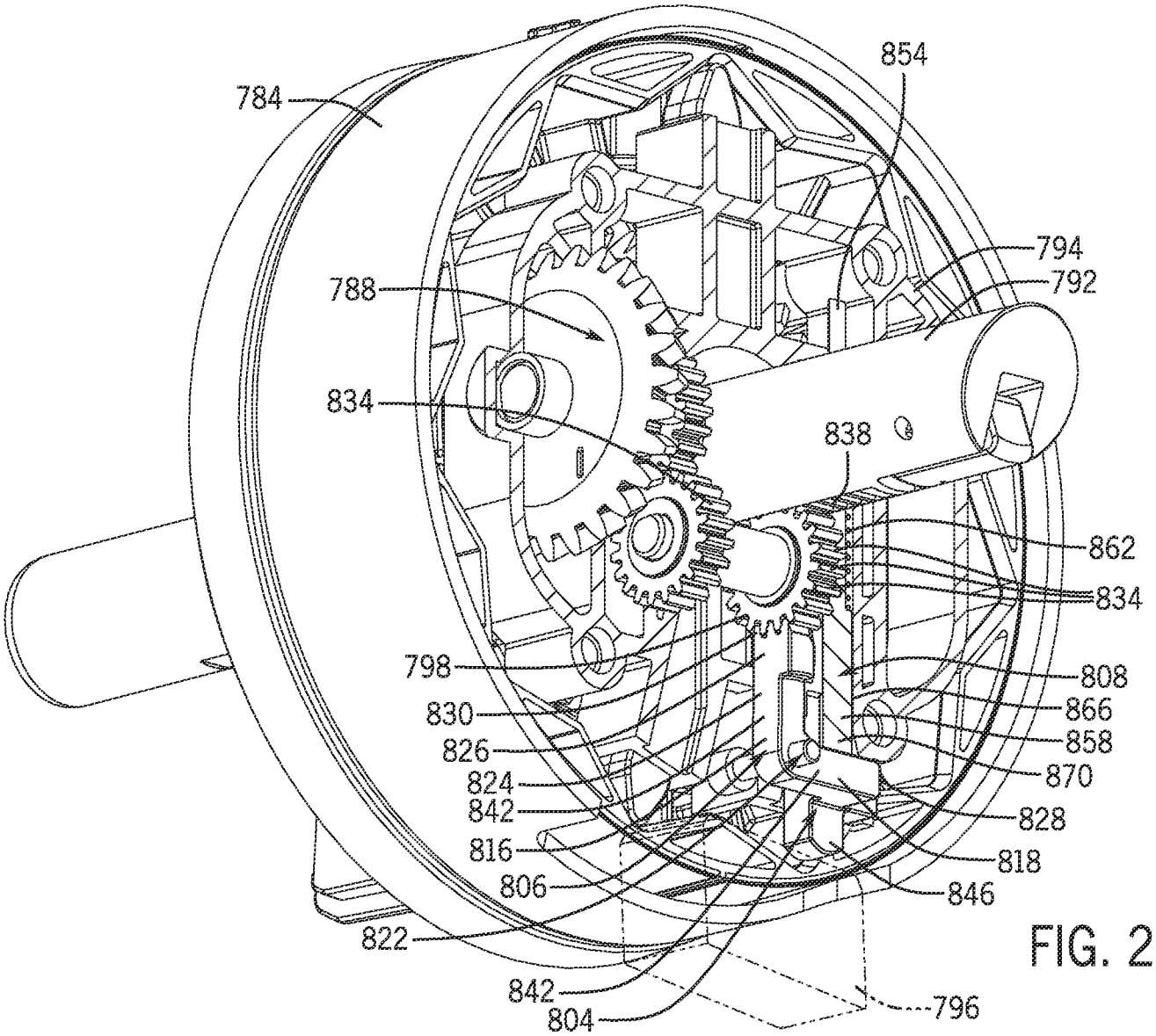
FIG. 29B is an isometric view with a partial section of a weight selector assembly including the lock mechanism of this example.
Figure 30A:
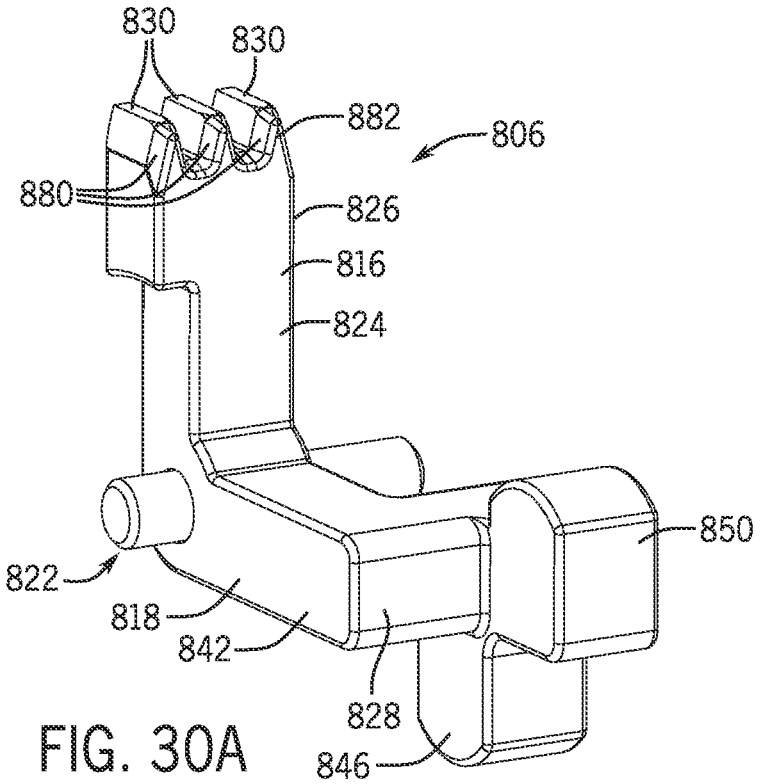
FIG. 30A is an enlarged isometric view of a lock lever of this example.
Figure 30B:
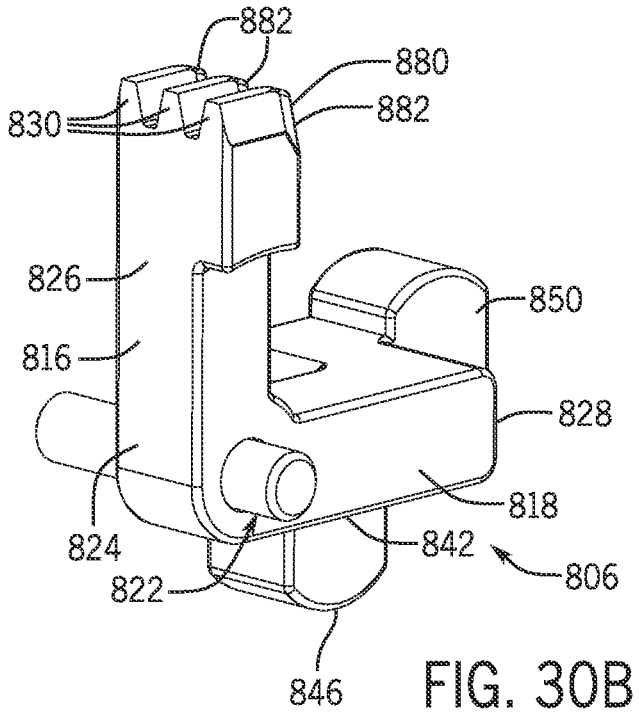
FIG. 30B is an enlarged isometric view of a lock lever of this example.

FIGS. 27 and 28 show a partial exploded view of an example of the barbell assembly 100 or 500 implementing the locking mechanism described in FIGS. 27 to 33B. The barbell assembly includes a weight selector assembly 780, and may include a base 782. The weight selection assembly 780 may be similar to or the same as weight selector 300 as described above, except where optional distinctions are made with respect to the locking mechanism. The weight selector assembly 780 may include a selector housing 784 having a central wall 794 and an inner housing 786, a gear assembly 788 including a plurality of gears, at least one of which is a pinion gear 798. The weight selection assembly 780, as described above with respect to the other examples, are operably associated with a knob 790 and a bevel gear 778 to cause the rod 792 to move in the direction of its length to select or de-select weights (such as those shown elsewhere). A lock mechanism 804 is operably configured to interact with the weight selection assembly 780 to prevent or allow the movement of the rod 792 to select weights. The lock mechanism 804 may include a lock lever 806 and a locking pin 808. The barbell assembly may be positioned in a base 782 in order to select a designed number of weights. The lock mechanism 804 may be configured to interact with the base 782 to actuate the lock mechanism 804 to disengage from the weight selection assembly to allow the rod 792 to be moved to select the desired number of weights. The base 792 may include an actuation member 796 that may be positioned on the base 792 to engage the lock mechanism 804 to allow the weight selection assembly 780 to select a desired number of weights.

With reference to FIGS. 29A, 29B, 30A, 30B, 31A, and 31B, the lock lever 806 may be movably attached to barbell, such as by the selector housing 784, to move between a first configuration, such as in one example a first position, disengaged from the gear assembly 788, such as for example when the barbell is positioned on the base 782 and weight selection is allowed, and a second configuration, such as in one example a second position, in engagement with the gear assembly 788 when the barbell is at least partially removed from the base 782 and weight selection is inhibited. In one example, the lock lever 806 is pivotally attached to the selector housing 784 to pivot between the at least two configurations. In one example, the lock lever 806 is pivotally attached to a central wall 794 of the selector housing 784.

Figure 32:
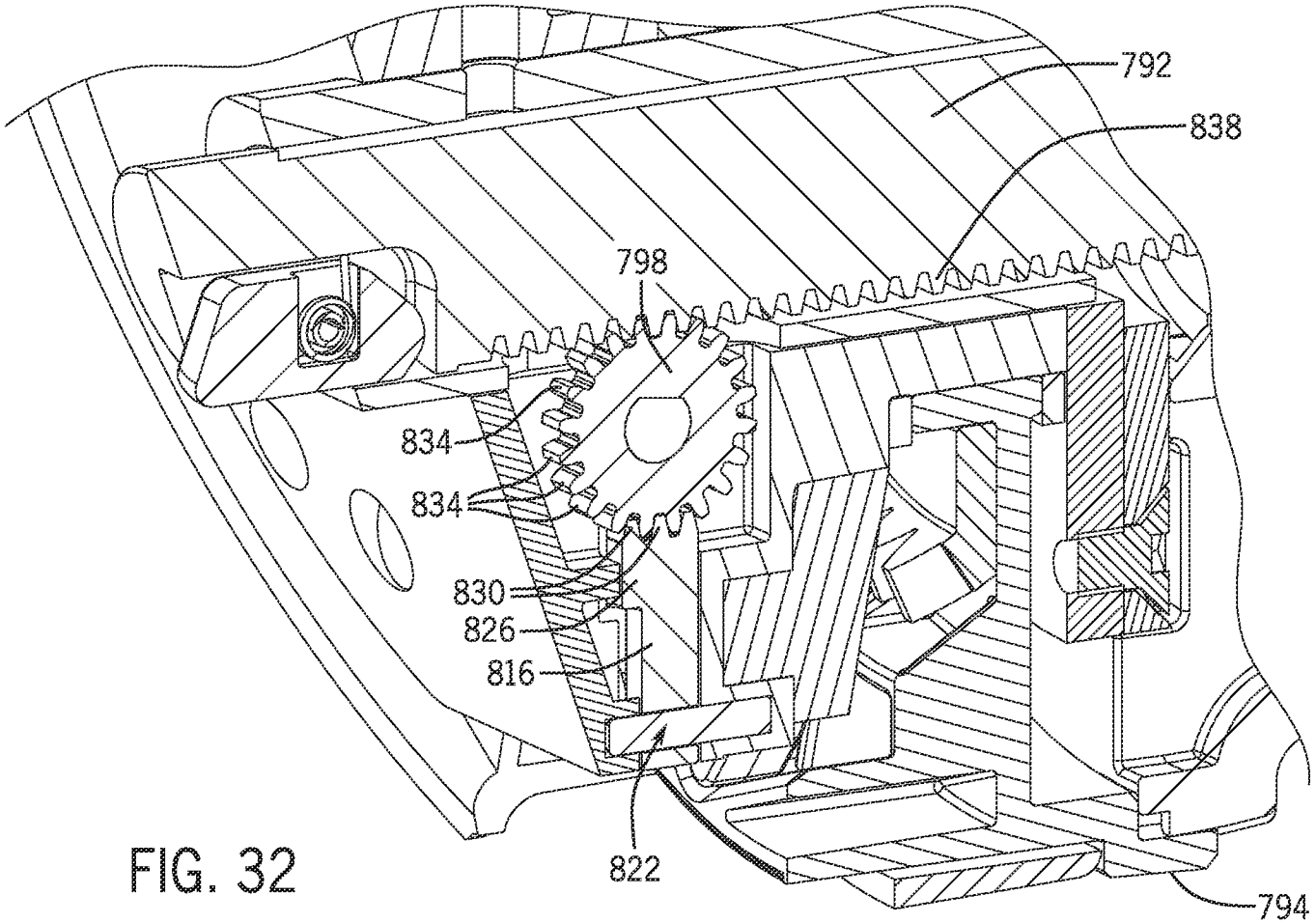
FIG. 32 is a representative section through a weight selector assembly of part of the lock mechanism, including the pivot structure for the lock lever.

The lock lever 806 may include a first portion 816 and a second portion 818. The first portion 816 may be configured to engage the gear assembly 788, and the second portion 818 may be configured to engage the locking pin 808 and/or the disengagement pin 812, as described herein. The first portion 816 and the second portion 818 may form an angle, with a pivot structure 822, such as an axle, positioned at the intersection formed between the first portion 816 and second portion 818. At least part of the first 816 and second 818 portions may lie in a common plane. As shown in FIG. 32, the pivot structure 822 may be supported by the selector housing 784, and in one example may be supported at least in part by the central wall 794 of the selector housing 784, or by the central wall 794 of the selector housing and the inner housing 786. In one example the first portion 816 and the second portion 818 may extend at right angles. In other examples the angle may be less than 90 degrees, or may be more than 90 degrees.

The first portion 816 may include a main member 824 defining a length, and may in one example be substantially linear, although it may be curved, angled, or have another shape. The first portion 816 may have an end portion 826 engageable with the gear assembly 788. The end portion 826 may be in one example may be shaped to at least partially mate with one or more teeth 834 on a gear of the gear assembly 788. In one example, the gear it engages with may be a pinion gear 798. In another example, the end portion 826 may define one or more tapered gear teeth 830 (best seen FIGS. 30A and 30B) to enmesh with the similarly shaped gear teeth 834 of the gear assembly 788. The engagement of the at least one tapered gear tooth 830 of the end portion 826 engages the gear teeth 834 (e.g. is positioned between two gear teeth) on the gear assembly 788 to provide a sufficient interference of the motion of the gear assembly 788. In one example the end portion 826 defines at least three gear teeth 830, which engage or enmesh with four gear teeth 834 on a gear of the gear assembly 788. Three or more gear teeth 830 provide a secure engagement with a gear of the gear assembly 788 to prevent or restrict motion of the gear assembly 788. In one example the end portion 826 engages the pinion gear 788 that engages the rack 838 on the rod 792. In other examples, the lock lever 806, such as by the end portion 826, may engage other gears in the gear assembly 788.

The second portion 818 of the lock lever 806 may have a main member 842 and an end portion 828 including contact features 846, 850 for engaging the disengagement pin 812 and the locking pin 808, respectively. Each of the contact features 846, 850 may extend away from the main member 842 at an angle to form a tab. In one example at least one contact feature 846, 850 extends at a right angle to the main member 842. In one example the contact features 846, 850 may extend in opposite directions from one another. In another example at least one contact feature 846, 850 is off-line from the main member 842. As shown in the example of FIGS. 28A and 28B, both contact features 846, 850 are offset from the main member 842 and extend in opposite directions from each other at different locations along the length of the main member 842. As shown in FIGS. 28A and 28B, a first contact feature 846 extends downwardly from an end portion 828 of the main member 842, and is offset to one side of the main member 842. A second contact feature 850 extends upwardly away from the main member 842, and is offset to the same side of the main member 842 as the first contact feature 846. The contact features 846, 850 may be offset from the common plane formed by the first 816 and second 818 portions so that the contact features 846, 850 may be engaged by the actuation member 792, such as in one example the lock disengagement pin 812, to cause the lock lever 806 to move without the lock disengagement pin 812 interfering with the movement of the lock lever 806. The contact features may not be aligned with one another, as shown, or in another example may be aligned with one another.

FIG. 32 shows the first portion 816 of the lock lever 806 pivotally mounted by pivot structure 822, such as in one example being a pivot axle, and is shown in its first configuration. The end portion 826 of the first portion 816 of the lock lever 806 is shown enmeshed with the pinion gear 788 to inhibit use of the gear assembly 788. The pivot axle about which the lock lever 806 rotates may be supported by the selector housing 784. The selector housing 784 may include an outer housing 784 and an inner housing 786. The inner housing 786 may include a central wall 794 as noted above. The pivot axle in one example may be supported at one end by the central wall 794 of the outer housing, and at another end by the inner housing 786. The pivot axle may be integrally molded with the lock lever 806, or may be separate from the lock lever 806 and attached thereto.

With continued reference to FIGS. 29A, 29B, 31A, and 31B, the locking pin 808 includes a top portion 854, a bottom portion 858, and a biasing member 862. The locking pin 808 may be at least partially positioned in a chamber 866 formed on the central wall 794 of the selector housing 784. A first or lower end 870 of the locking pin 808 may engage the second contact feature 850, or second tab, of the lock lever 806. An opposite or upper end of top portion 854 of the locking pin 808 may be movably received through an opening 874 in the top wall 876 of the chamber 866. The biasing member 862 may be positioned in the chamber 866 and extend between the top wall 876 of the chamber 866 and a shoulder 881 formed on the locking pin 808. In one example the biasing member 862 is a coil spring receiving the locking pin 808, and maintained in compression between the top wall 876 of the chamber 866 and the shoulder 881, resulting in a resilient force biasing the locking pin 808 towards the lock lever 806.

The locking pin 808 is movable between a first configuration and a second configuration. In the first configuration, the biasing member 862 moves the locking pin 808 towards the lock lever 806, with the bottom end 870 engaging the lock lever 806, for example the second contact feature 850 of the lock lever 806, to cause the lock lever 806 to rotate about the pivot axle and move the first portion 816 of the lock lever 806 into engagement with the gear assembly 788 to inhibit the selection of weights. In the second configuration, the bottom end 870 is engaged by the lock lever 806 to compress the biasing member 862 and move the locking pin 808 upwardly. In the second configuration, the lock lever 806 is rotated about the pivot axle such that the first portion 816 of the lock lever 806 is disengaged from the gear assembly 788, allowing the selection of weights. The lock lever 806 may be caused to move in this way by the actuation member 796, as is described below.

With continuing reference to FIGS. 29A, 29B, 31A, and 31B, the actuating member 796 (e.g., lock disengagement pin 812) may be provided in any suitable location or configuration on the base 782 to engage, e.g., actuate, such as by temporarily translating, rotating, or both, a component of the locking mechanism 804 (e.g. the lock lever 806) of the barbell. The base 782 may be similar to or the same as the bases 122 and 522 described herein.

In one example, the actuating member 796 (e.g., lock disengagement pin 812) may be a protruding structure attached to the base 782 at any suitable location on the base 782. In another example, the lock disengagement pin 812 may be arranged at a suitable location on the base 782 (e.g., on the top surface of the base 782) such that it actuates, in this case pushes up, on the lock lever 806.

Figure 31A:
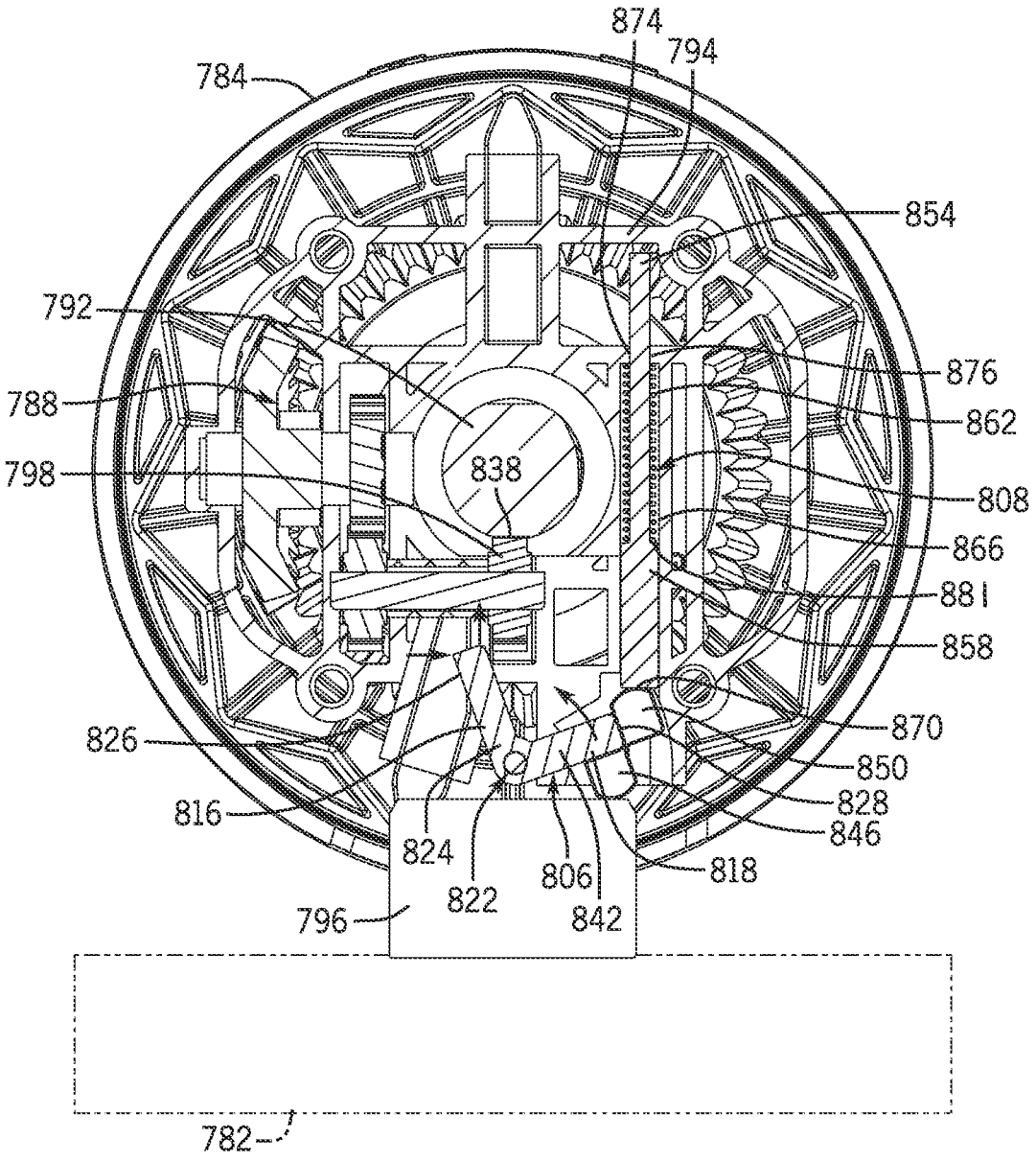
FIG. 31A is a representative section through a weight selector assembly including the lock mechanism of this example in a first configuration.
Figure 33A:
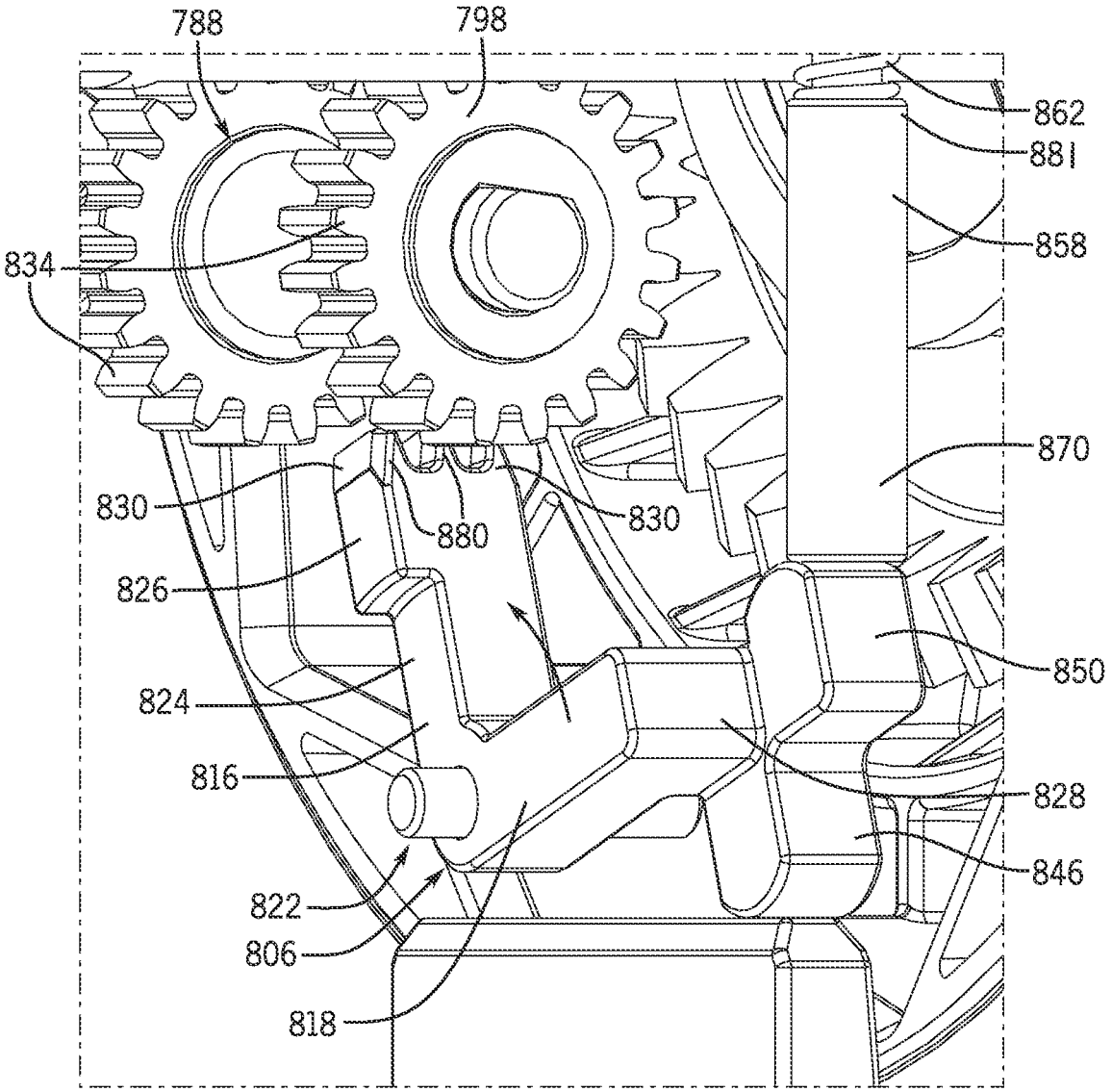
FIG. 33A is a close up isometric view of part of the lock mechanism of this example in a first configuration, similar to that shown in FIG. 31A.

Referring to FIGS. 31A, 31B, 33A and 33B, the operation of the lock mechanism 804 to vary between inhibiting and allowing the movement of the gear assembly 788 is shown and described. Some portions of the barbell structure are not shown for purposes of clarity. FIGS. 31A and 33A each show the lock mechanism 804 in a first configuration, with the barbell resting on the base 782. The base 782 is shown schematically here, but is similar to the barbell resting on the base 782 as at least shown in FIGS. 1-5A, and FIGS. 17 and 18. When positioned in the base 782, the actuation member 796 engages the lock mechanism 804 and maintains it in a first configuration, where the lock mechanism 804 is not engaged with the gear assembly 788, in which the selection assembly is operational to change the number of weights selected for adjusting the load of the barbell. More specifically, the lock disengagement pin 812 may engage the lock lever 806, such as in one example the second portion 818 of the lock lever 806, and in a further example the first contact feature 846 on the lock lever 806, causing the lock lever 806 to pivot about the pivot axle in a counter-clockwise direction so that the end portion 826 is disengaged from the pinion gear 788 of the gear assembly 788. The first contact feature 846 may in one example be the downwardly depending tab defined by the first contact feature 846. The second contact feature 850, such as the upwardly extending tab defined by the second contact feature 850, of the lock lever 806 may engage the first end 870 of the locking pin 808, and when rotated by the lock disengagement pin 812 move the locking pin 808 upwardly, compressing the biasing spring.

Figure 31B:
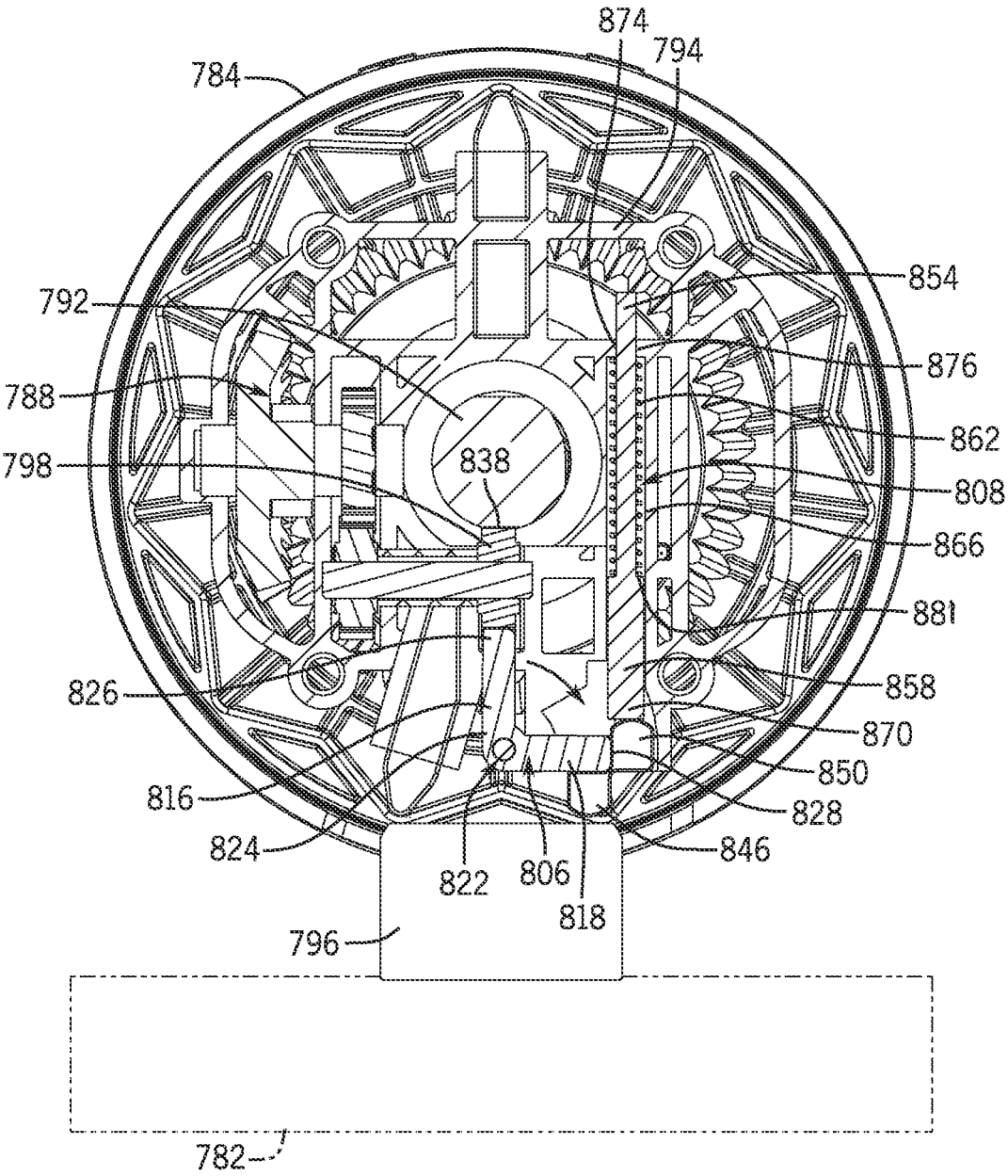
FIG. 31B is a representative section through a weight selector assembly including the lock mechanism of this example in a second configuration.
Figure 33B:
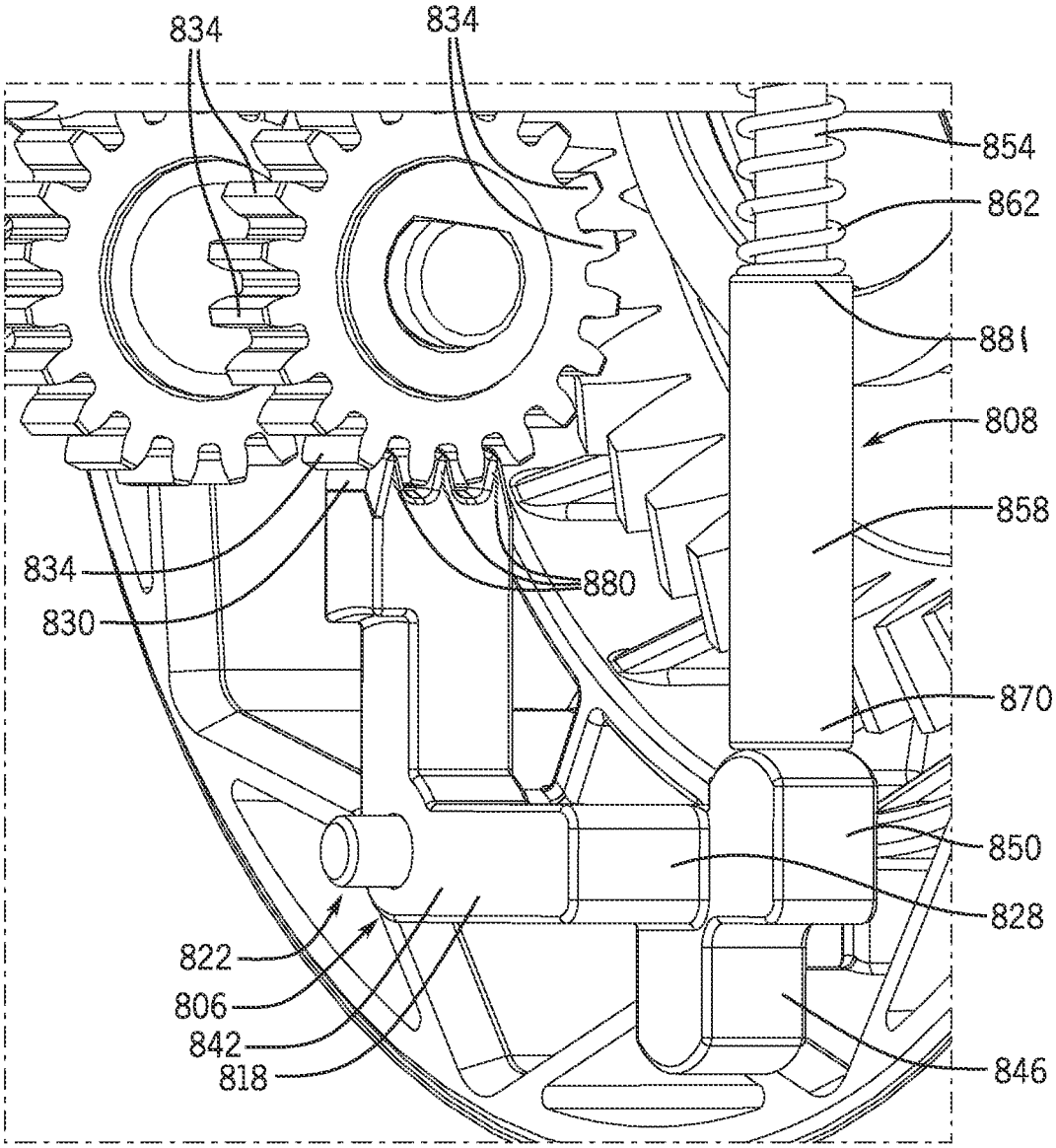
FIG. 33B is a close up isometric view of part of the lock mechanism of this example in a second configuration, similar to that shown in FIG. 31B.

FIGS. 31B and 33B each show the lock mechanism 804 in a second configuration, with the barbell disengaged actuation member 796 on the base 782. The base 782 is shown schematically here, but is similar to the base as at least shown in FIG. 5C. When disengaged from the base 782 a sufficient amount that the lock disengagement pin 812 on the base 782 disengages from the first contact feature 846 of the second portion 818 of the lock lever 806, the locking pin 808 moves downwardly under the biasing force of the spring 862 against the second portion 818 of the lock lever 806. The locking pin 808 causes the lock lever 806 to rotate about the pivot axle to move the lock lever 806 into the second configuration, where the lock mechanism 804 is engaged with the gear assembly 788. In this second configuration, the weight selector assembly 780 is not operational because movement of the gear assembly 788 is inhibited. Thus the number of weights selected for adjusting the load of the barbell may not be changed.

More specifically, once the disengagement pin 812 disengages from the second portion 818 of the lock lever 806, the locking pin 808 contacting the lock lever 806 causes the lock lever 806 to pivot about the pivot axle, shown here in a clockwise direction, so that the end portion 826 is engaged with the pinion gear 788 of the gear assembly 788. In one example, the locking pin 808 engages the second contact feature 850 on the lock lever 806. The second contact feature 850 may in one example be the upwardly extending tab defined by the second contact feature 850.

Referring still to FIGS. 31A and 31B, the movement of the lock lever 806 may be in an arc about the pivot structure 822. This arcuate movement may be in a plane transverse to the extension of the rod 792, and in one example may be at right angles to the extension of the rod 792. This arcuate movement includes a motion at least partially in a first direction, such as vertically as shown, and at least partially in a second direction, such as horizontally as shown. Alternatively, the lock lever 806 may be configured to move only in a single direction, such as a linear translatory motion, such as only vertically or only horizontally in the referenced figures. For example the lock lever 806 may move in a direction aligned with the movement of the disengagement pin 812 relative to the selector housing 784, which in one example may be upwardly as shown between FIGS. 31A and 31B.

Referring to FIGS. 30A, 30B, 33A and 33B, the at least one gear tooth 830 on the end portion 826 of the lock lever 806 may define a tapered side edge 880 that facilitates the selective engagement with, or enmeshing with, the gear teeth 834 on the particular gear of the gear assembly 788. In one example the gear is the pinion gear 788 that engages the rack 838 on the rod 792. The lock lever 806 moves in an at least partially lateral direction when moving between the first and second configurations to cause the end portion 826 to engage or disengage the pinion gear 788. When moving from the second configuration (not engaging) to the first configuration (engaging), the tooth or teeth 830 on the end portion 826 enmesh with the gear teeth 834 by moving generally laterally into engagement from a side of the pinion gear 798, as shown in the transition between FIGS. 33A and 33B.

In the example shown, the end portion 126 moves into engagement with the pinion gear 798 as the lock lever moves from the second configuration to the first configuration as the lock lever rotates under the biasing force of the locking pin 808. The end portion moves, in this example as shown, clockwise in an arcuate motion including both lateral and vertical components (with reference to FIGS. 31A and 31B). This motion of the end portion 126 moves the at least one tooth 830 into engagement from the side of the pinion gear 798 opposite from the location of the locking pin 808.

The lateral side edge 880 of the tooth or teeth 830 on the end portion 826 may have a tapered shape, such as a wedge shape, with a narrower terminal edge 882 gradually widening to the center of the tooth 830. The tapered side edge 880 is a "leading edge" since the tapered edge 880, and the terminal edge 882, is the first part of the at least one tooth 830 to pass into the spaces between the gear teeth 834 of the pinion gear 788. The tapered leading edge 880 is narrower than the spaces or gap formed between the teeth 834 on the gear. This allows the tooth or teeth 830 on the end portion 826 to fit with and enmesh with the teeth 834 on the pinion gear 788 when the respective teeth 830 and 834 are in general alignment, or are generally out of alignment with one another. If generally out of alignment with one another, the tapered leading edges 880 may result in a small rotation of the pinion gear 798 as it adjusts to be aligned with the teeth 830 of the lock lever 806.

In one example, an adjustable barbell includes a handle assembly comprising a bar, a weight selector assembly 780 comprising a rod 792 movably coupled to the bar, and a gear assembly 788 configured to cause axial movement of the rod 792 relative to the bar; and a lock mechanism 804 having a first configuration disengaged from the gear assembly 788 wherein the weight selector assembly 780 is operable to move the rod 792 to selectively couple one or more of a plurality of removable weights to the handle assembly, and a second configuration in engagement with the gear assembly 788 preventing the rotation of the weight selector assembly 780. Additionally, in one example, the movement of the lock mechanism 804 between the first configuration and the second configuration may include movement in at least a first direction or at least in a first direction and a second direction. Additionally, the lock mechanism 804 may move in a curved motion.

Alternatively or additionally, in the second configuration the lock mechanism 804 may be configured to engage with at least one gear of the gear assembly 788.

Alternatively of additionally, the lock mechanism 804 may include at least one tooth 830 that engages with teeth 834 of the at least one gear to prevent the at least one gear from moving. Additionally, the at least one tooth 830 may laterally engage with the teeth 834 of the at least one gear. Additionally, the at least one tooth 830 may define a wedge shaped lateral side edge to engage the teeth 834 of the at least one gear.

Alternatively or additionally, the lock mechanism 804 may pivot between at least the first configuration engaging the gear of the gear assembly 788 and the second configuration disengaged from the gear of the gear assembly 788. Additionally, the lock mechanism 804 may be pivotally supported by a housing.

Additionally or alternatively, the lock mechanism 804 may include a locking pin 808 configured to move the locking mechanism from the first configuration to the second configuration. Additionally, the locking pin 808 may be biased to resiliently hold the lock mechanism 804 in the second configuration. Alternatively or additionally, the locking pin 808 may move linearly.

Alternatively or additionally, the lock mechanism 804 may include a lock lever 806 having a first portion 816 and a second portion 818, the first portion 816 defining an end portion 826 having the at least one tooth 830. Additionally, the second portion 818 of the lock mechanism 804 includes a first contact feature 846 and a second contact feature, the first and second contact features offset from the second portion 818. Additionally, the first contact feature 846 extends away from the second portion 818, and the second contact feature extends away from the second portion 818 in a different direction than the first contact feature 846. Additionally or alternatively, the locking pin 808 engages the second contact feature.

Additionally or alternatively, the adjustable barbell may include a base 782 configured to support the adjustable barbell, the base 782 including a disengagement pin 812 configured to engage the lock mechanism 804 and move it from a first configuration to a second configuration when the adjustable barbell is received on the base 782. Additionally, the disengagement pin 812 may engage the lock lever 806. Additionally, the disengagement pin 812 may engage a second portion 818 of the lock lever 806. Additionally, the disengagement pin 812 may engage the first contact feature 846 of the lock lever 806. Additionally, the first contact feature 846 extends from the second portion 818 in a direction toward the disengagement pin 812.

Additionally or alternatively, the barbell system may include a bar that defines a rack 838, and the gear assembly 788 includes a plurality of gears including a pinion gear 788 engaging the rack 838, and a plurality of gears configured to drive the rod 792 responsive to actuation of the weight selector assembly 780. Additionally, the lock mechanism 804 may engage the pinion gear 788 in the second configuration. Additionally the gear assembly 788 may include a main bevel gear 778 fixed to the selector ring, and a plurality of intermediate gears operatively engaged between the main bevel gear 778 and the pinion gear 788 to move the rod 792 responsive to rotation of the main bevel gear 778. Additionally, the plurality of intermediate gears may include an intermediate bevel gear 778 meshed with the main bevel gear 778, a first spur gear coaxial and rotating synchronously with the intermediate bevel gear 778, and a second spur gear meshed with the first spur gear, and wherein the second spur gear is coaxial to and rotating synchronously with the pinion gear 788.

The adjustable barbell system according to the present disclosure may provide a number of benefits. For instance, the adjustable barbell systems (e.g., systems 100 and 500) may be more compact than a traditional barbell system that use separate manually attachable weights. Additionally, an adjustable barbell system of the kind described herein may reduce or prevent injury by obviating the need for the user to manually add or remove weights from the ends of the bar (e.g., thus reducing the risk of a dropped weight and/or pinched fingers). Additionally, the user's experience may be further improved by increasing the efficiency of a workout, e.g., as not only the weight changes to the barbell are made more efficient by the current system but also by obviating the need for the user to pause his or her workout to calculate what combination of weights need to be added to the bar to achieve a desired total weight of the barbell.

This summary is provided to aid in understanding of the present disclosure. Each of the various aspects and features of the disclosure may advantageously be used separately in some instances, or in combination with other aspects and features of the disclosure in other instances. Accordingly, while the disclosure is presented in terms of examples, individual aspects of any example can be claimed separately or in combination with aspects and features of that example or any other example. This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

As used in the claims with respect to connection between components (e.g., between a weight and the handle assembly), phrases such as "fixed," "fixedly connected," "fixedly joined," or variations thereof (e.g., "fixedly connects" or "fixedly joins") refer to a condition in which the connection between the components is intended as a rigid connection (i.e. restricting all six degrees of freedom). In the "fixedly connected" or "fixedly joined" state, the weight is intended to contribute to the total weight of the barbell by remaining joined to the handle assembly during use in an exercise by the user. All relative or directional references (e.g., proximal, distal, upper, lower, upward, downward, left, right, lateral, longitudinal, front, back, top, bottom, above, below, vertical, horizontal, radial, axial, clockwise, counterclockwise, and so forth) are used by way of example to aid the reader's understanding of the particular examples described, and, unless specifically so note or set forth in the claims, should not be read as a requirement or limitation, such as to the position, orientation, or use. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. An adjustable barbell comprising:

a handle assembly comprising:

a bar;

a weight selector assembly comprising a rod movably coupled to the bar, and a gear assembly configured to cause axial movement of the rod relative to the bar; and a lock mechanism having:

a first configuration disengaged from the gear assembly wherein the weight selector assembly is operable to move the rod to selectively couple one or more of a plurality of removable weights to the handle assembly, and a second configuration in engagement with the gear assembly preventing the rotation of the weight selector assembly, wherein the lock mechanism pivots between at least the first configuration engaging a gear of the gear assembly and the second configuration disengaged from the gear of the gear assembly.

2. The adjustable barbell of claim 1, wherein the movement of the lock mechanism between the first configuration and the second configuration includes movement in at least a first direction or at least in a first direction and a second direction.

3. The adjustable barbell of claim 2, wherein the lock mechanism moves in a curved motion.

4. The adjustable barbell of claim 1 wherein:

in the second configuration the lock mechanism is configured to engage with at least one gear of the gear assembly, the lock mechanism including at least one tooth that engages with teeth of the at least one gear to prevent the at least one gear from moving.

5. The adjustable barbell of claim 4, wherein the at least one tooth laterally engages with the teeth of the at least one gear.

6. The adjustable barbell of claim 5, wherein the at least one tooth defines a wedge shaped lateral side edge to engage the teeth of the at least one gear.

7. The adjustable barbell of claim 4, wherein the lock mechanism includes a lock lever having a first portion and a second portion, the first portion defining an end portion having the at least one tooth.

8. The adjustable barbell of claim 7, wherein the second portion of the lock mechanism includes a first contact feature and a second contact feature, the first and second contact features offset from the second portion.

9. The adjustable barbell of claim 8, wherein the first contact feature extends away from the second portion, and the second contact feature extends away from the second portion in a different direction than the first contact feature.

10. The adjustable barbell of claim 1, wherein the lock mechanism includes a locking pin configured to move the lock mechanism from the first configuration to the second configuration.

11. The adjustable barbell of claim 10, wherein the locking pin is biased to resiliently hold the lock mechanism in the second configuration.

12. The adjustable barbell of claim 1, further comprising:

a base configured to support the adjustable barbell, the base including a disengagement pin configured to engage the lock mechanism and move it from a first configuration to a second configuration when the adjustable barbell is received on the base.

13. The adjustable barbell of claim 12, wherein the disengagement pin engages a contact feature of a lock lever of the lock mechanism, the contact feature extending in a direction toward the disengagement pin.

14. The adjustable barbell of claim 1, wherein:

the bar defines a rack; and the gear assembly comprises:

a pinion gear engaging the rack, and a plurality of gears configured to drive the rod responsive to actuation of the weight selector assembly.

15. The adjustable barbell of claim 14, wherein the lock mechanism engages the pinion gear in the second configuration.

16. The adjustable barbell of claim 15, wherein:

the gear assembly comprises:

a main bevel gear fixed to the selector ring, and a plurality of intermediate gears operatively engaged between the main bevel gear and the pinion gear to move the rod responsive to rotation of the main bevel gear.

17. The adjustable barbell of claim 16, wherein:

the plurality of intermediate gears includes an intermediate bevel gear meshed with the main bevel gear, a first spur gear coaxial and rotating synchronously with the intermediate bevel gear, and a second spur gear meshed with the first spur gear, and wherein the second spur gear is coaxial to and rotating synchronously with the pinion gear.

18. An adjustable barbell comprising:

a bar;

a weight selector assembly comprising a rod movably coupled to the bar, and at least one gear configured to cause axial movement of the rod relative to the bar; and a lock mechanism pivotable between a first configuration and a second configuration, wherein:

the first configuration disengages the lock mechanism from the at least one gear to allow a rotation of the weight selector assembly to move the rod to selectively couple one or more of a plurality of removable weights to the adjustable barbell, and the second configuration engages the lock mechanism with the at least one gear to prevent the rotation of the weight selector assembly.

19. A system comprising:

an adjustable barbell comprising:

a bar;

a weight selector assembly comprising a rod movably coupled to the bar, and a gear assembly configured to cause axial movement of the rod relative to the bar; and a lock mechanism pivotable between a first configuration and a second configuration, wherein:

the first configuration disengages the lock mechanism from the gear assembly to allow a rotation of the weight selector assembly to move the rod to selectively couple one or more of a plurality of removable weights to the adjustable barbell, and the second configuration engages the lock mechanism with the gear assembly to prevent the rotation of the weight selector assembly; and a base configured to support the adjustable barbell, the base configured to engage the lock mechanism to pivot the lock mechanism from the second configuration to the first configuration.

* * * * *